US011000730B2

(12) United States Patent
Dalebout et al.

(10) Patent No.: US 11,000,730 B2
(45) Date of Patent: May 11, 2021

(54) ELLIPTICAL EXERCISE MACHINE

(71) Applicant: ICON Health & Fitness, Inc., Logan, UT (US)

(72) Inventors: William T. Dalebout, North Logan, UT (US); Gaylen Ercanbrack, Logan, UT (US)

(73) Assignee: ICON HEALTH & FITNESS, INC., Logan, UT (US)

( * ) Notice: Subject to any disclaimer, the term of this patent is extended or adjusted under 35 U.S.C. 154(b) by 0 days.

(21) Appl. No.: 16/351,156

(22) Filed: Mar. 12, 2019

(65) Prior Publication Data

US 2019/0282852 A1 Sep. 19, 2019

Related U.S. Application Data

(60) Provisional application No. 62/644,133, filed on Mar. 16, 2018.

(51) Int. Cl.
*A63B 22/06* (2006.01)
*A63B 21/22* (2006.01)
(Continued)

(52) U.S. Cl.
CPC .... *A63B 22/0664* (2013.01); *A63B 21/00192* (2013.01); *A63B 21/154* (2013.01); *A63B 21/225* (2013.01); *A63B 22/001* (2013.01); *A63B 23/03575* (2013.01); *A63B 2022/0676* (2013.01); *A63B 2210/00* (2013.01)

(58) Field of Classification Search
CPC ..... A63B 21/00192; A63B 21/154; A63B 21/225; A63B 22/001; A63B 22/0664; A63B 23/03575; A63B 24/0084; A63B 71/0622; A63B 2022/0676; A63B 2022/0682; A63B 2209/08; A63B 2210/00; A63B 2220/17; A63B 2220/20;
(Continued)

(56) References Cited

U.S. PATENT DOCUMENTS 3,123,646 A 3/1964 Easton
3,579,339 A 5/1971 Chang
(Continued)

OTHER PUBLICATIONS

U.S. Appl. No. 13/088,007, filed Apr. 15, 2011, Scott R. Watterson.
(Continued)

*Primary Examiner* — Joshua Lee
(74) *Attorney, Agent, or Firm* — Maschoff Brennan

(57) ABSTRACT

An elliptical exercise machine may include a base, one or more upright stanchions coupled to the base and extending upward from the base and supporting first and second cranks. The first crank may support a first crank arm. The first crank arm may support a first pedal leg hanging downward from the first crank arm. The first pedal leg may support a right pedal. The right pedal may be configured to swing forward and rearward and to raise upward and lower downward. The second crank may support a second crank arm. The second crank arm may support a second pedal leg hanging downward from the second crank arm. The second pedal leg may support a left pedal. The left pedal may be configured to swing forward and rearward and to raise upward and lower downward.

17 Claims, 55 Drawing Sheets

(51) Int. Cl.
*A63B 21/00* (2006.01)
*A63B 22/00* (2006.01)
*A63B 23/035* (2006.01)

(58) Field of Classification Search
CPC ..... A63B 2220/22; A63B 2220/80; A63B 2230/06; A63B 2230/40; A63B 2230/75
See application file for complete search history.

(56) References Cited

U.S. PATENT DOCUMENTS 4,023,795 A 5/1977 Pauls
4,300,760 A 11/1981 Bobroff
D286,311 S 10/1986 Martinell
4,681,318 A 7/1987 Lay
4,684,126 A 8/1987 Dalebout
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet
4,850,585 A 7/1989 Dalebout
D304,849 S 11/1989 Watterson
4,880,225 A 11/1989 Lucas
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham
D307,615 S 5/1990 Bingham
4,921,242 A 5/1990 Watterson
4,932,650 A 6/1990 Bingham
D309,167 S 7/1990 Griffin
D309,485 S 7/1990 Bingham
4,938,478 A 7/1990 Lay
D310,253 S 8/1990 Bersonnet
4,955,599 A 9/1990 Bersonnet
4,971,316 A 11/1990 Dalebout
D313,055 S 12/1990 Watterson
4,974,832 A 12/1990 Dalebout
4,979,737 A 12/1990 Kock
4,981,294 A 1/1991 Dalebout
D315,765 S 3/1991 Measom
4,998,725 A 3/1991 Watterson et al.
5,000,442 A 3/1991 Dalebout
5,000,443 A 3/1991 Dalebout
5,000,444 A 3/1991 Dalebout
D316,124 S 4/1991 Dalebout
5,013,033 A 5/1991 Watterson
5,014,980 A 5/1991 Bersonnet
5,016,871 A 5/1991 Dalebout
D318,085 S 7/1991 Jacobson
D318,086 S 7/1991 Bingham
D318,699 S 7/1991 Jacobson
5,029,801 A 7/1991 Dalebout
5,034,576 A 7/1991 Dalebout
5,058,881 A 10/1991 Measom
5,058,882 A 10/1991 Dalebout
D321,388 S 11/1991 Dalebout
5,062,626 A 11/1991 Dalebout
5,062,627 A 11/1991 Bingham
5,062,632 A 11/1991 Dalebout
5,062,633 A 11/1991 Engel et al.
5,067,710 A 11/1991 Watterson et al.
5,072,929 A 12/1991 Peterson
D323,009 S 1/1992 Dalebout
D323,198 S 1/1992 Dalebout
D323,199 S 1/1992 Dalebout
D323,863 S 2/1992 Watterson
5,088,729 A 2/1992 Dalebout
5,090,694 A 2/1992 Pauls
5,102,380 A 4/1992 Jacobson
5,104,120 A 4/1992 Watterson
5,108,093 A 4/1992 Watterson
D326,491 S 5/1992 Dalebout
5,122,105 A 6/1992 Engel
5,135,216 A 8/1992 Bingham
5,147,265 A 9/1992 Pauls
5,149,084 A 9/1992 Dalebout
5,149,312 A 9/1992 Croft et al.
5,171,196 A 12/1992 Lynch
D332,347 S 1/1993 Raadt
5,190,505 A 3/1993 Dalebout
5,192,255 A 3/1993 Dalebout
5,195,937 A 3/1993 Engel
5,203,826 A 4/1993 Dalebout
D335,511 S 5/1993 Engel
D335,905 S 5/1993 Cutter
D336,498 S 6/1993 Engel
5,217,487 A 6/1993 Engel
D337,361 S 7/1993 Engel
D337,666 S 7/1993 Peterson
D337,799 S 7/1993 Cutter
5,226,866 A 7/1993 Engel
5,238,462 A * 8/1993 Cinke ..... A63B 22/0056 482/51
5,244,446 A 9/1993 Engel
5,247,853 A 9/1993 Dalebout
5,259,611 A 11/1993 Dalebout
D342,106 S 12/1993 Campbell
5,279,528 A 1/1994 Dalebout
D344,112 S 2/1994 Smith
D344,557 S 2/1994 Ashby
5,282,776 A 2/1994 Dalebout
5,295,931 A 3/1994 Dreibelbis
5,302,161 A 4/1994 Loubert
D347,251 S 5/1994 Dreibelbis
5,316,534 A 5/1994 Dalebout
D348,493 S 7/1994 Ashby
D348,494 S 7/1994 Ashby
5,328,164 A 7/1994 Soga
D349,931 S 8/1994 Bostic
5,336,142 A 8/1994 Dalebout
5,344,376 A 9/1994 Bostic
D351,202 S 10/1994 Bingham
D351,435 S 10/1994 Peterson
D351,633 S 10/1994 Bingham
D352,534 S 11/1994 Dreibelbis
D353,422 S 12/1994 Bostic
5,372,559 A 12/1994 Dalebout
5,374,228 A 12/1994 Buisman
5,382,221 A 1/1995 Hsu
5,387,168 A 2/1995 Bostic
5,393,690 A 2/1995 Fu
D356,128 S 3/1995 Smith
5,409,435 A 4/1995 Daniels
5,429,563 A 7/1995 Engel
5,431,612 A 7/1995 Holden
D360,915 S 8/1995 Bostic
5,468,205 A 11/1995 McFall
5,489,249 A 2/1996 Brewer et al.
5,492,517 A 2/1996 Bostic
D367,689 S 3/1996 Wilkinson
5,511,740 A 4/1996 Loubert
5,512,025 A 4/1996 Dalebout et al.
D370,949 S 6/1996 Furner
D371,176 S 6/1996 Furner
5,527,245 A 6/1996 Dalebout
5,529,553 A 6/1996 Finlayson
5,540,429 A 7/1996 Dalebout
5,549,533 A 8/1996 Olson
5,554,085 A 9/1996 Dalebout
5,569,128 A 10/1996 Dalebout
5,591,105 A 1/1997 Dalebout
5,591,106 A 1/1997 Dalebout
5,595,556 A 1/1997 Dalebout
5,607,375 A 3/1997 Dalebout
5,611,539 A 3/1997 Watterson
5,622,527 A 4/1997 Watterson et al.
5,626,538 A 5/1997 Dalebout
5,626,542 A 5/1997 Dalebout
D380,024 S 6/1997 Novak
5,637,059 A 6/1997 Dalebout

(56) References Cited

U.S. PATENT DOCUMENTS

| | | | |
|---|---|---|---|
| D380,509 | S | 7/1997 | Wilkinson |
| 5,643,153 | A | 7/1997 | Nylen |
| 5,645,509 | A | 7/1997 | Brewer et al. |
| D384,118 | S | 9/1997 | Deblauw |
| 5,662,557 | A | 9/1997 | Watterson |
| 5,669,857 | A | 9/1997 | Watterson et al. |
| 5,672,140 | A | 9/1997 | Watterson |
| 5,674,156 | A | 10/1997 | Watterson |
| 5,674,453 | A | 10/1997 | Watterson |
| 5,676,624 | A | 10/1997 | Watterson |
| 5,683,331 | A | 11/1997 | Dalebout |
| 5,683,332 | A | 11/1997 | Watterson |
| D387,825 | S | 12/1997 | Fleck |
| 5,695,433 | A | 12/1997 | Buisman |
| 5,695,434 | A | 12/1997 | Dalebout |
| 5,695,435 | A | 12/1997 | Dalebout |
| 5,702,325 | A | 12/1997 | Watterson |
| 5,704,879 | A | 1/1998 | Watterson |
| 5,718,657 | A | 2/1998 | Dalebout et al. |
| 5,720,200 | A | 2/1998 | Anderson et al. |
| 5,720,698 | A | 2/1998 | Dalebout |
| D392,006 | S | 3/1998 | Dalebout |
| 5,722,922 | A | 3/1998 | Watterson |
| 5,733,229 | A | 3/1998 | Dalebout |
| 5,743,833 | A | 4/1998 | Watterson |
| 5,762,584 | A | 6/1998 | Daniels |
| 5,762,587 | A | 6/1998 | Dalebout et al. |
| 5,772,560 | A | 6/1998 | Watterson |
| 5,810,698 | A | 9/1998 | Hullett |
| 5,827,155 | A | 10/1998 | Jensen |
| 5,830,114 | A | 11/1998 | Halfen |
| 5,860,893 | A | 1/1999 | Watterson |
| 5,860,894 | A | 1/1999 | Dalebout |
| 5,899,834 | A | 5/1999 | Dalebout |
| D412,953 | S | 8/1999 | Armstrong |
| D413,948 | S | 9/1999 | Dalebout |
| 5,951,441 | A | 9/1999 | Dalebout |
| 5,951,448 | A | 9/1999 | Bolland |
| D416,596 | S | 11/1999 | Armstrong |
| 6,003,166 | A | 12/1999 | Hald |
| 6,019,710 | A | 2/2000 | Dalebout et al. |
| 6,027,429 | A | 2/2000 | Daniels |
| 6,033,347 | A | 3/2000 | Dalebout et al. |
| D425,940 | S | 5/2000 | Halfen |
| 6,059,692 | A | 5/2000 | Hickman |
| D428,949 | S | 8/2000 | Simonson |
| 6,123,646 | A | 9/2000 | Colassi |
| 6,171,217 | B1 | 1/2001 | Cutler |
| 6,171,219 | B1 | 1/2001 | Simonson |
| 6,174,267 | B1 | 1/2001 | Dalebout |
| 6,193,631 | B1 | 2/2001 | Hickman |
| 6,228,003 | B1 | 5/2001 | Hald |
| 6,238,323 | B1 | 5/2001 | Simonson |
| 6,251,052 | B1 | 6/2001 | Simonson |
| 6,261,022 | B1 | 7/2001 | Dalebout et al. |
| 6,280,362 | B1 | 8/2001 | Dalebout et al. |
| 6,296,594 | B1 | 10/2001 | Simonson |
| D450,872 | S | 11/2001 | Dalebout |
| 6,312,363 | B1 | 11/2001 | Watterson et al. |
| D452,338 | S | 12/2001 | Dalebout |
| D453,543 | S | 2/2002 | Cutler |
| D453,948 | S | 2/2002 | Cutler |
| 6,350,218 | B1 | 2/2002 | Dalebout et al. |
| 6,387,020 | B1 | 5/2002 | Simonson |
| 6,413,191 | B1 | 7/2002 | Harris |
| 6,422,980 | B1 | 7/2002 | Simonson |
| 6,447,424 | B1 | 9/2002 | Ashby et al. |
| 6,458,060 | B1 | 10/2002 | Watterson et al. |
| 6,458,061 | B2 | 10/2002 | Simonson |
| 6,471,622 | B1 | 10/2002 | Hammer |
| 6,563,225 | B2 | 5/2003 | Soga |
| 6,601,016 | B1 | 7/2003 | Brown et al. |
| 6,623,140 | B2 | 9/2003 | Watterson |
| 6,626,799 | B2 | 9/2003 | Watterson et al. |
| 6,652,424 | B2 | 11/2003 | Dalebout |
| 6,685,607 | B1 | 2/2004 | Olson |
| 6,695,581 | B2 | 2/2004 | Wasson |
| 6,701,271 | B2 | 3/2004 | Willner et al. |
| 6,702,719 | B1 | 3/2004 | Brown et al. |
| 6,712,740 | B2 | 3/2004 | Simonson |
| 6,730,002 | B2 | 5/2004 | Hald |
| 6,743,153 | B2 | 6/2004 | Watterson |
| 6,746,371 | B1 | 6/2004 | Brown et al. |
| 6,749,537 | B1 | 6/2004 | Hickman |
| 6,761,667 | B1 | 7/2004 | Cutler et al. |
| 6,770,015 | B2 | 8/2004 | Simonson |
| 6,786,852 | B2 | 9/2004 | Watterson |
| 6,808,472 | B1 | 10/2004 | Hickman |
| 6,821,230 | B2 | 11/2004 | Dalebout |
| 6,830,540 | B2 | 12/2004 | Watterson et al. |
| 6,863,641 | B1 | 3/2005 | Brown et al. |
| 6,866,613 | B1 | 3/2005 | Brown et al. |
| 6,875,160 | B2 | 4/2005 | Watterson et al. |
| D507,311 | S | 7/2005 | Butler |
| 6,918,858 | B2 | 7/2005 | Watterson et al. |
| 6,921,351 | B1 | 7/2005 | Hickman et al. |
| 6,974,404 | B1 | 12/2005 | Watterson |
| 6,997,852 | B2 | 2/2006 | Watterson et al. |
| 7,025,713 | B2 | 4/2006 | Dalebout |
| D520,085 | S | 5/2006 | Willardson |
| 7,044,897 | B2 | 5/2006 | Myers |
| 7,052,442 | B2 | 5/2006 | Watterson |
| 7,060,006 | B1 | 6/2006 | Watterson et al. |
| 7,060,008 | B2 | 6/2006 | Watterson et al. |
| 7,070,539 | B2 | 7/2006 | Brown et al. |
| 7,097,588 | B2 | 8/2006 | Watterson |
| D527,776 | S | 9/2006 | Willardson |
| 7,112,168 | B2 | 9/2006 | Dalebout et al. |
| 7,128,693 | B2 | 10/2006 | Brown et al. |
| 7,166,062 | B1 | 1/2007 | Watterson et al. |
| 7,166,064 | B2 | 1/2007 | Watterson et al. |
| 7,169,087 | B2 | 1/2007 | Ercanbrack et al. |
| 7,169,093 | B2 | 1/2007 | Simonson |
| 7,192,388 | B2 | 3/2007 | Dalebout |
| 7,250,022 | B2 | 7/2007 | Dalebout |
| 7,282,016 | B2 | 10/2007 | Simonson |
| 7,285,075 | B2 | 10/2007 | Cutler |
| 7,344,481 | B2 | 3/2008 | Watterson |
| 7,377,882 | B2 | 5/2008 | Watterson |
| 7,425,188 | B2 | 9/2008 | Ercanbrack |
| 7,429,236 | B2 | 9/2008 | Dalebout |
| 7,455,622 | B2 | 11/2008 | Watterson et al. |
| 7,482,050 | B2 | 1/2009 | Olson |
| D588,655 | S | 3/2009 | Utykanski |
| 7,510,509 | B2 | 3/2009 | Hickman |
| 7,537,546 | B2 | 5/2009 | Watterson et al. |
| 7,537,549 | B2 | 5/2009 | Nelson |
| 7,537,552 | B2 | 5/2009 | Dalebout |
| 7,540,828 | B2 | 6/2009 | Watterson |
| 7,549,947 | B2 | 6/2009 | Hickman et al. |
| 7,556,590 | B2 | 7/2009 | Watterson et al. |
| 7,563,203 | B2 | 7/2009 | Dalebout |
| 7,575,536 | B1 | 8/2009 | Hickman |
| 7,601,105 | B1 | 10/2009 | Gipson, III |
| 7,604,573 | B2 | 10/2009 | Dalebout et al. |
| D604,373 | S | 11/2009 | Dalebout |
| 7,618,350 | B2 | 11/2009 | Dalebout et al. |
| 7,618,357 | B2 | 11/2009 | Dalebout |
| 7,625,315 | B2 | 12/2009 | Hickman |
| 7,625,321 | B2 | 12/2009 | Simonson |
| 7,628,730 | B1 | 12/2009 | Watterson et al. |
| 7,628,737 | B2 | 12/2009 | Kowallis |
| 7,637,847 | B1 | 12/2009 | Hickman |
| 7,645,212 | B2 | 1/2010 | Ashby et al. |
| 7,645,213 | B2 | 1/2010 | Watterson |
| 7,658,698 | B2 | 2/2010 | Pacheco |
| 7,674,205 | B2 | 3/2010 | Dalebout et al. |
| 7,713,171 | B1 | 5/2010 | Hickman |
| 7,713,172 | B2 | 5/2010 | Watterson et al. |
| 7,713,180 | B2 | 5/2010 | Wickens |
| 7,717,828 | B2 | 5/2010 | Simonson |
| 7,736,279 | B2 | 6/2010 | Dalebout et al. |
| 7,740,563 | B2 | 6/2010 | Dalebout et al. |
| 7,749,144 | B2 | 7/2010 | Hammer |

(56) References Cited

U.S. PATENT DOCUMENTS 7,766,797 B2 8/2010 Dalebout
7,771,329 B2 8/2010 Dalebout
7,775,940 B2 8/2010 Dalebout et al.
7,789,800 B1 9/2010 Watterson et al.
7,798,946 B2 9/2010 Dalebout
7,815,550 B2 10/2010 Watterson
7,857,731 B2 12/2010 Hickman et al.
7,862,475 B2 1/2011 Watterson
7,862,478 B2 1/2011 Watterson et al.
7,862,483 B2 1/2011 Hendrickson
D635,207 S 3/2011 Dalebout
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout
D650,451 S 12/2011 Olson
D652,877 S 1/2012 Dalebout
8,152,702 B2 4/2012 Pacheco
D659,775 S 5/2012 Olson
D659,777 S 5/2012 Watterson
D660,383 S 5/2012 Watterson
D664,613 S 7/2012 Dalebout
8,251,874 B2 8/2012 Ashby et al.
8,298,123 B2 10/2012 Hickman
8,298,125 B2 10/2012 Colledge
D671,177 S 11/2012 Sip
D671,178 S 11/2012 Sip
D673,626 S 1/2013 Olson
8,690,735 B2 4/2014 Watterson et al.
D707,763 S 6/2014 Cutler
8,740,753 B2 6/2014 Olson
8,758,201 B2 6/2014 Ashby et al.
8,771,153 B2 7/2014 Dalebout
8,784,270 B2 7/2014 Watterson
8,808,148 B2 8/2014 Watterson
8,814,762 B2 8/2014 Butler
D712,493 S 9/2014 Ercanbrack
8,840,075 B2 9/2014 Michael Olson
8,845,493 B2 9/2014 Watterson et al.
8,870,726 B2 10/2014 Watterson
8,876,668 B2 11/2014 Hendrickson
8,894,549 B2 11/2014 Colledge
8,894,555 B2 11/2014 Michael L Olson
8,911,330 B2 12/2014 Watterson et al.
8,920,288 B2 12/2014 Dalebout
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson
9,039,578 B2 5/2015 Dalebout
D731,011 S 6/2015 Buchanan
9,072,930 B2 7/2015 Ashby
9,119,983 B2 9/2015 Rhea
9,123,317 B2 9/2015 Watterson et al.
9,126,071 B2 9/2015 Smith
9,126,072 B2 9/2015 Watterson
9,138,614 B2 * 9/2015 Lu ..... A63B 21/154
9,138,615 B2 9/2015 Olson
9,142,139 B2 9/2015 Watterson et al.
9,144,703 B2 9/2015 Dalebout
9,149,683 B2 9/2015 Smith
9,186,535 B2 11/2015 Ercanbrack
9,186,549 B2 11/2015 Watterson et al.
9,192,811 B1 * 11/2015 Miller ..... A63B 22/001
9,199,115 B2 * 12/2015 Yim ..... A63B 21/4034
9,254,409 B2 2/2016 Dalebout
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
D864,320 S 5/2016 Weston
D864,321 S 5/2016 Weston
9,339,691 B2 5/2016 Brammer
9,352,185 B2 5/2016 Hendrickson
9,352,186 B2 5/2016 Watterson
9,375,605 B2 6/2016 Tyger
9,381,394 B2 7/2016 Mortensen et al.
9,387,387 B2 7/2016 Dalebout
9,393,453 B2 7/2016 Watterson
9,403,047 B2 8/2016 Olson
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Kent M Smith
9,498,672 B1 * 11/2016 Miller ..... A63B 23/03516
9,517,378 B2 12/2016 Ashby
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout
9,616,278 B2 4/2017 Olson
9,623,281 B2 4/2017 Hendrickson
9,636,567 B2 5/2017 Brammer et al.
9,649,529 B1 * 5/2017 Miller ..... A63B 22/001
9,675,839 B2 6/2017 Dalebout
9,682,307 B2 6/2017 Dalebout
9,694,234 B2 7/2017 Dalebout
9,694,242 B2 7/2017 Ashby
9,737,755 B2 8/2017 Dalebout
9,757,605 B2 9/2017 Olson
9,764,186 B2 9/2017 Dalebout
9,767,785 B2 9/2017 Ashby
9,795,822 B2 10/2017 Smith
9,808,672 B2 11/2017 Dalebout
9,827,461 B1 * 11/2017 Miller ..... A63B 21/4035
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen
9,943,719 B2 4/2018 Smith
9,943,722 B2 4/2018 Dalebout
9,948,037 B2 4/2018 Ashby
9,950,209 B2 * 4/2018 Yim ..... A63B 22/0664
9,968,816 B2 5/2018 Olson
9,968,821 B2 5/2018 Finlayson et al.
9,968,823 B2 5/2018 Cutler
9,987,513 B2 * 6/2018 Yim ..... A63B 23/03516
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 9/2018 Smith
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson
10,207,143 B2 2/2019 Dalebout
10,207,145 B2 2/2019 Tyger

(56) References Cited

U.S. PATENT DOCUMENTS 10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,258,828 B2 4/2019 Dalebout et al.
10,272,317 B2 4/2019 Watterson
10,279,212 B2 5/2019 Dalebout
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
10,426,989 B2 10/2019 Dalebout
10,433,612 B2 10/2019 Ashby
10,441,840 B2 10/2019 Dalebout
10,449,416 B2 10/2019 Dalebout
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
2002/0016235 A1 2/2002 Ashby
2002/0077221 A1 6/2002 Dalebout
2002/0159253 A1 10/2002 Dalebout
2003/0045406 A1 3/2003 Stone
2004/0091307 A1 5/2004 James
2004/0171464 A1 9/2004 Ashby
2004/0171465 A1 9/2004 Hald
2005/0049123 A1 3/2005 Dalebout
2005/0077805 A1 4/2005 Dalebout
2005/0107229 A1 5/2005 Wickens
2005/0164839 A1 7/2005 Watterson
2005/0272577 A1 12/2005 Olson
2007/0117683 A1 5/2007 Ercanbrack
2007/0254778 A1 11/2007 Ashby
2008/0051256 A1 2/2008 Ashby
2008/0242520 A1 10/2008 Hubbard
2008/0300110 A1 12/2008 Smith
2009/0105052 A1 4/2009 Dalebout
2010/0242246 A1 9/2010 Dalebout et al.
2012/0237911 A1 9/2012 Watterson
2012/0295774 A1 11/2012 Dalebout
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson
2013/0196822 A1 8/2013 Watterson et al.
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson
2013/0281241 A1 10/2013 Watterson
2014/0024499 A1 1/2014 Watterson
2014/0073970 A1 3/2014 Ashby
2014/0121071 A1 5/2014 Strom
2014/0135173 A1 5/2014 Watterson
2014/0248998 A1* 9/2014 Lu ..... A63B 22/04 482/52
2014/0248999 A1* 9/2014 Lu ..... A63B 22/0664 482/52
2014/0249000 A1* 9/2014 Lu ..... A63B 22/001 482/52
2014/0274574 A1 9/2014 Shorten et al.
2014/0274579 A1 9/2014 Olson
2014/0287884 A1 9/2014 Buchanan
2014/0309085 A1 10/2014 Watterson et al.
2015/0182779 A1 7/2015 Dalebout
2015/0182781 A1 7/2015 Watterson
2015/0238817 A1 8/2015 Watterson
2015/0250418 A1 9/2015 Ashby
2015/0251055 A1 9/2015 Ashby
2015/0253210 A1 9/2015 Ashby et al.
2015/0253735 A1 9/2015 Watterson
2015/0253736 A1 9/2015 Watterson
2015/0258560 A1 9/2015 Ashby
2016/0008658 A1* 1/2016 Yim ..... A63B 22/001 482/52
2016/0058335 A1 3/2016 Ashby
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0250519 A1 9/2016 Watterson
2016/0253918 A1 9/2016 Watterson
2016/0346595 A1 12/2016 Dalebout
2017/0036053 A1 2/2017 Smith
2017/0056711 A1 3/2017 Dalebout
2017/0056715 A1 3/2017 Dalebout
2017/0124912 A1 5/2017 Ashby
2017/0193578 A1 7/2017 Watterson
2017/0266489 A1 9/2017 Douglass
2017/0266532 A1 9/2017 Watterson
2017/0266533 A1 9/2017 Dalebout et al.
2017/0270820 A1 9/2017 Ashby
2018/0001135 A1 1/2018 Powell
2018/0036585 A1 2/2018 Powell
2018/0084817 A1 3/2018 Capell et al.
2018/0085630 A1 3/2018 Capell et al.
2018/0089396 A1 3/2018 Capell et al.
2018/0099116 A1 4/2018 Ashby
2018/0099180 A1 4/2018 Wilkinson
2018/0111034 A1 4/2018 Watterson
2018/0117385 A1 5/2018 Watterson
2018/0117393 A1 5/2018 Ercanbrack
2018/0154209 A1 6/2018 Watterson
2018/0185698 A1* 7/2018 Anderson ..... A63B 21/154
2018/0200566 A1 7/2018 Weston
2019/0058370 A1 2/2019 Tinney
2019/0080624 A1 3/2019 Watterson
2019/0151698 A1 5/2019 Olson
2019/0168072 A1 6/2019 Brammer
2019/0178313 A1 6/2019 Wrobel
2019/0192898 A1 6/2019 Dalebout
2019/0192952 A1 6/2019 Powell
2019/0201730 A1* 7/2019 Smith ..... A63B 22/0664
2019/0209893 A1 7/2019 Watterson
2019/0223612 A1 7/2019 Wattereson
2019/0232112 A1 8/2019 Dalebout
2019/0269958 A1 9/2019 Dalebout
2019/0269971 A1 9/2019 Capell
2019/0275366 A1 9/2019 Powell
2019/0328079 A1 10/2019 Ashby
2019/0329091 A1 10/2019 Powell
2019/0376585 A1 12/2019 Buchanan
2020/0009417 A1 1/2020 Dalebout
2020/0016459 A1 1/2020 Smith
2020/0238130 A1 7/2020 Silcock et al.
2020/0254295 A1 8/2020 Watterson

(56) References Cited

U.S. PATENT DOCUMENTS

| | | | |
|---|---|---|---|
| 2020/0254309 | A1 | 8/2020 | Watterson |
| 2020/0254311 | A1 | 8/2020 | Watterson |

OTHER PUBLICATIONS

U.S. Appl. No. 16/252,834, filed Jan. 21, 2019, Scott R. Watterson.
U.S. Appl. No. 16/299,668, filed Mar. 12, 2019, Scott R. Watterson.
U.S. Appl. No. 16/351,156, filed Mar. 12, 2019, William T. Dalebout.
U.S. Appl. No. 16/378,022, filed Apr. 8, 2019, William T. Dalebout.
U.S. Appl. No. 16/435,104, filed Jun. 7, 2019, Dale Alan Buchanan.
U.S. Appl. No. 29/702,127, filed Sep. 16, 2019, Gordon Cutler.
U.S. Appl. No. 15/973,176, filed May 7, 2018, Melanie Douglass.
U.S. Appl. No. 16/879,376, filed May 20, 2020, David Hays.
U.S. Appl. No. 16/992,870, filed Aug. 13, 2020, Gaylen Ercanbrack.
U.S. Appl. No. 16/992,886, filed Aug. 13, 2020, William T. Dalebout.
U.S. Appl. No. 17/067,310, filed Oct. 9, 2020, Jarred Willardson.
U.S. Appl. No. 17/096,350, filed Nov. 12, 2020, William T. Dalebout.
U.S. Appl. No. 62/897,113, filed Sep. 9, 2019, Megan Jane Ostler.
U.S. Appl. No. 62/991,378, filed Mar. 18, 2020, Chris Nascimento.
U.S. Appl. No. 62/994,204, filed Mar. 24, 2020, Chase Brammer.
U.S. Appl. No. 63/073,081, filed Sep. 1, 2020, Darren C. Ashby.
U.S. Appl. No. 63/079,697, filed Sep. 17, 2020, Jarred Willardson.
U.S. Appl. No. 63/086,793, filed Oct. 2, 2020, Darren C. Ashby.

* cited by examiner

ELLIPTICAL EXERCISE MACHINE

CROSS-REFERENCE TO RELATED APPLICATIONS

This application claims the benefit of and priority to provisional patent application No. 62/644,133 entitled "ELLIPTICAL EXERCISE MACHINE" filed Mar. 16, 2018, which application is herein incorporated by reference in its entirety for all that it discloses.

BACKGROUND

Elliptical exercise machines are generally configured to allow users to simulate striding motions along an elliptical path as a way to exercise a variety of muscles through a wide range of motion. Since their introduction, elliptical exercise machines have become very popular with users due to the generally low-impact exercise they enable as compared to other striding exercises such as walking, jogging, or running.

Unfortunately, however, conventional elliptical exercise machines generally have fixed elliptical paths which can be uncomfortable for users. Also, conventional elliptical exercise machines generally have relatively long front-to-back footprints that take up relatively large amounts of floor space, which can make them difficult to fit onto the floor space in a gym or a home.

The subject matter claimed herein is not limited to embodiments that solve any disadvantages or that operate only in environments such as those described above. Rather, this background is only provided to illustrate one example technology area where some embodiments described herein may be practiced.

SUMMARY

In one aspect of the disclosure, an elliptical exercise machine may include a base, one or more upright stanchions coupled to the base and extending upward from the base and supporting first and second cranks. The first crank may support a first crank arm that is offset from the center of the first crank. The first crank arm may support a first pedal leg hanging downward from the first crank arm. The first pedal leg may support a right pedal. The right pedal may be configured to swing forward and rearward by a user's right foot striding forward and rearward with a length of each swing determined by a length of a stride of the user's right foot. The right pedal may be configured to raise upward and lower downward as the first crank arm moves upward and downward during rotation of the first crank. The second crank may support a second crank arm that is offset from the center of the second crank. The second crank arm may support a second pedal leg hanging downward from the second crank arm. The second pedal leg may support a left pedal. The left pedal may be configured to swing forward and rearward by the user's left foot striding forward and rearward with a length of each swing determined by a length of a stride of the user's left foot. The left pedal may be configured to raise upward and lower downward as the second crank arm moves upward and downward during rotation of the second crank.

Another aspect of the disclosure may include any combination of the above-mentioned features and may further include the elliptical exercise machine further including a flywheel coupled to the first crank and/or the second crank, with the flywheel configured to provide resistance to rotation of the first crank and/or the second crank.

Another aspect of the disclosure may include any combination of the above-mentioned features and may further include the elliptical exercise machine further including a magnetic brake configured to provide variable resistance to the rotation of the flywheel.

Another aspect of the disclosure may include any combination of the above-mentioned features and may further include the elliptical exercise machine further including a crank pulley configured to rotate in phase with the first crank or with the second crank, a double-reduction pulley, a flywheel belt coupling the flywheel to the double-reduction pulley, and an intermediate belt coupling the double-reduction pulley to the crank pulley.

Another aspect of the disclosure may include any combination of the above-mentioned features and may further include the elliptical exercise machine further including a timing shaft and belts and pulleys coupling the first crank to the second crank to cause the first crank arm to rotate about 180 degrees out of phase from the second crank arm.

Another aspect of the disclosure may include any combination of the above-mentioned features and may further include the timing shaft being coupled to the one or more upright stanchions.

Another aspect of the disclosure may include any combination of the above-mentioned features and may further include the belts and pulleys including a first crank pulley configured to rotate in phase with the first crank, a first timing shaft pulley configured to rotate in phase with the timing shaft, a first belt coupling the first crank pulley to the first timing shaft pulley, a second crank pulley configured to rotate in phase with the second crank, a second timing shaft pulley configured to rotate in phase with the timing shaft, and a second belt coupling the second crank pulley to the second timing shaft pulley.

Another aspect of the disclosure may include any combination of the above-mentioned features and may further include the elliptical exercise machine further including a timing cable and pulleys coupling the first crank to the second crank to cause the first crank arm to rotate about 180 degrees out of phase from the second crank arm.

Another aspect of the disclosure may include any combination of the above-mentioned features and may further include the pulleys including a first crank pulley configured to rotate in phase with the first crank, upper and lower first timing pulleys, a second crank pulley configured to rotate in phase with the second crank, and upper and lower second timing pulleys.

Another aspect of the disclosure may include any combination of the above-mentioned features and may further include the timing cable being configured in a loop and being configured to couple the first crank pulley to the upper and lower first timing pulleys, and to couple the upper and lower first timing pulleys to the upper and lower second timing pulleys, and to couple the upper and lower second timing pulleys to the second crank pulley. Another aspect of the disclosure may include any combination of the above-mentioned features and may further include the elliptical exercise machine further including a first swing handle and a second swing handle. The first swing handle may be coupled to a first swing arm. The first swing arm may be coupled to the first pedal leg. The second swing handle may be coupled to a second swing arm. The second swing arm may be coupled to the second pedal leg.

Another aspect of the disclosure may include any combination of the above-mentioned features and may further include the first pedal leg being supported by the first crank arm via a coupling to a first roller arm, with the first roller arm configured to roll atop a first roller that is coupled to the first crank arm, and the second pedal leg being supported by the second crank arm via a coupling to a second roller arm, with the second roller arm configured to roll atop a second roller that is coupled to the second crank arm.

Another aspect of the disclosure may include any combination of the above-mentioned features and may further include the elliptical exercise machine further including a second first pedal leg supported by the first swing arm and hanging downward from the first swing arm, with the second first pedal leg further supporting the right pedal, and a second pedal leg supported by the second swing arm and hanging downward from the second swing arm, with the second pedal leg further supporting the left pedal.

Another aspect of the disclosure may include any combination of the above-mentioned features and may further include a surface of the first roller arm that is configured to roll atop the first roller being curved and a surface of the second roller arm that is configured to roll atop the second roller being curved, with each curved surface being a concave surface or a convex surface.

Another aspect of the disclosure may include any combination of the above-mentioned features and may further include at least a portion of the right pedal being configured to swing rearward further than a rearmost portion of the base, and at least a portion of the left pedal being configured to swing rearward further than a rearmost portion of the base.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

Throughout the drawings, identical reference numbers designate similar, but not necessarily identical, elements.

DETAILED DESCRIPTION

While conventional elliptical exercise machines have become very popular with users, conventional elliptical exercise machines generally have shortcomings of an uncomfortable fixed elliptical path and a relatively long front-to-back footprint that takes up a relatively large amount of floor space in a gym or in a home.

Some embodiments disclosed herein are elliptical exercise machines that overcome the shortcomings of conventional exercise machines. For example, the example elliptical exercise machines disclosed herein may allow for an elliptical path that has a dynamically variable stride length which allows the user to stride with a stride length that is comfortable to the user. Also, the example elliptical exercise machines disclosed herein have a shorter front-to-back footprint than conventional elliptical exercise machines, which may enable the example elliptical exercise machines disclosed herein to take up relatively small amounts of floor space, which can make them easier to fit onto the floor space in a gym or in a home. In this manner, the example elliptical exercise machines disclosed herein overcome the shortcomings of conventional elliptical exercise machines, thus enabling a more comfortable elliptical exercise for users while using less floor space in a gym or in a home.

Figure 1A:
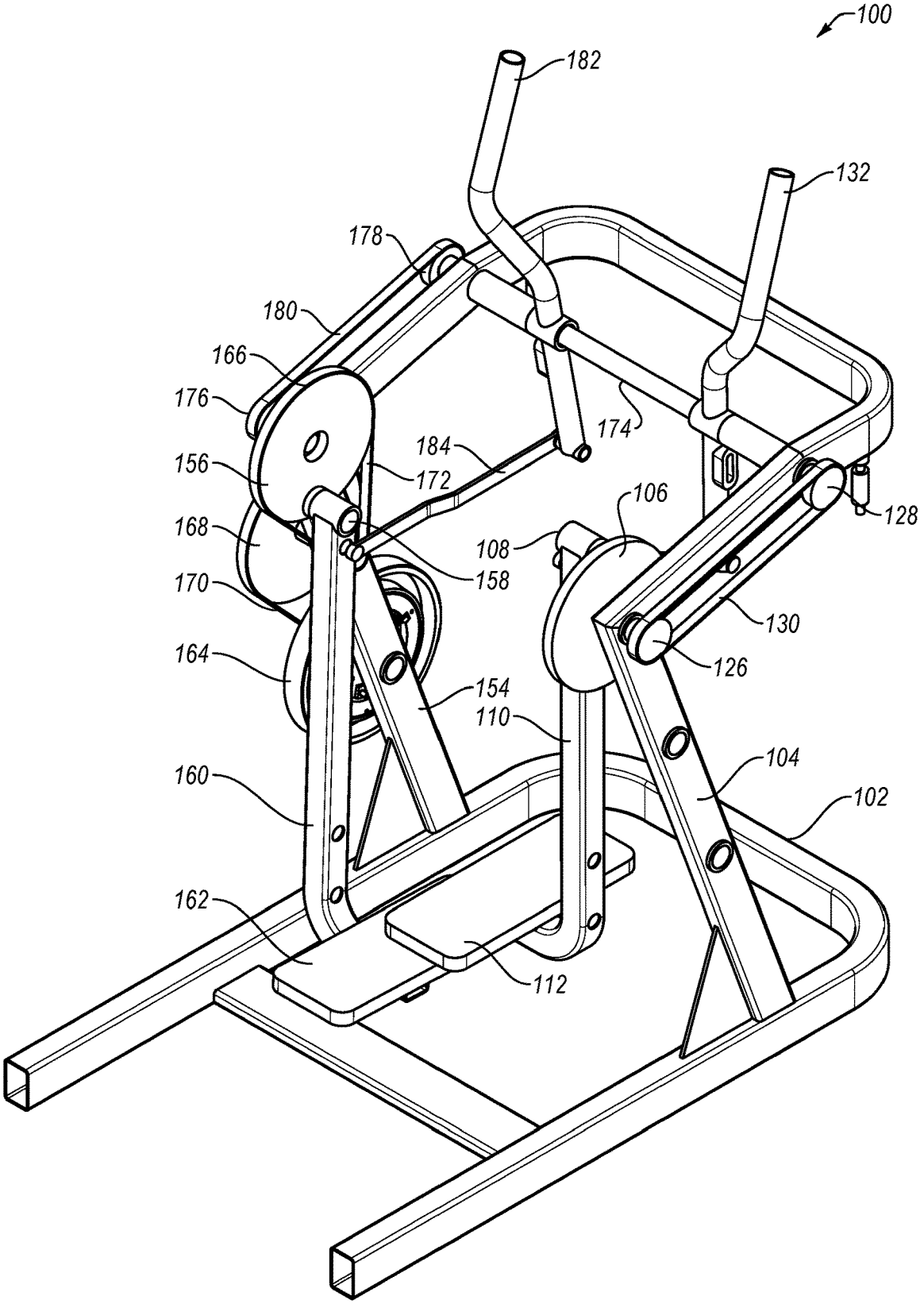
FIGS. 1A-1G are rear-right, rear, right, front, left, top, and bottom perspective views, respectively, of a first example elliptical exercise machine.
Figure 1B:
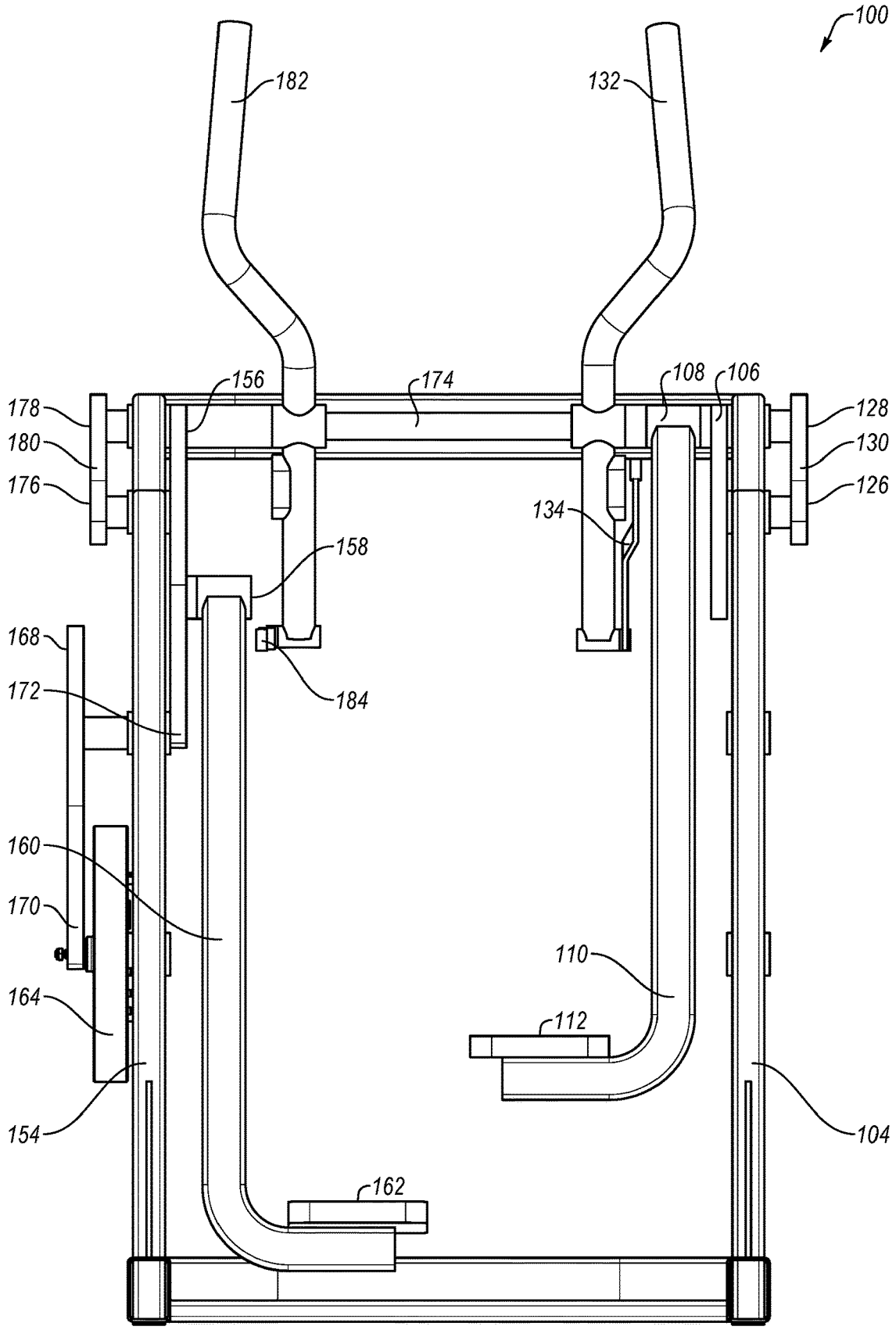
Figure 1C:
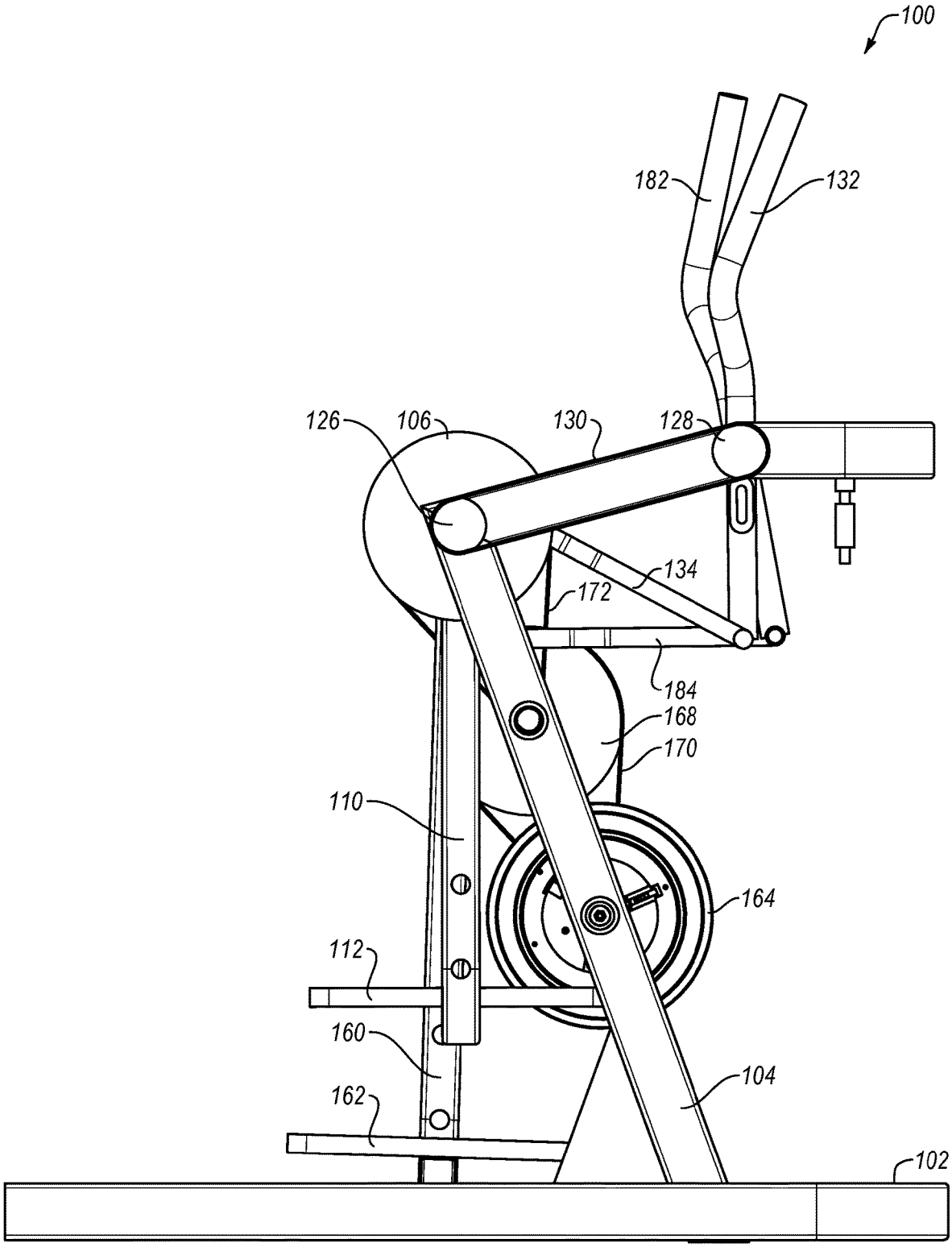
Figure 1D:
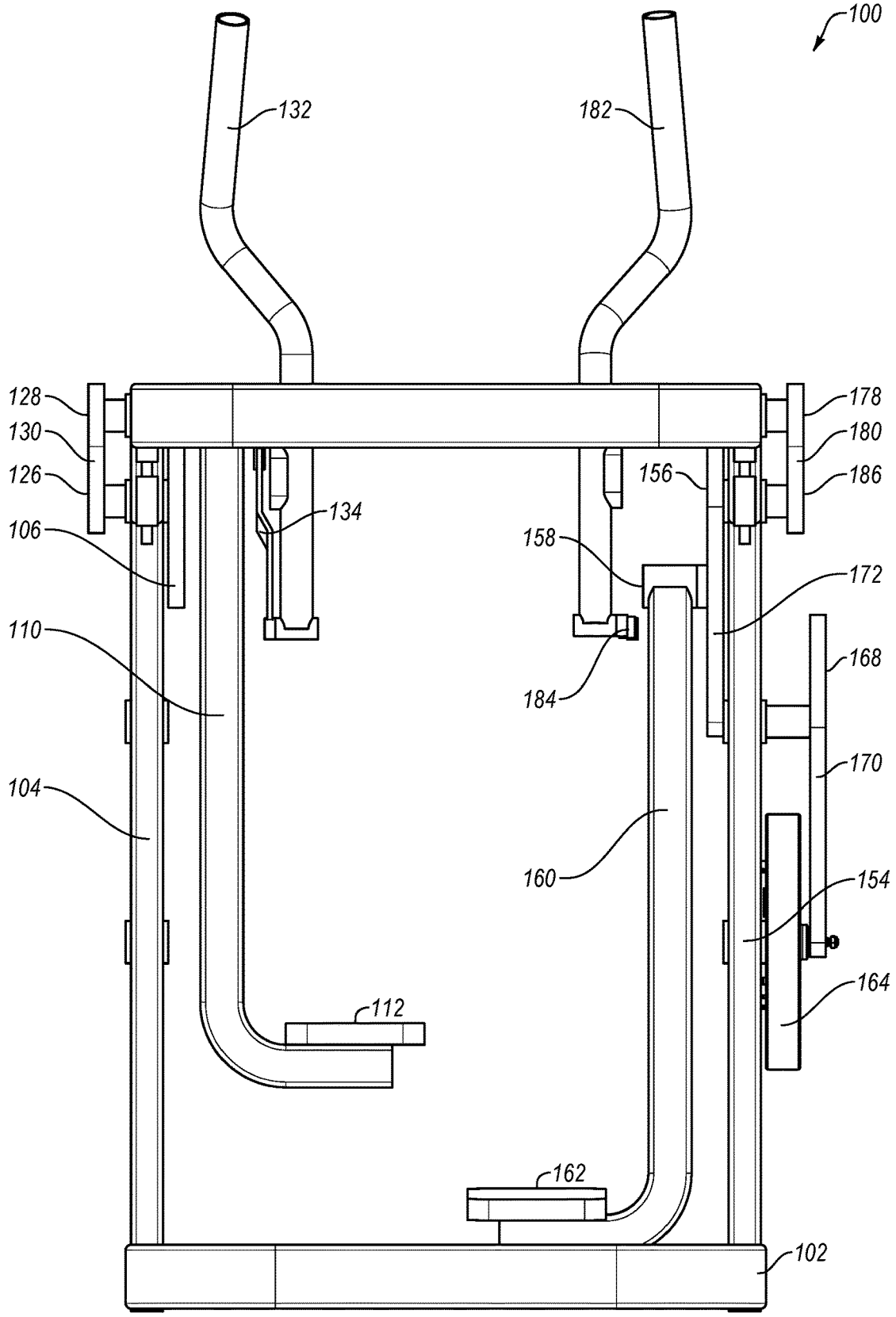
Figure 1E:
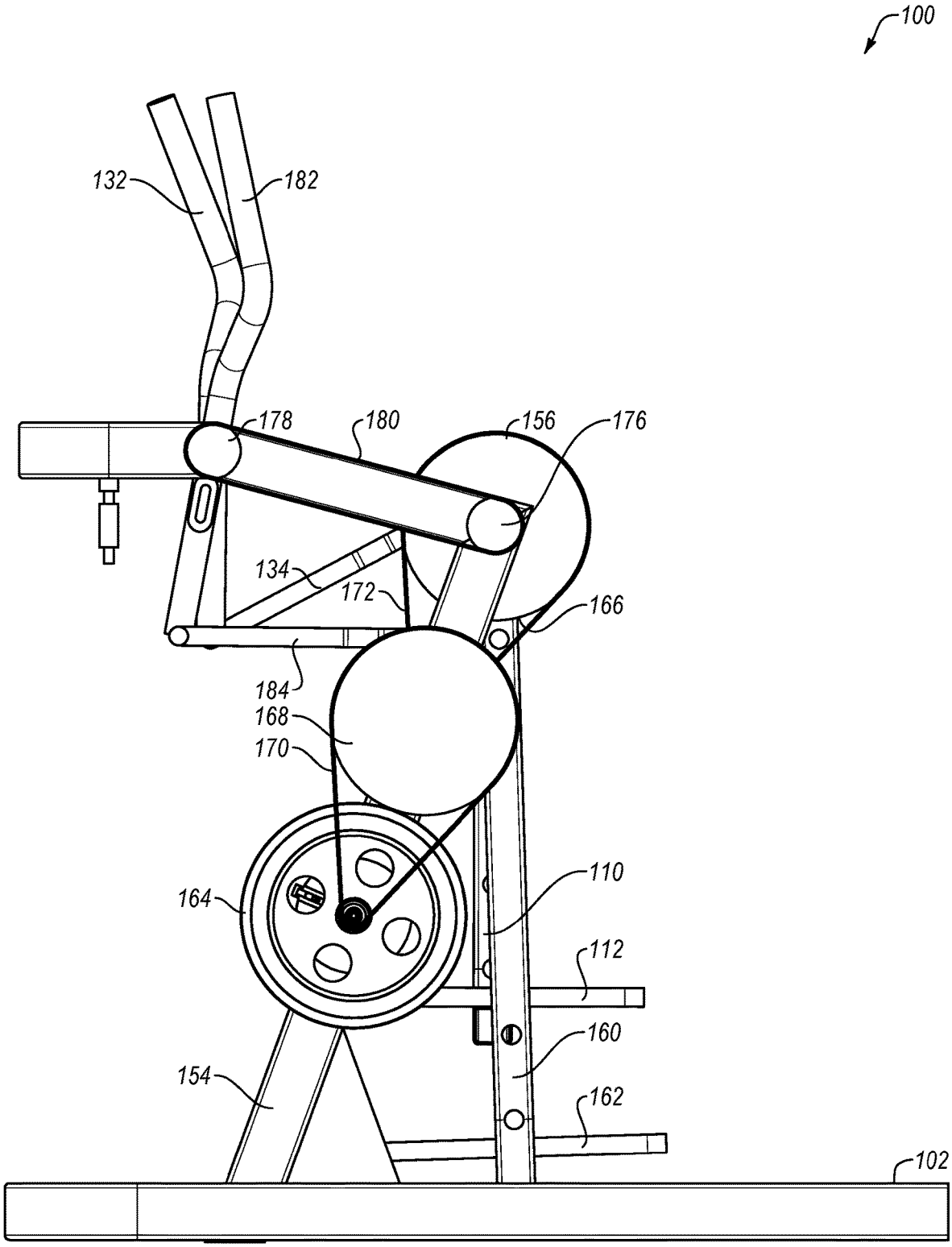
Figure 1F:
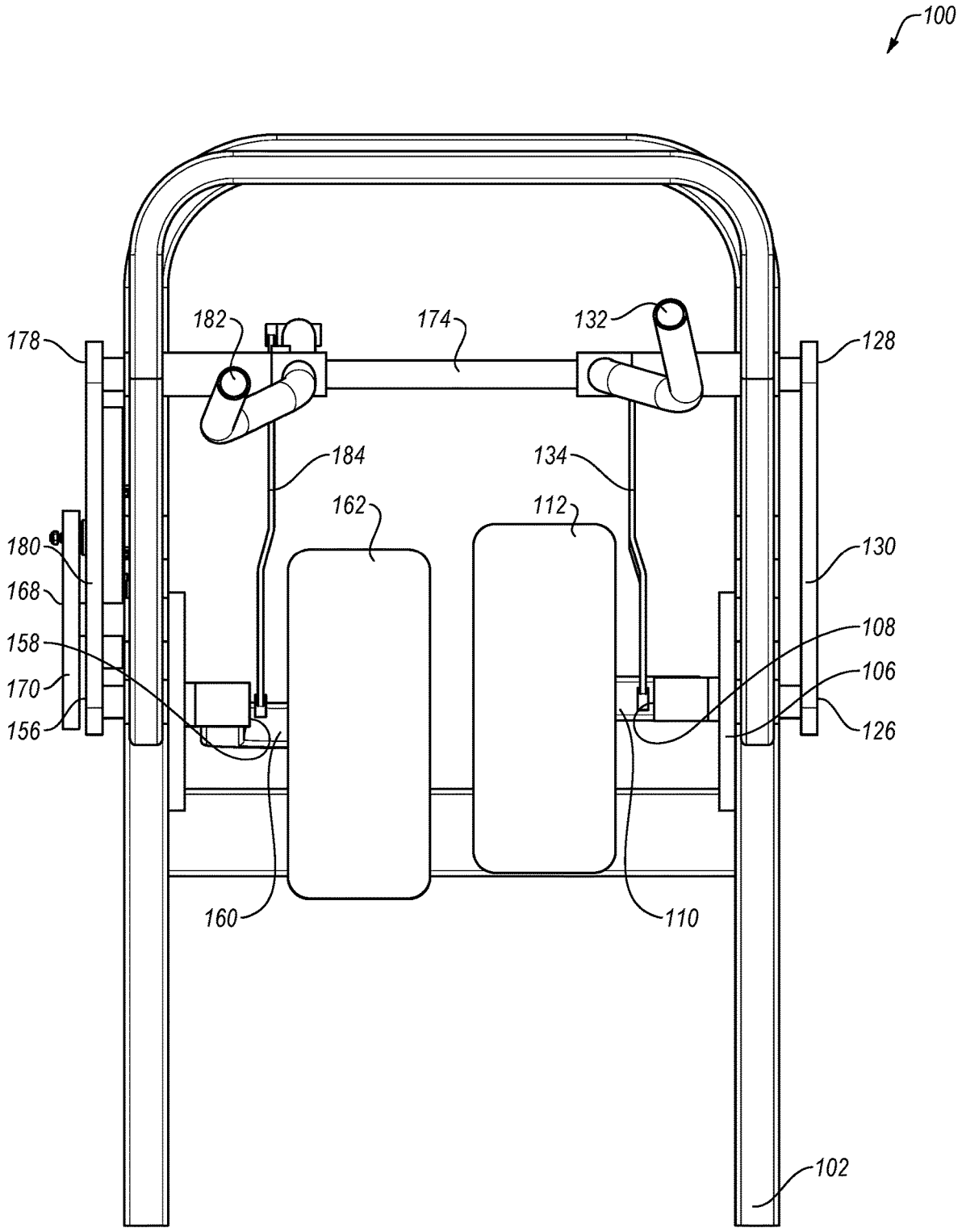
Figure 1G:
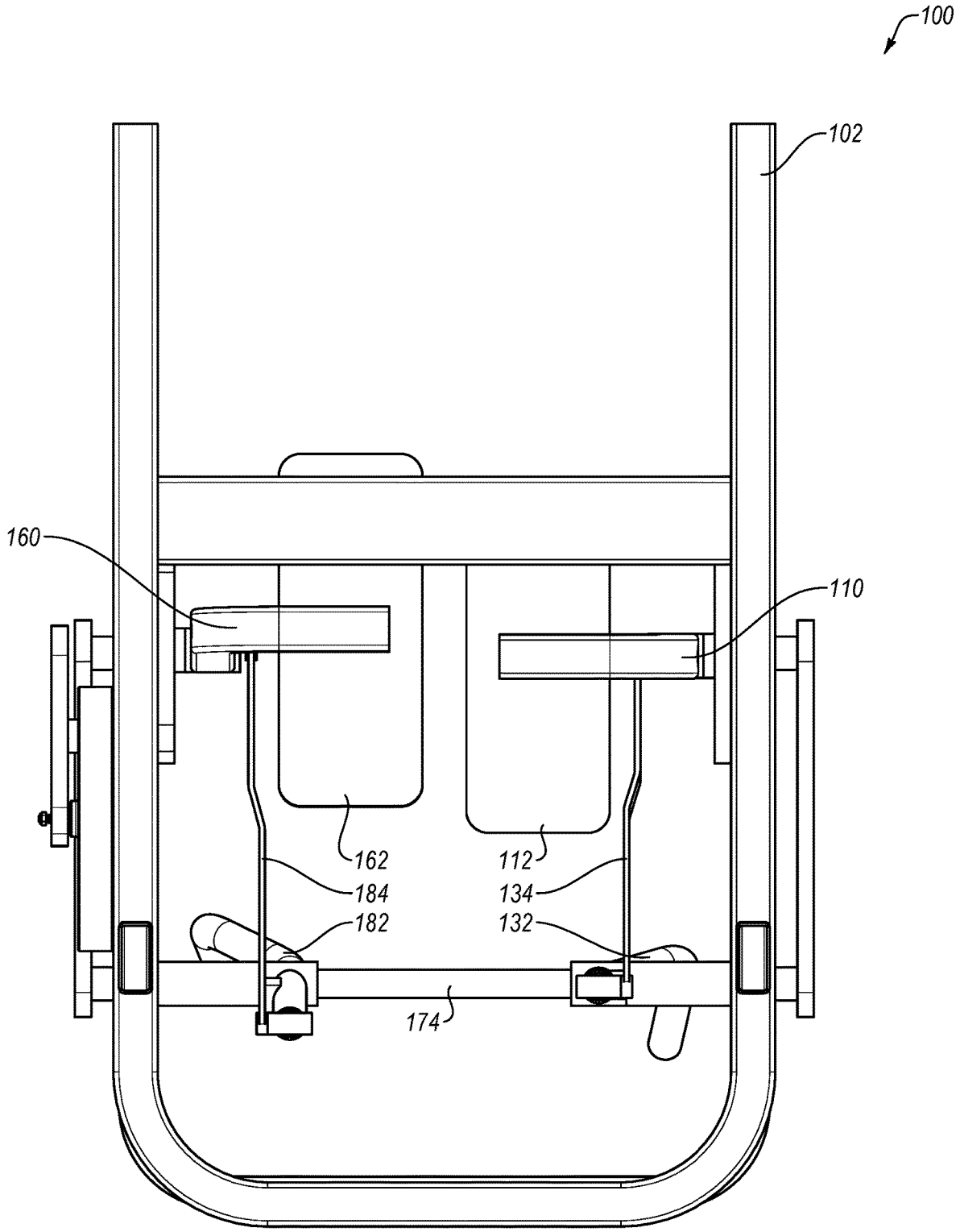

Turning now to the drawings, FIGS. 1A-1G are rear-right, rear, right, front, left, top, and bottom perspective views, respectively, of a first example elliptical exercise machine 100.

The machine 100 may include a base 102, a right upright stanchion 104 coupled to the base 102 and extending upward from the base 102, and a left upright stanchion 154 coupled to the base 102 and extending upward from the base 102.

The right upright stanchion 104 may support a right crank 106. The right crank 106 may support a right crank arm 108 that is offset from the center of the right crank 106. The right crank arm 108 may support a right pedal leg 110 hanging downward from the right crank arm 108. The right pedal leg 110 may support a right pedal 112. Similarly, the left upright stanchion 154 may support a left crank 156. The left crank 156 may support a left crank arm 158 that is offset from the center of the left crank 156. The left crank arm 158 may support a left pedal leg 160 hanging downward from the left crank arm 158. The left pedal leg 160 may support a left pedal 162.

The machine 100 may further include a flywheel 164 coupled to the left crank 156. The flywheel 164 may be configured to provide resistance to rotation of the left crank 156. The machine 100 may further include a crank pulley 166 (note, in the machine 100, an outer surface of the left crank 156 functions as the crank pulley 166) configured to rotate in phase with the left crank 156, a double-reduction pulley 168, a flywheel belt 170 coupling the flywheel 164 to the double-reduction pulley 168, and an intermediate belt 172 coupling the double-reduction pulley 168 to the crank pulley 166.

The machine 100 may further include a timing shaft 174 and belts and pulleys coupling the right crank to the left crank to cause the right crank arm 108 to rotate about 180 degrees out of phase from the left crank arm 158. These belts and pulleys may include a right crank pulley 126 configured to rotate in phase with the right crank 106, a right timing shaft pulley 128 configured to rotate in phase with the timing shaft 174, a right belt 130 coupling the right crank pulley 126 to the right timing shaft pulley 128, a left crank pulley 176 configured to rotate in phase with the left crank 156, a left timing shaft pulley 178 configured to rotate in phase with the timing shaft 174, and a left belt 180 coupling the left crank pulley 176 to the left timing shaft pulley 178. The timing shaft 174 may be coupled to the right upright stanchion 104 and the left upright stanchion 154, such as being coupled to generally horizontal and forward portions of the right upright stanchion 104 and the left upright stanchion 154.

The machine 100 may further include a right swing handle 132 and a left swing handle 182 configured to be gripped by a user's right and left hands, respectively, during an exercise session. The right swing handle 132 may be coupled to a right swing arm 134. Although not shown in the figures, it is understood that the right swing arm 134 may be coupled to the right pedal leg 110, using a bolt and a nut for example. Although not shown in the figures, it is understood that the left swing handle 182 may be coupled to a left swing arm 184. The left swing arm 184 may be coupled to the left pedal leg 160, using a bolt and a nut for example. The right swing handle 132 and the left swing handle 182 may enable a user to coordinate movement of the user's arms and legs during an exercise session.

Figure 2A:
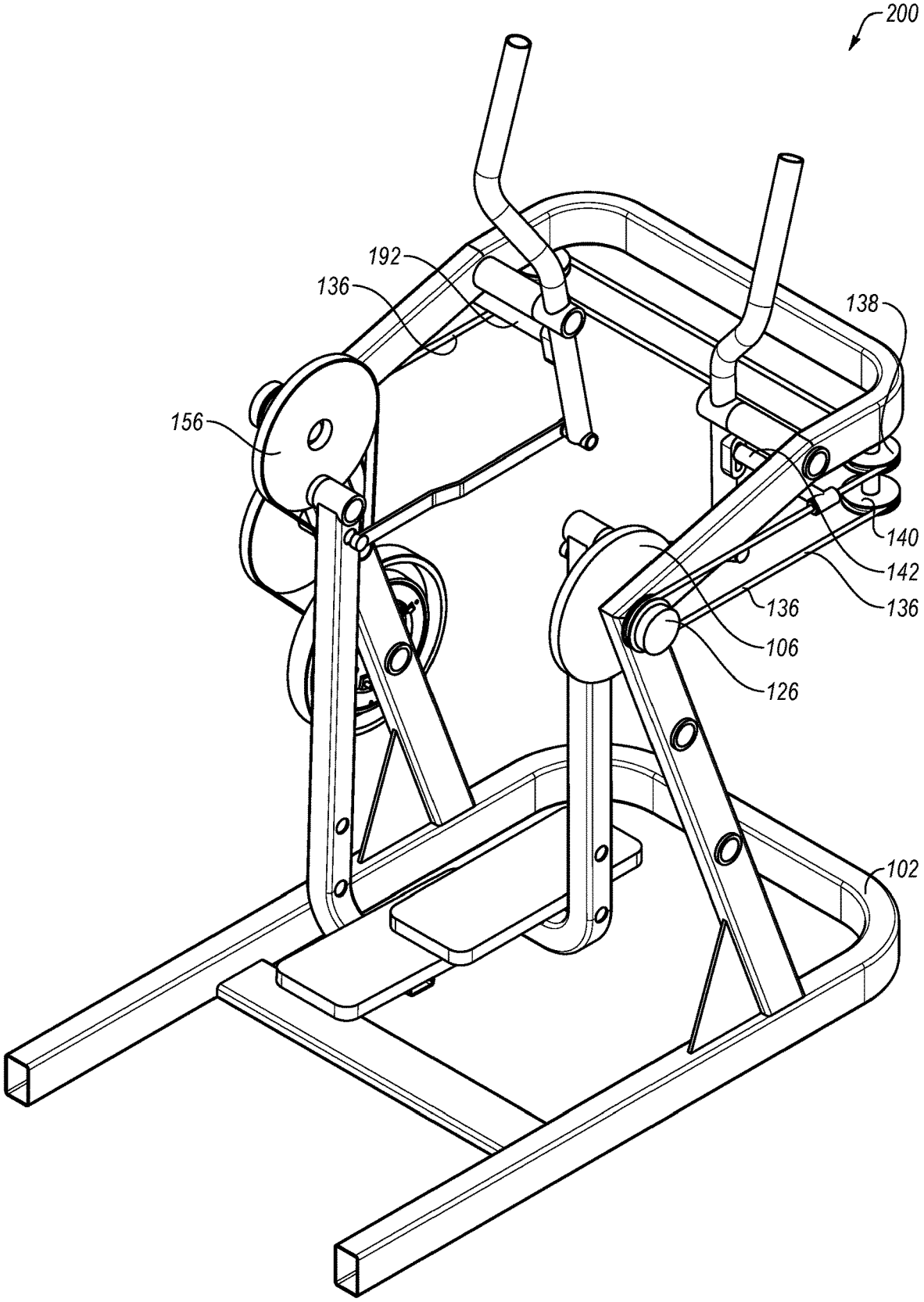
FIGS. 2A-2G are right-rear, rear, right, front, left, top, and bottom perspective views, respectively, of a second example elliptical exercise machine.
Figure 2B:
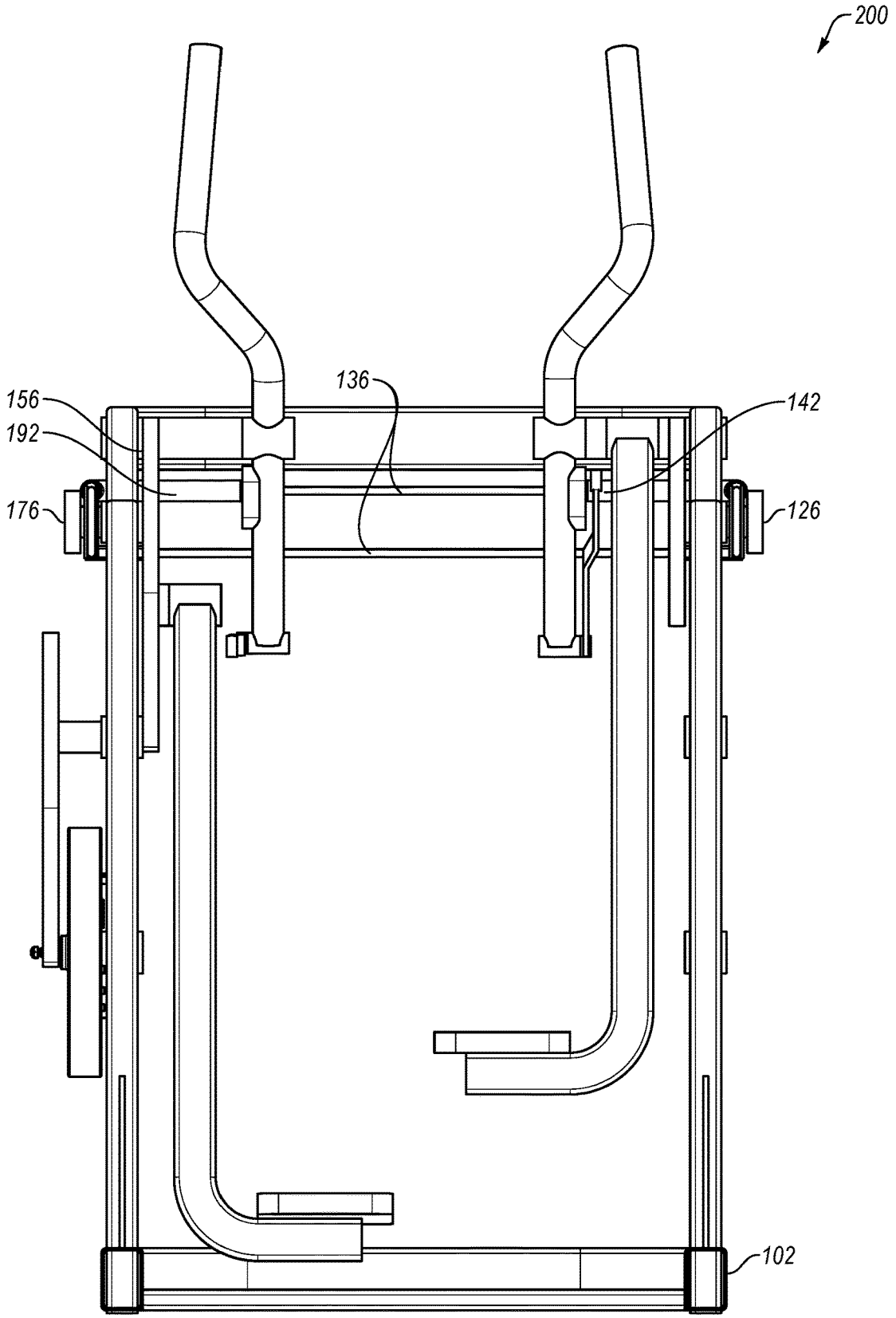
Figure 2C:
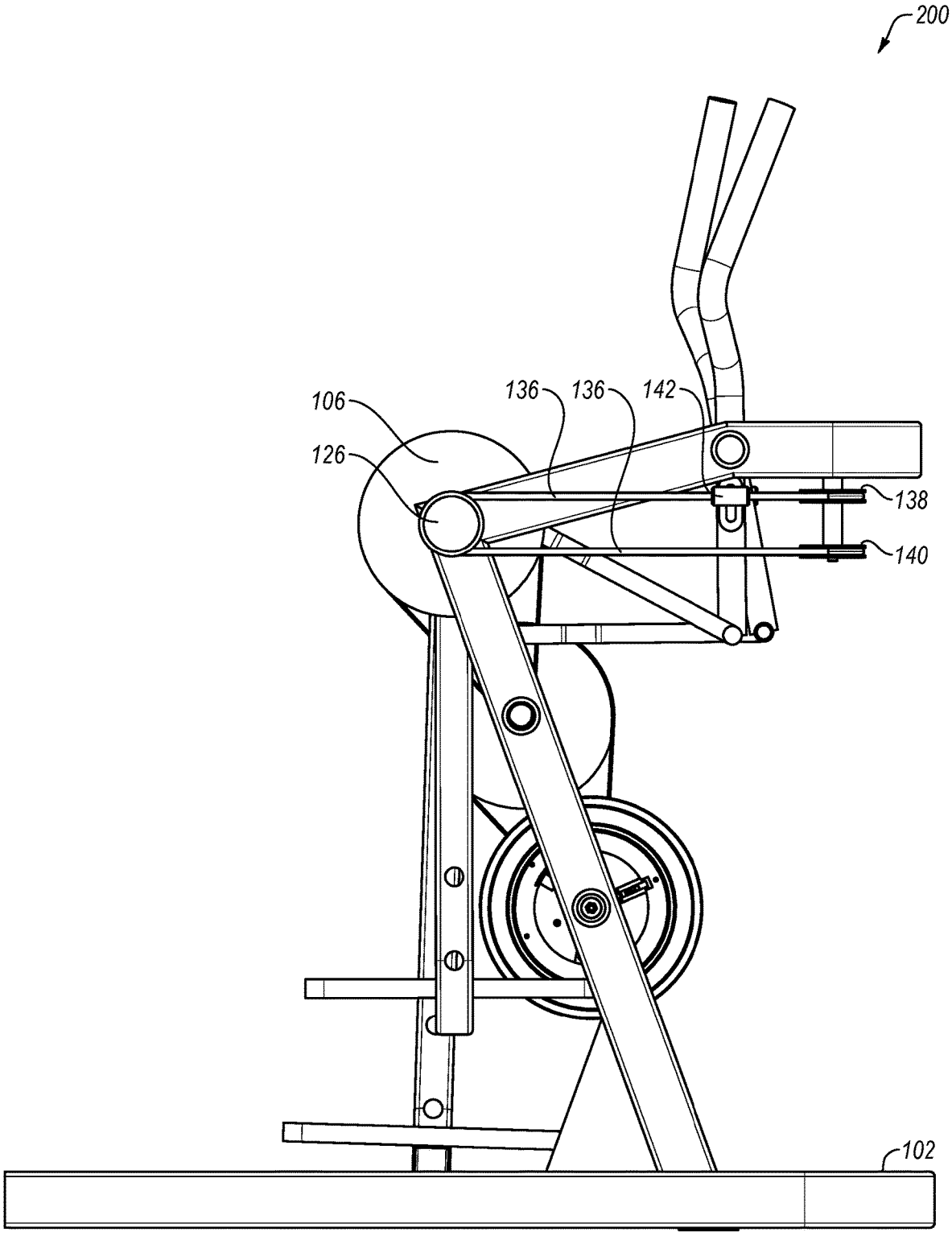
Figure 2D:
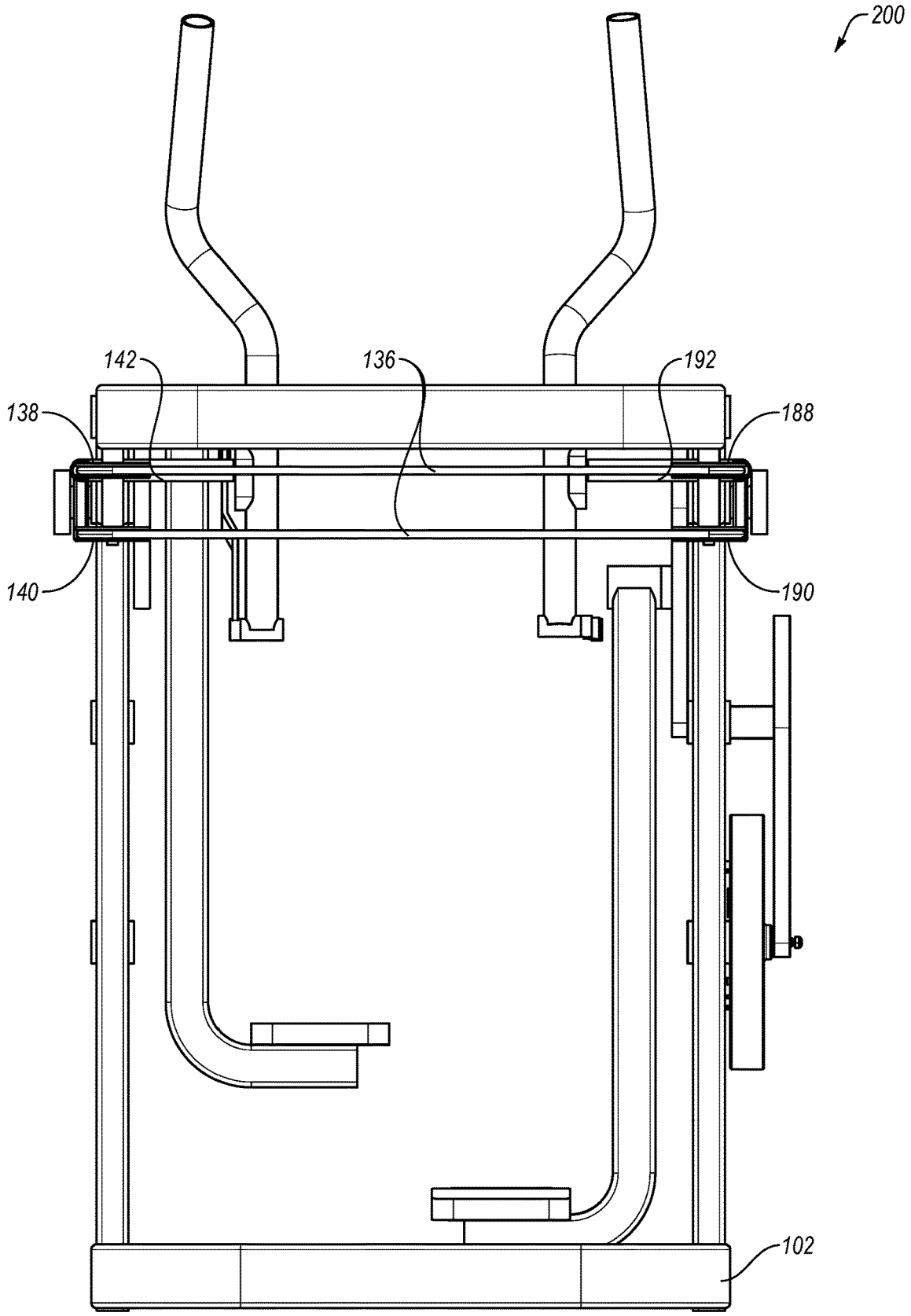
Figure 2E:
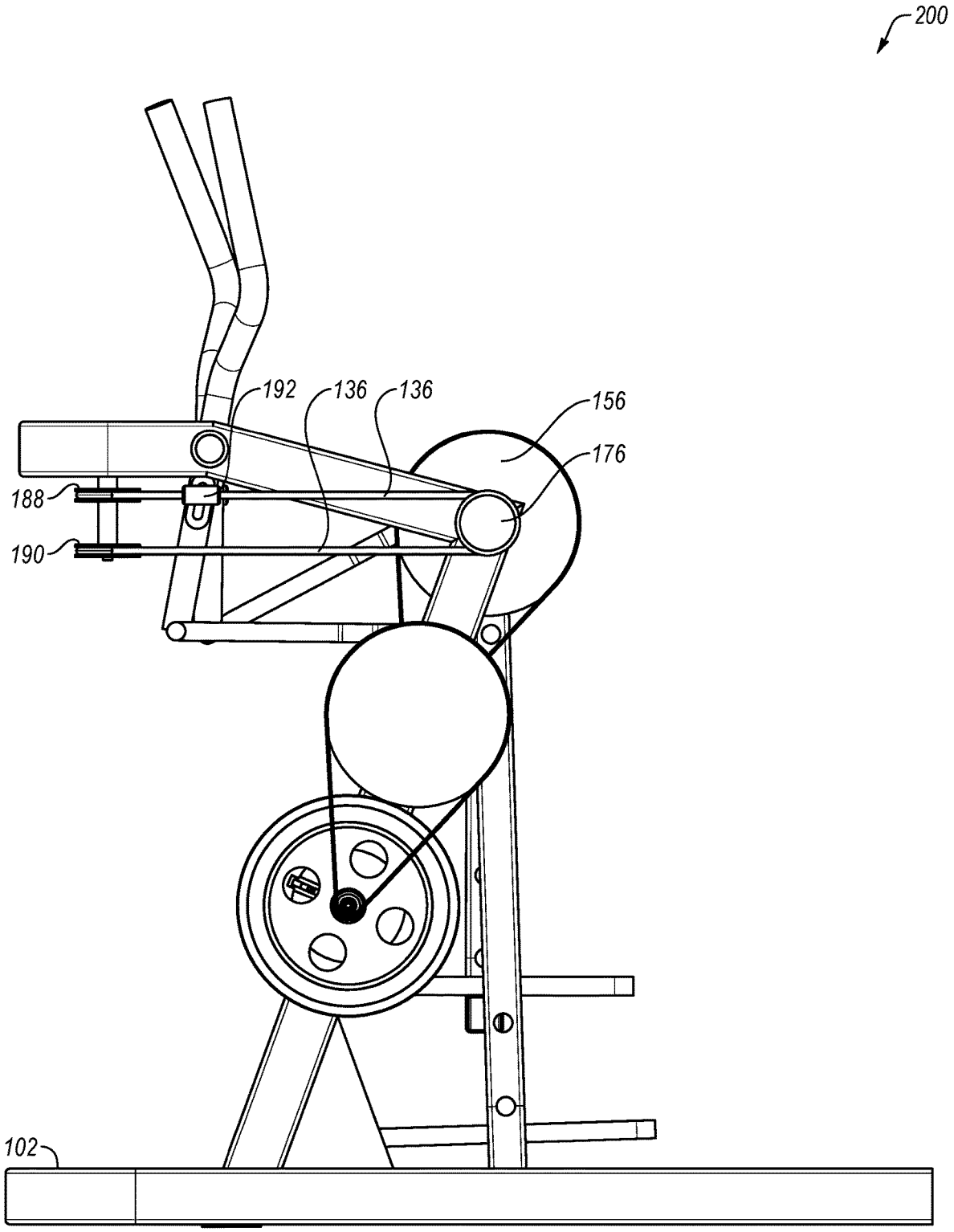
Figure 2F:
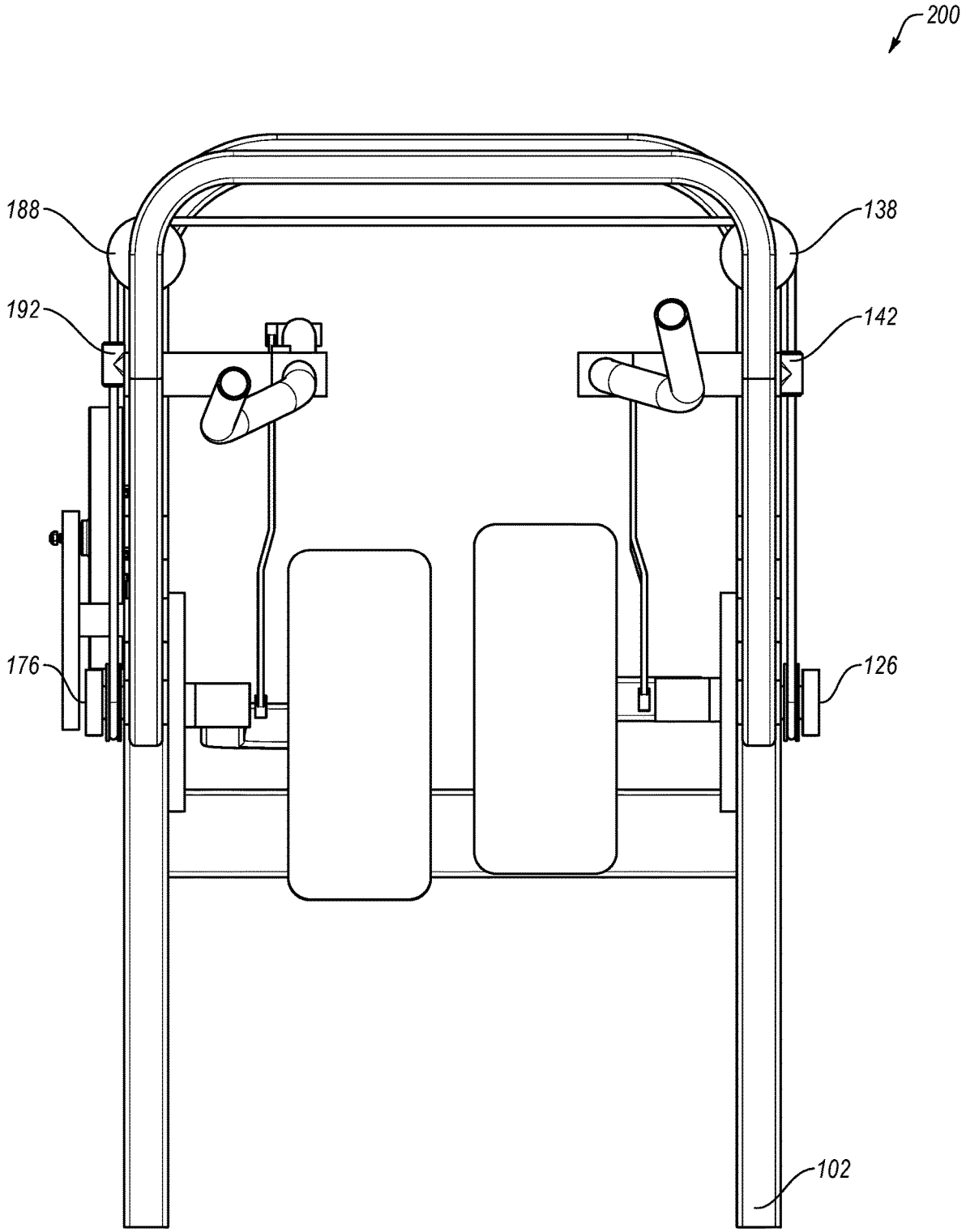
Figure 2G:
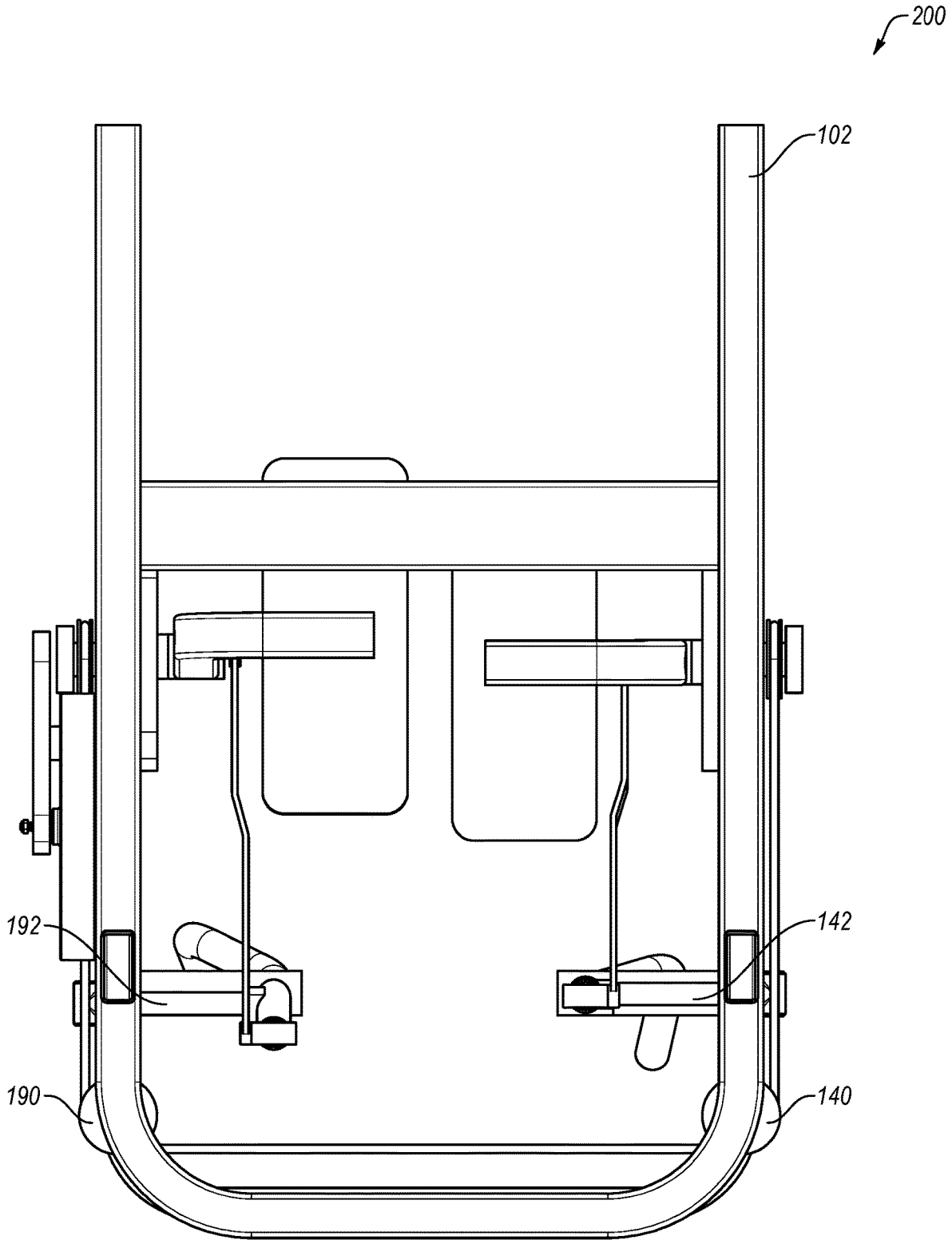

FIGS. 2A-2G are right-rear, rear, right, front, left, top, and bottom perspective views, respectively, of a second example elliptical exercise machine 200. The machine 200 is similar to the machine 100, and therefore the discussion of the machine 200 will generally be limited to aspects of the machine 200 that differ from the machine 100.

In place of the timing shaft 174, the right timing shaft pulley 128, the right belt 130, the left timing shaft pulley 178, and the left belt 180 of the machine 100, the machine 200 may include a timing cable 136 and pulleys coupling the right crank 106 to the left crank 156 to cause the right crank arm 108 to rotate about 180 degrees out of phase from the left crank arm 158. These pulleys may include the right crank pulley 126 that is configured to rotate in phase with the right crank 106, upper and lower right timing pulleys 138 and 140, the left crank pulley 176 configured to rotate in phase with the left crank 156, and upper and lower left timing pulleys 188 and 190. The timing cable 136 may be configured in a loop and may be configured to couple the right crank pulley 126 to the upper and lower right timing pulleys 138 and 140, and to couple the upper and lower right timing pulleys 138 and 140 to the upper and lower left timing pulleys 188 and 190, and to couple the upper and lower left timing pulleys 188 and 190 to the left crank pulley 176. The machine 200 may further include a right cable guide 142 and a left cable guide 192 to maintain the timing cable 136 in the proper position with respect to the pulleys through which the timing cable 136 is routed.

Figure 3A:
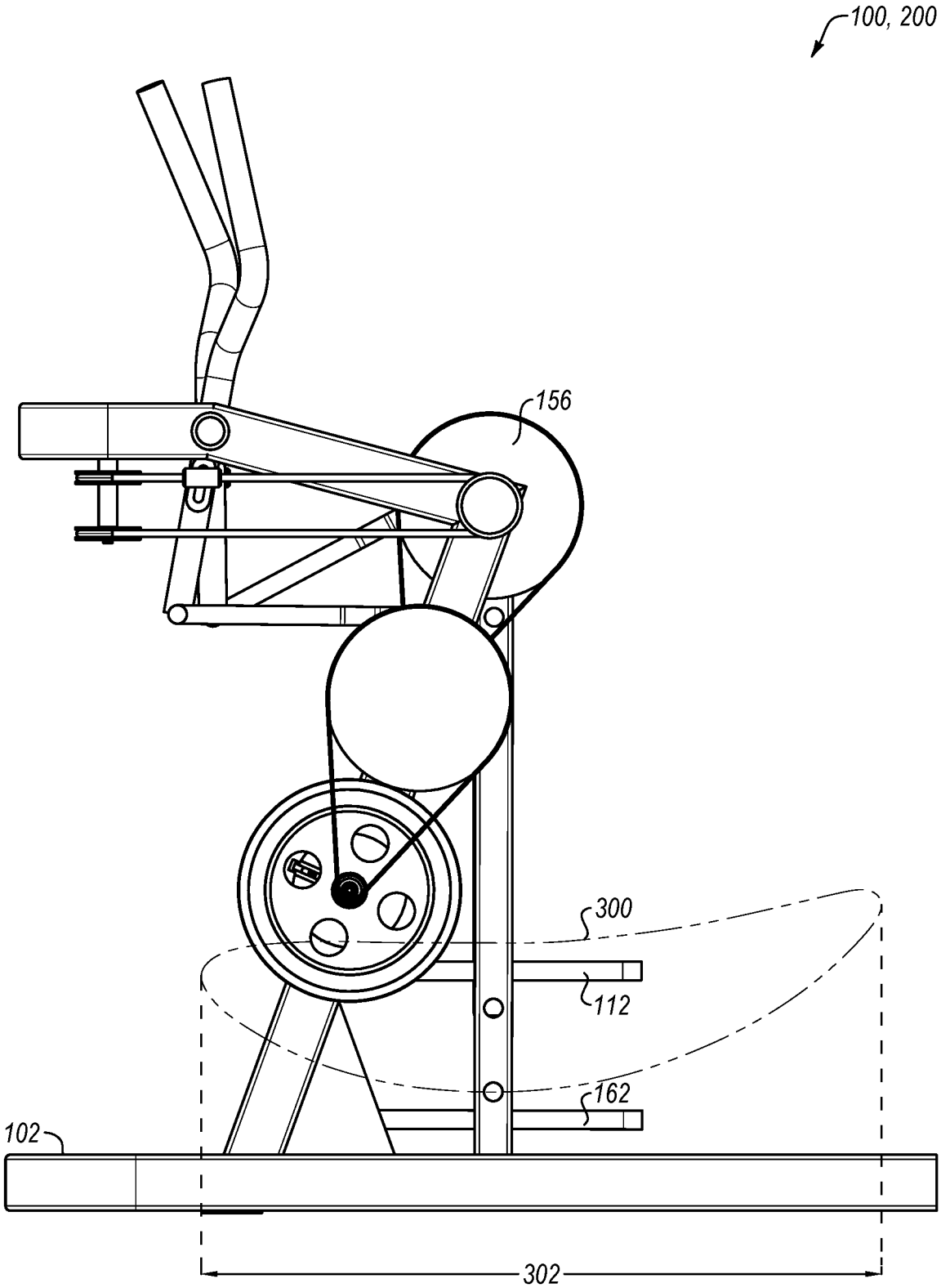
FIGS. 3A-3E are left views of a combination of the first and second example elliptical exercise machines, illustrating an example elliptical path of the first and second example elliptical exercise machines.
Figure 3B:
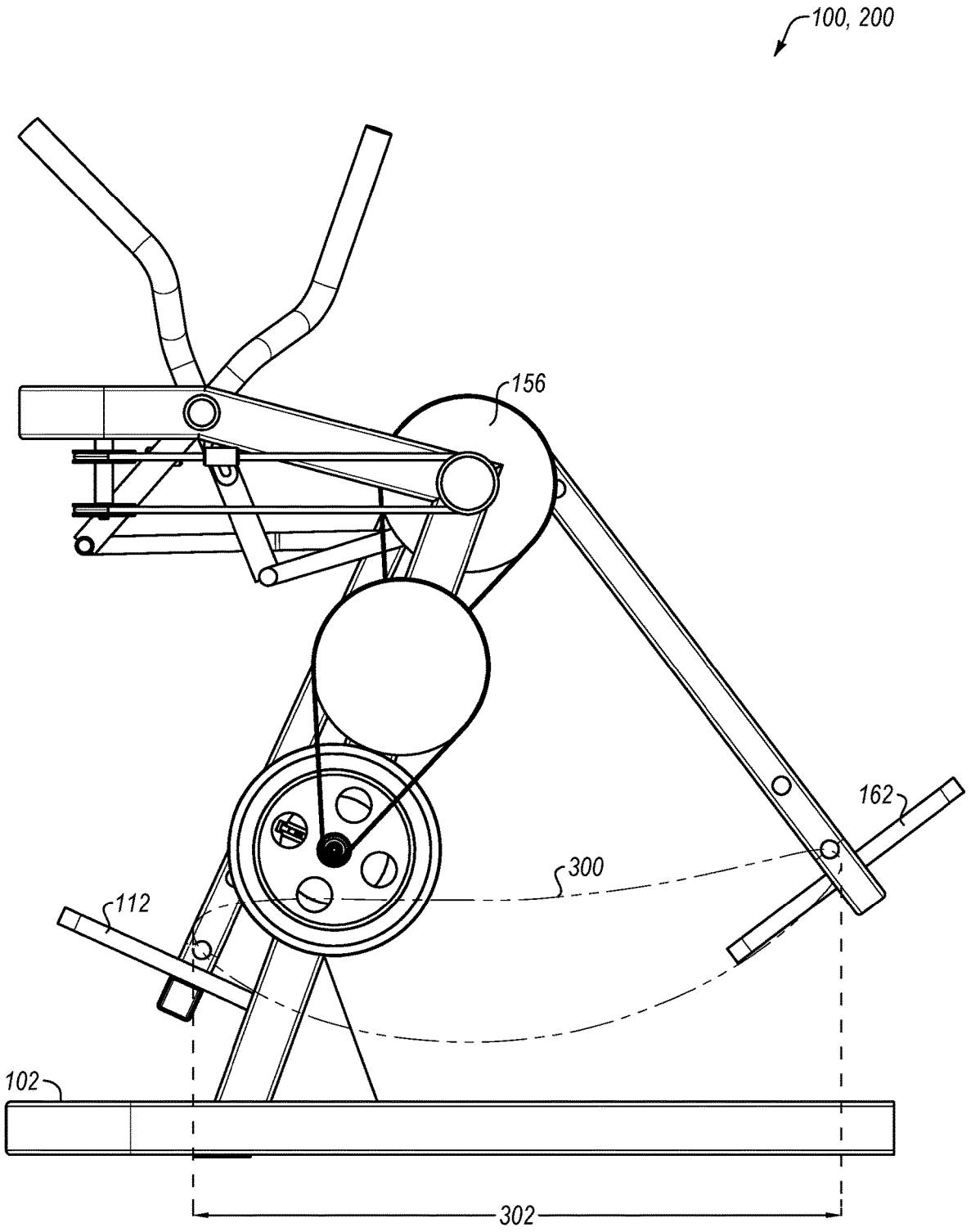
Figure 3C:
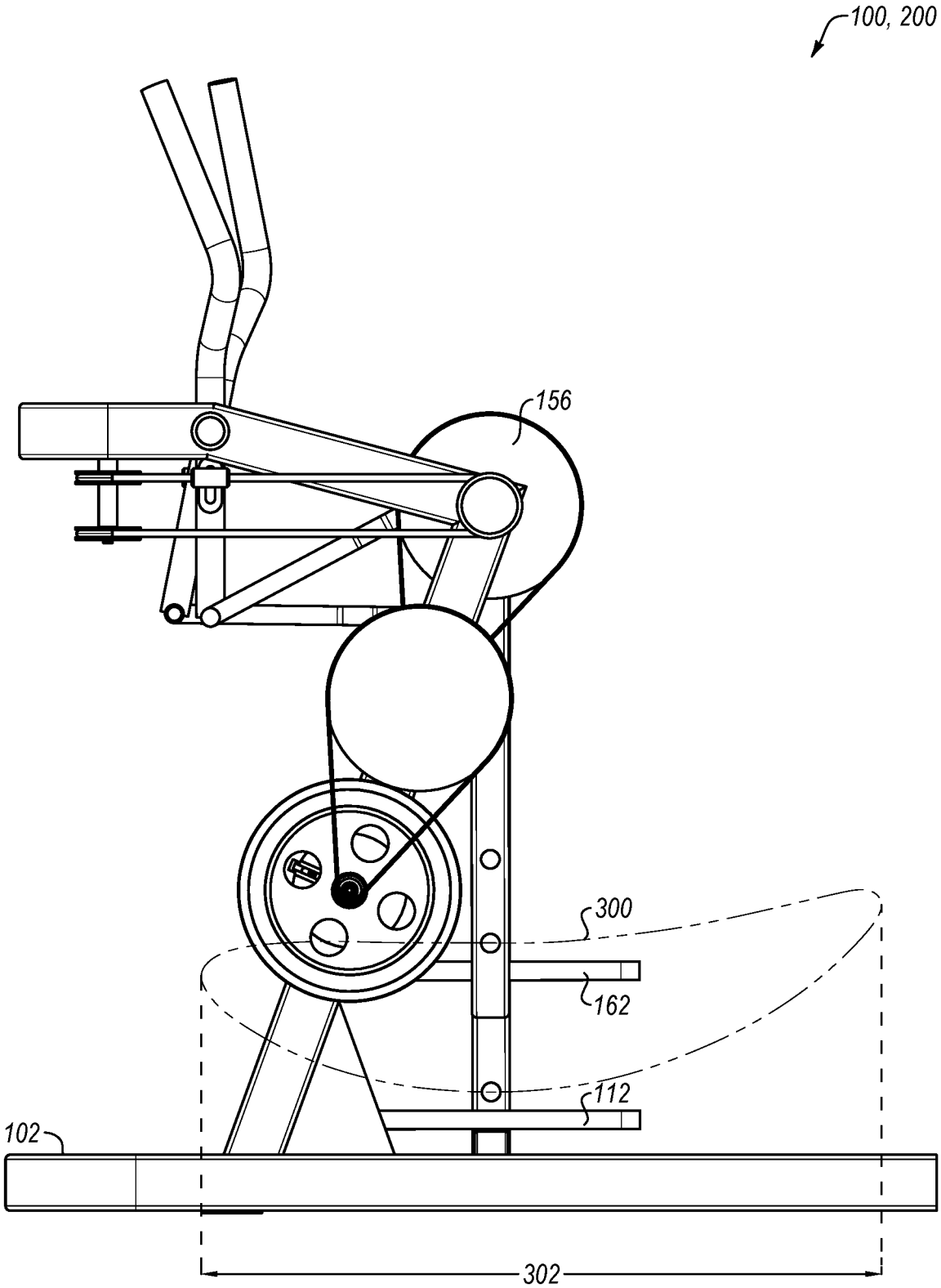
Figure 3D:
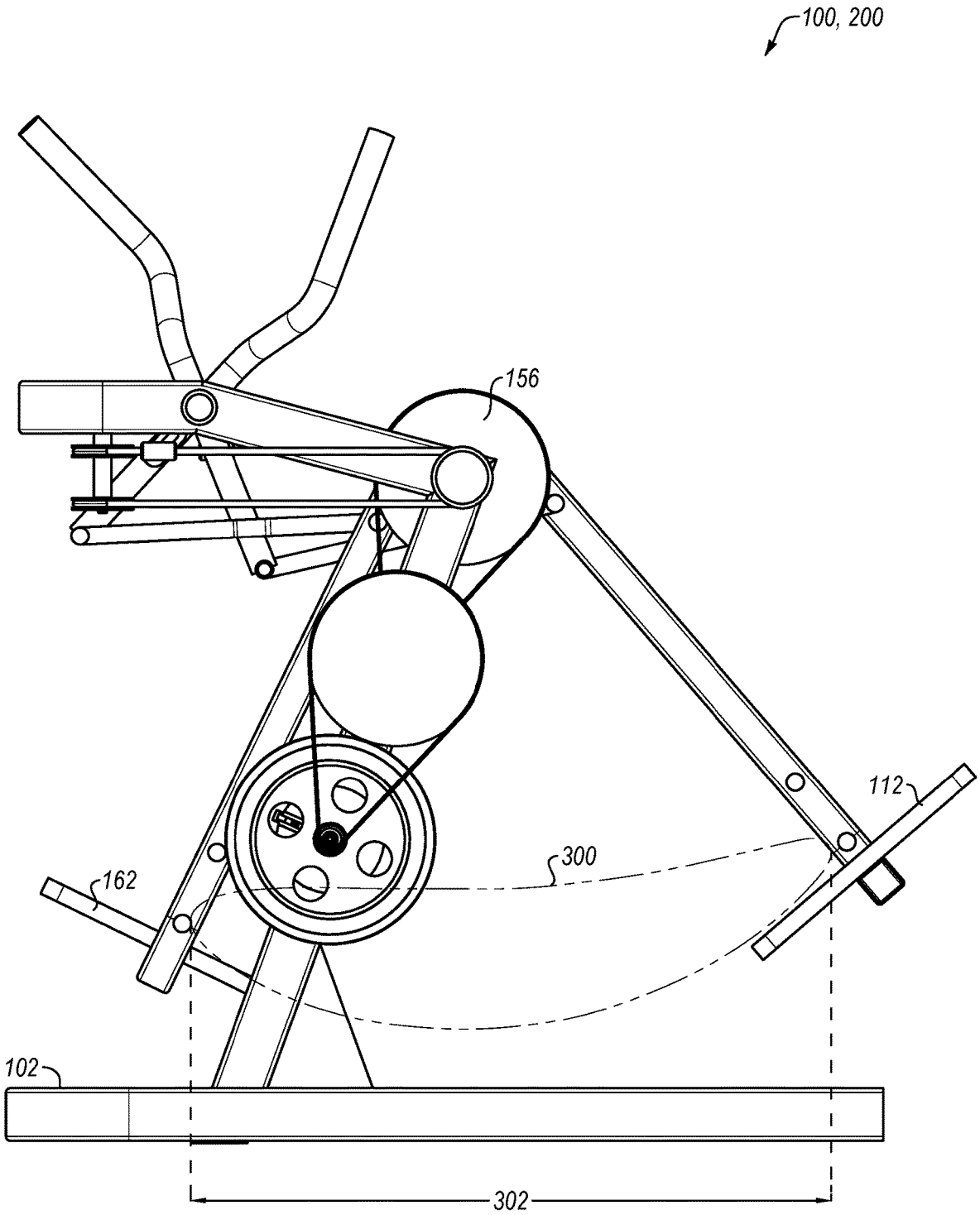
Figure 3E:
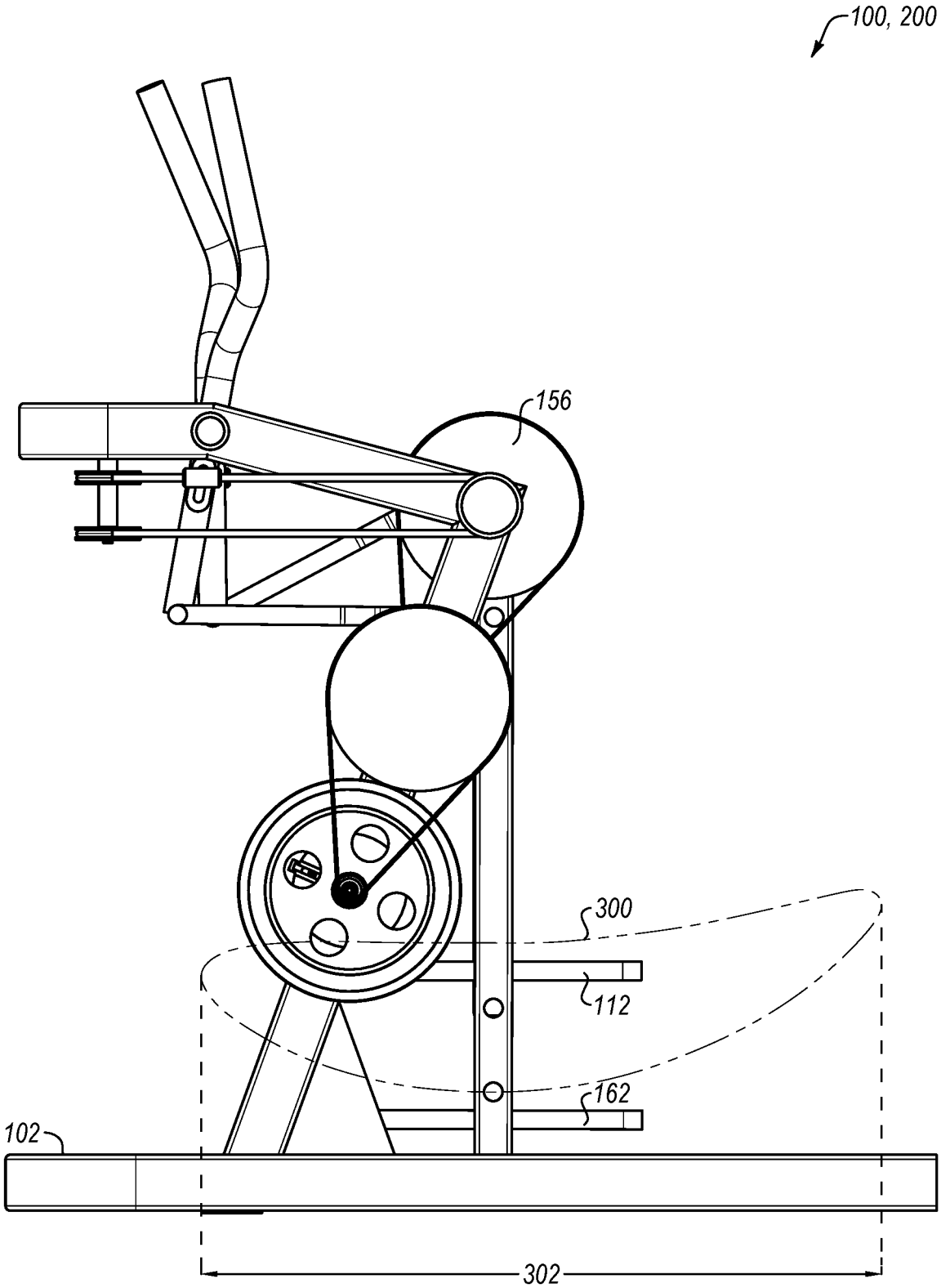

FIGS. 3A-3E are left views of a combination of the first and second example elliptical exercise machines 100 and 200, illustrating an example elliptical path 300 of the first and second example elliptical exercise machines 100 and 200.

During operation of the machines 100 and 200, the right pedal 112 may be configured to swing forward and rearward along the elliptical path 300 by a user's right foot striding forward and rearward with a length 302 of each swing determined by a length of a stride of the user's right foot. The right pedal 112 may be configured to raise upward and lower downward along the elliptical path 300 as the right crank arm 108 (see e.g., FIGS. 1A and 2A) moves upward and downward during rotation of the right crank 106 (see e.g., FIGS. 1A and 2A). Similarly, the left pedal 162 may be configured to swing forward and rearward along the elliptical path 300 by a user's left foot striding forward and rearward with a length 302 of each swing determined by a length of a stride of the user's left foot. The left pedal 162 may be configured to raise upward and lower downward along the elliptical path 300 as the left crank arm 158 (see e.g., FIGS. 1A and 2A) moves upward and downward during rotation of the left crank 156.

The machines 100 and 200 may allow the elliptical path 300 to have a dynamically variable stride length 302 which allows the user to stride with a stride length that is comfortable to the user. Also, machines 100 and 200 may have a shorter front-to-back footprint than conventional elliptical exercise machines. This relatively shorter front-to-back footprint may result in at least a portion of the right pedal 112 being configured to swing rearward further than a rearmost portion of the base 102 (see, e.g., FIG. 3D) and at least a portion of the left pedal 162 being configured to swing rearward further than a rearmost portion of the base 102 (see, e.g., FIG. 3B).

Figure 4A:
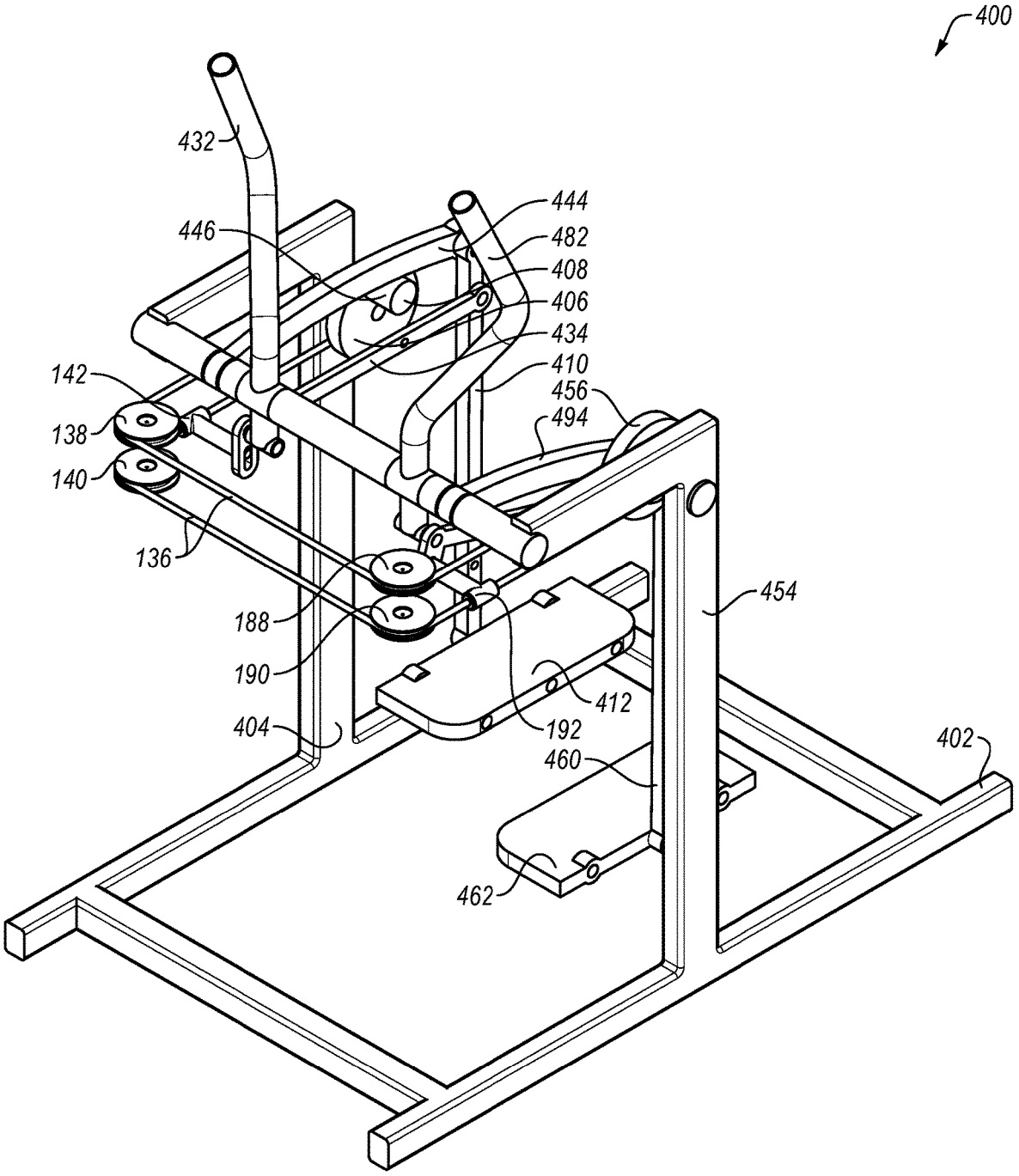
FIGS. 4A-4G are front-left, rear, right, front, left, top, and bottom perspective views, respectively, of a third example elliptical exercise machine.
Figure 4B:
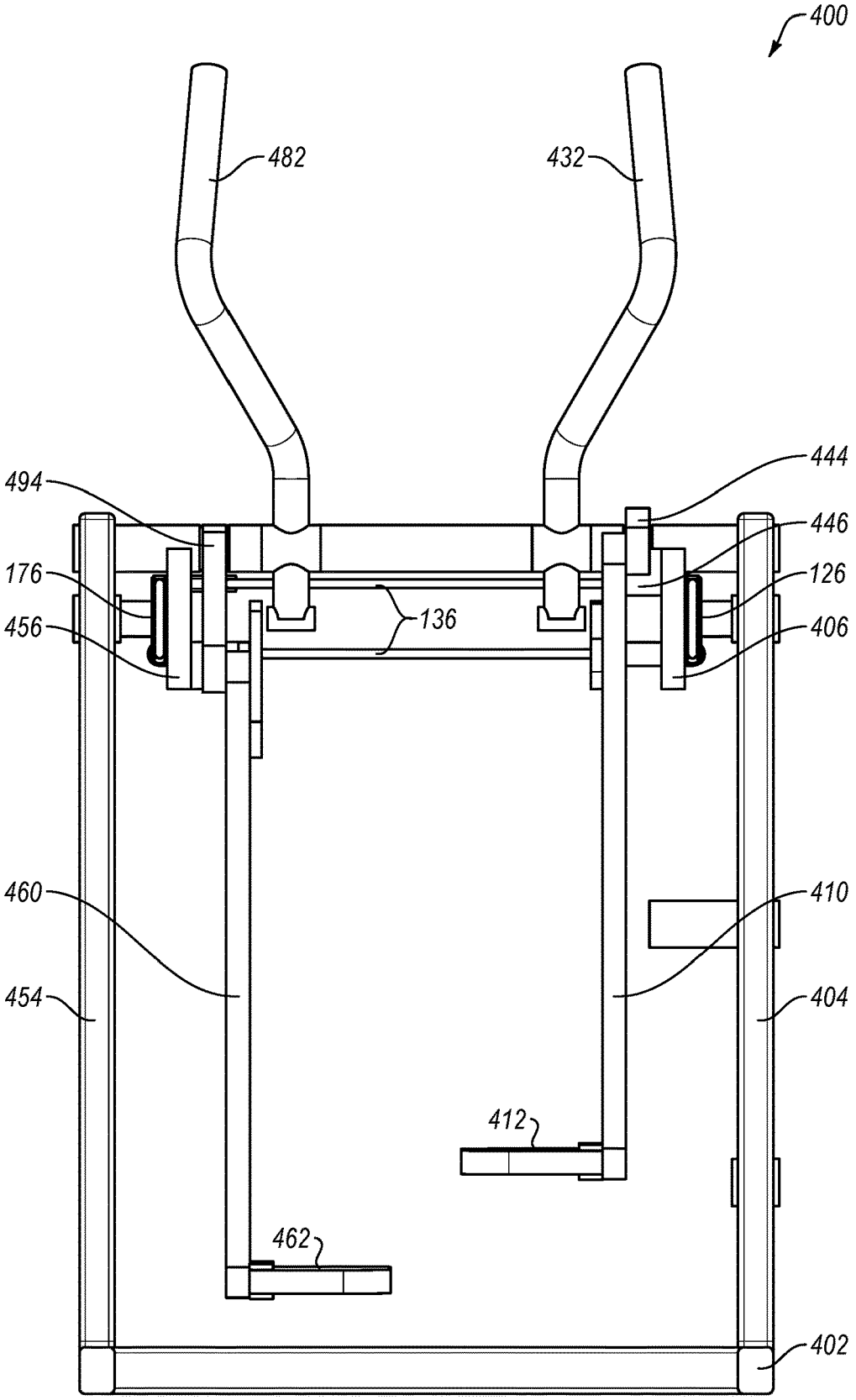
Figure 4C:
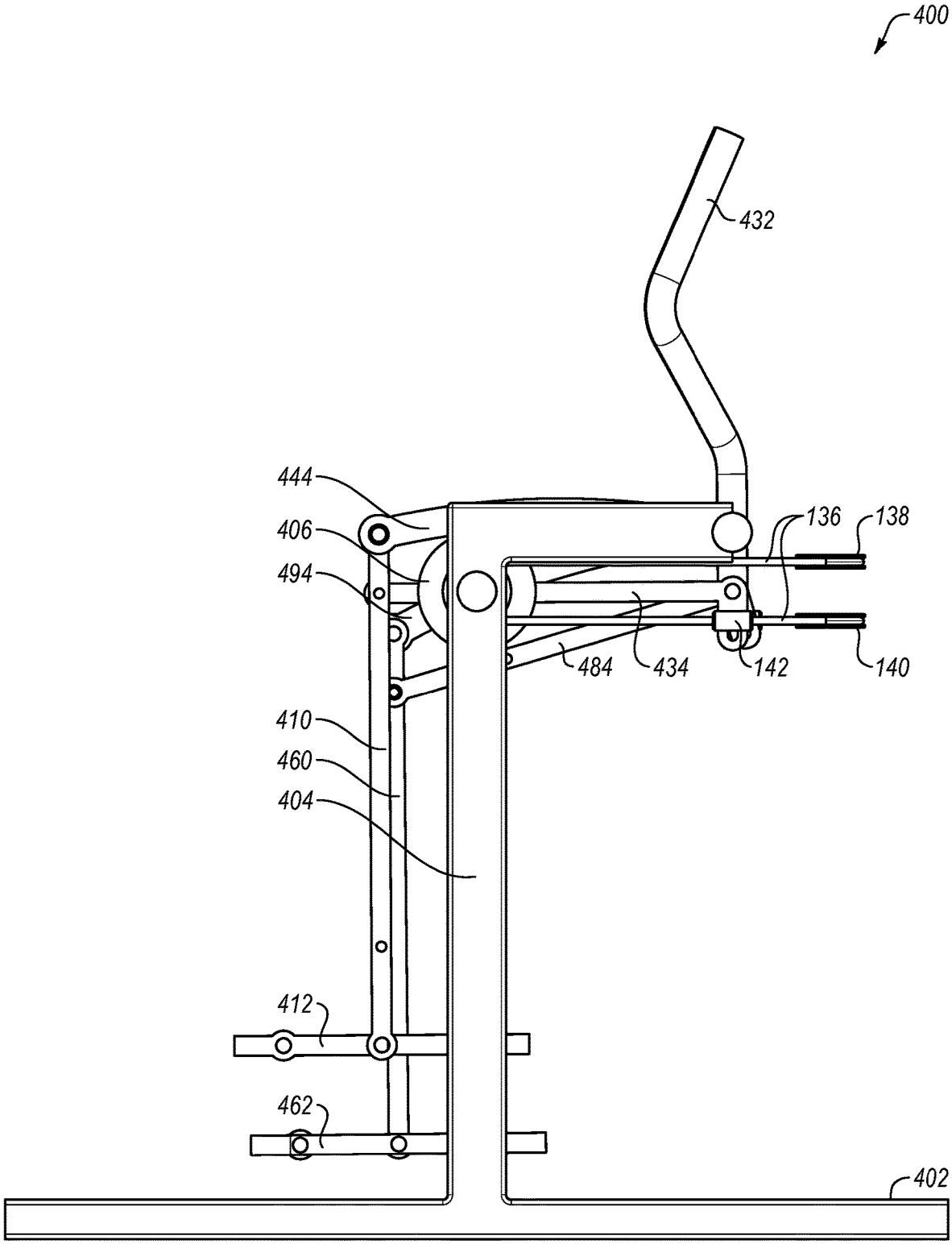
Figure 4D:
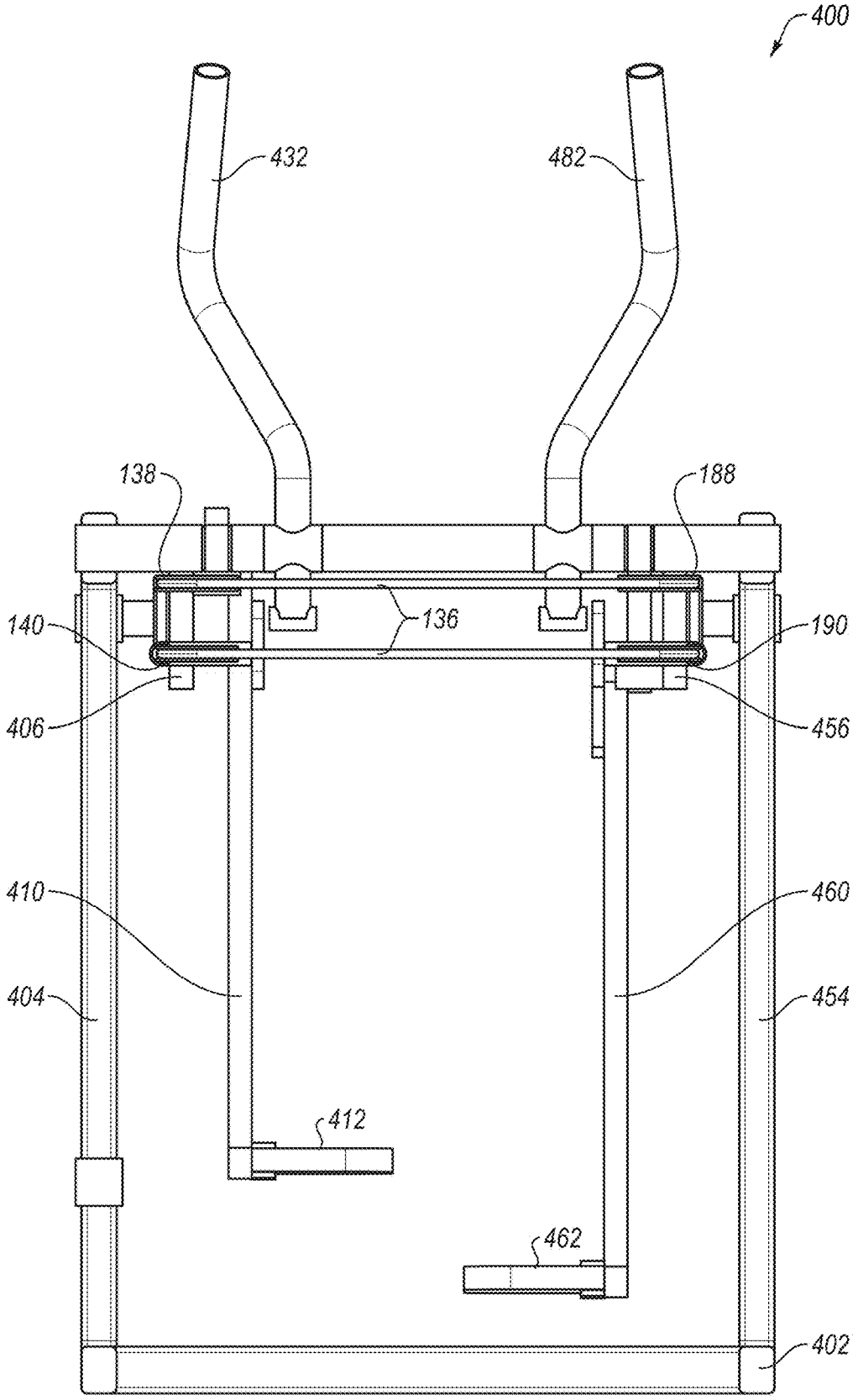
Figure 4E:
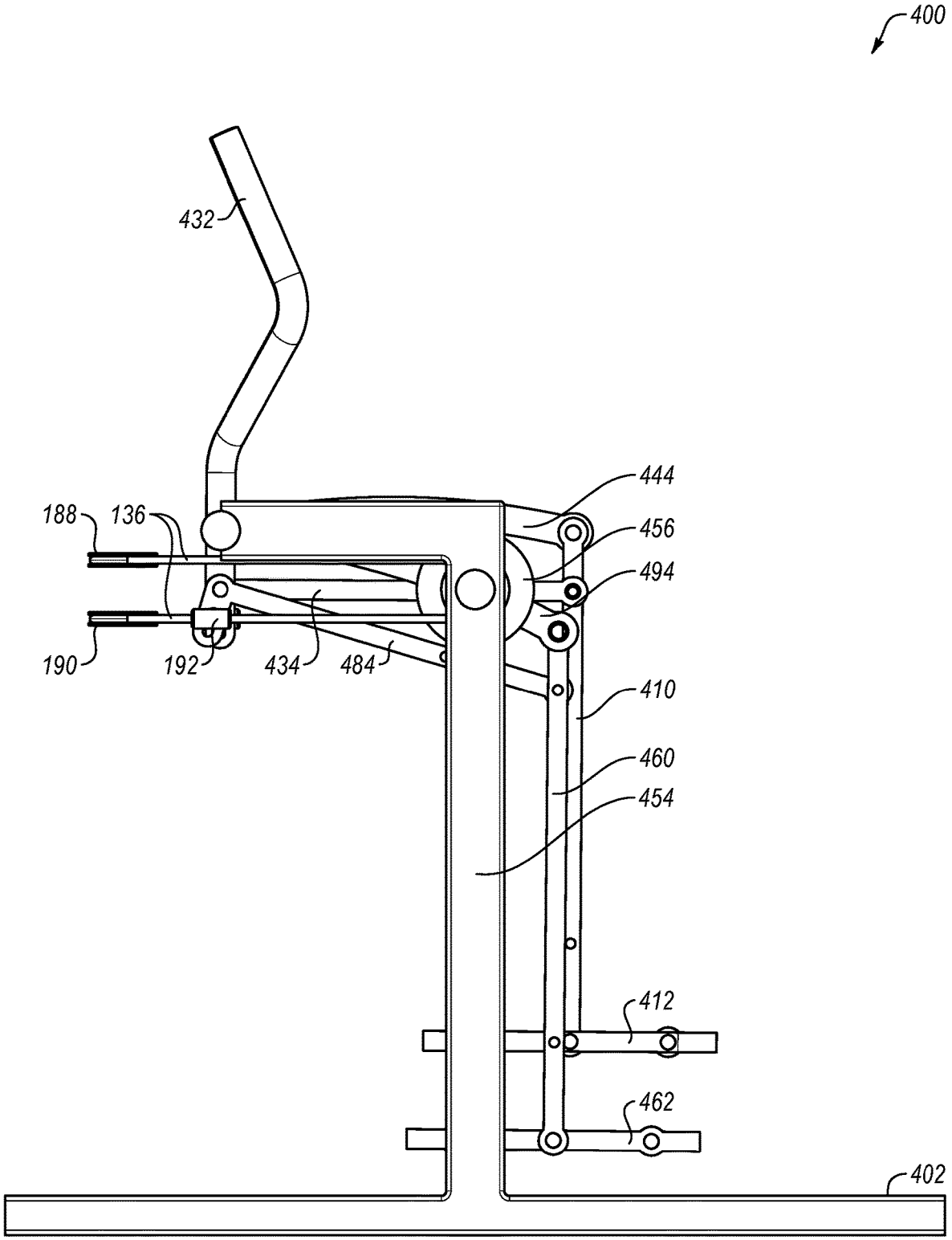
Figure 4F:
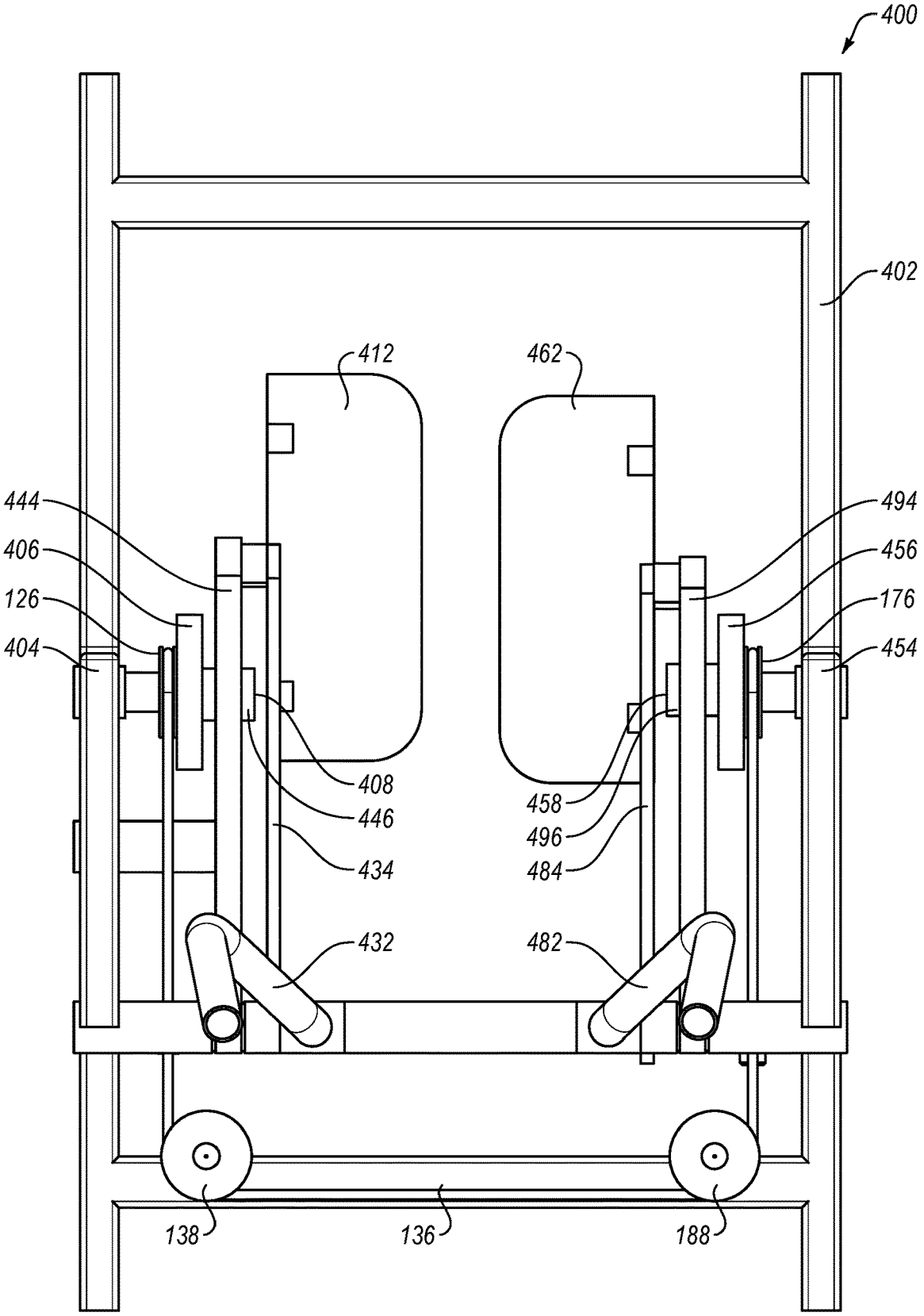
Figure 4G:
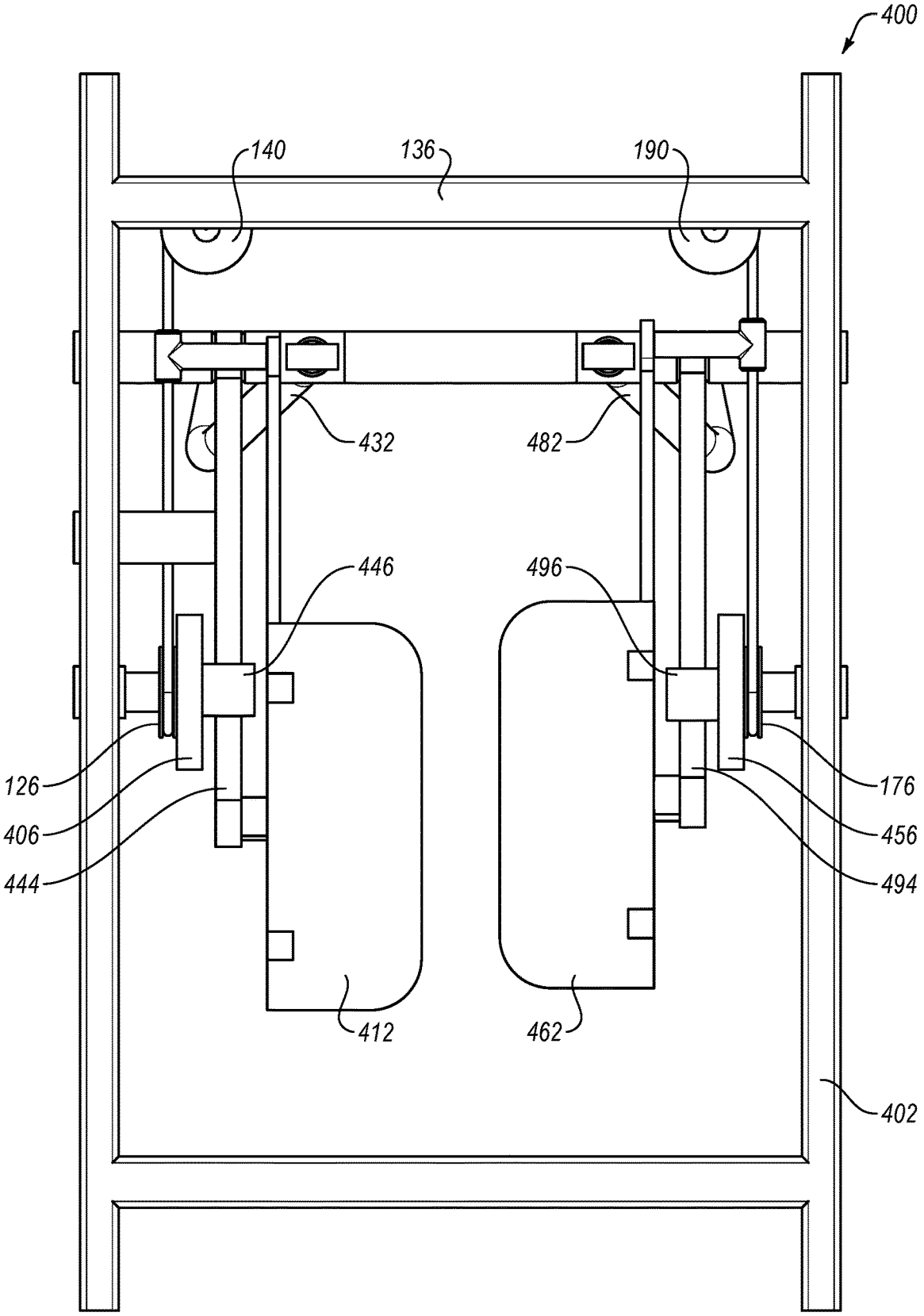

FIGS. 4A-4G are front-left, rear, right, front, left, top, and bottom perspective views, respectively, of a third example elliptical exercise machine 400.

The machine 400 may include a base 402, a right upright stanchion 404 coupled to the base 402 and extending upward from the base 402, and a left upright stanchion 454 coupled to the base 402 and extending upward from the base 402.

The right upright stanchion 404 may support a right crank 406. The right crank 406 may support a right crank arm 408 that is offset from the center of the right crank 406. The right crank arm 408 may support a right pedal leg 410 hanging downward from the right crank arm 408. The right pedal leg 410 may support a right pedal 412. Similarly, the left upright stanchion 454 may support a left crank 456. The left crank 456 may support a left crank arm 458 that is offset from the center of the left crank 456. The left crank arm 458 may support a left pedal leg 460 hanging downward from the left crank arm 458. The left pedal leg 460 may support a left pedal 462.

The machine 400 may further include a right swing handle 432 and a left swing handle 482. The right swing handle 432 may be coupled to a right swing arm 434. The right swing arm 434 may be coupled to the right pedal leg 410. The left swing handle 482 may be coupled to a left swing arm 484. The left swing arm 484 may be coupled to the left pedal leg 460.

Similar to the machine 200, the machine 400 may include the timing cable 136, the right crank pulley 126 that is configured to rotate in phase with the right crank 406, the upper and lower right timing pulleys 138 and 140, the left crank pulley 176 configured to rotate in phase with the left crank 456, the upper and lower left timing pulleys 188 and 190, the right cable guide 142, and the left cable guide 192. Although not shown in the figures, it is understood that the upper and lower right timing pulleys 138 and 140 and the upper and lower left timing pulleys 188 and 190 would be connected to the frame of the exercise machine in a similar fashion as they are connected to the frame of the machine 200, such as to a cross-bar between the generally horizontal and forward portions of the right upright stanchion 404 and the left upright stanchion 454. As they do in the machine 100, this timing cable and these pulleys in the machine 400 may be configured to couple the right crank 406 to the left crank 456 to cause the right crank arm 408 to rotate about 180 degrees out of phase from the left crank arm 458.

Figure 5A:
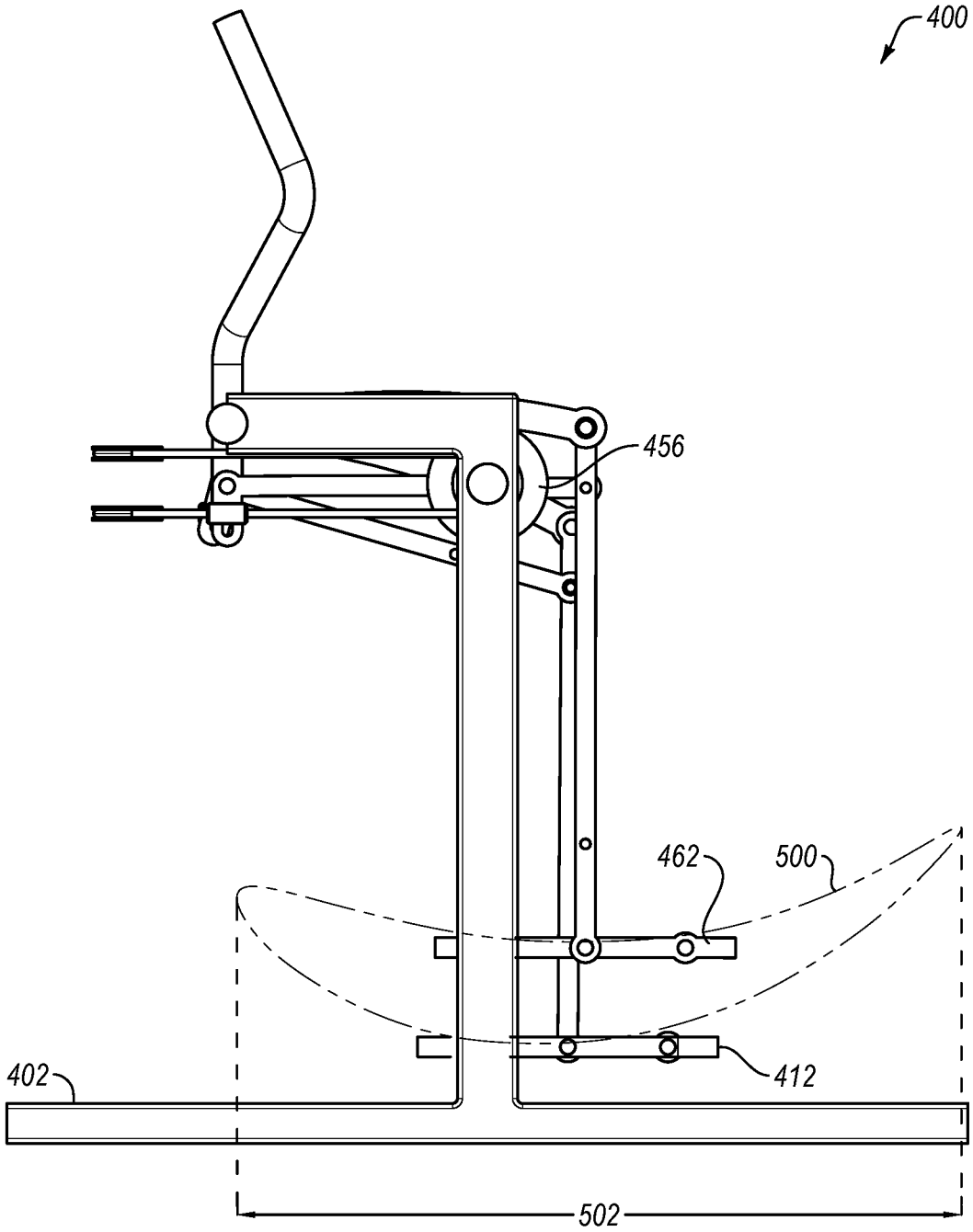
FIGS. 5A-5E are left views of the third example elliptical exercise machine, illustrating an example elliptical path of the third example elliptical exercise machine.
Figure 5B:
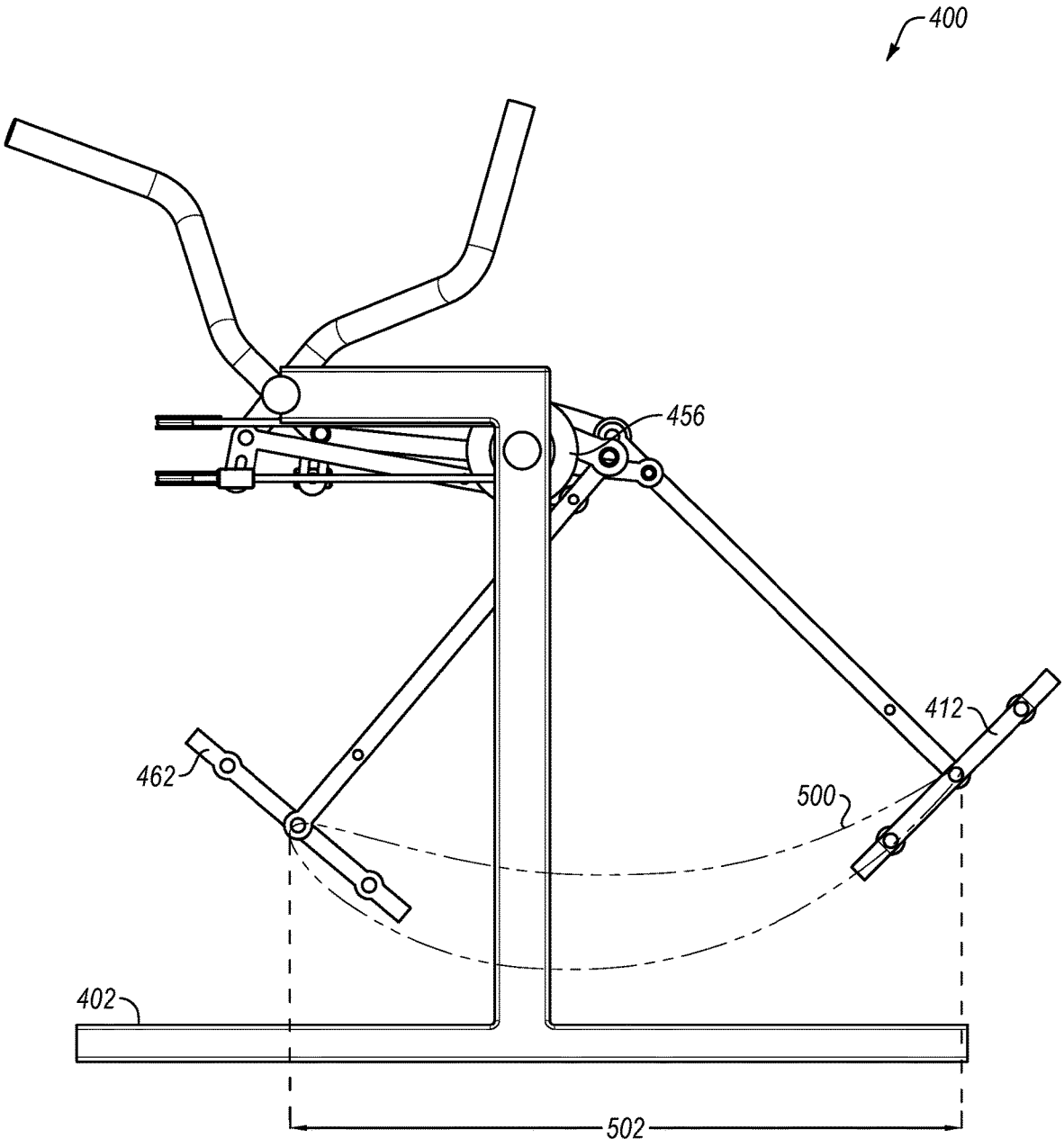
Figure 5C:
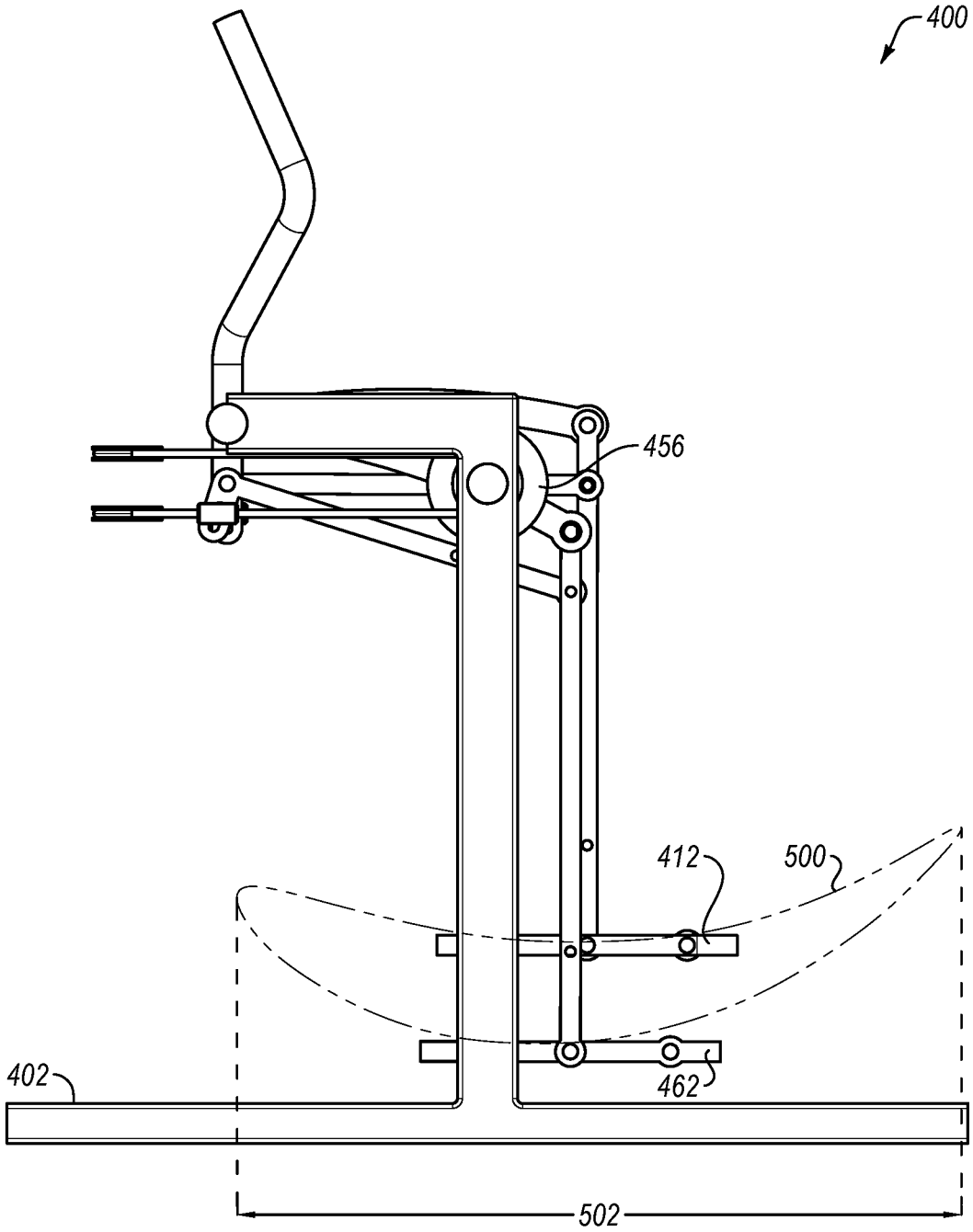
Figure 5D:
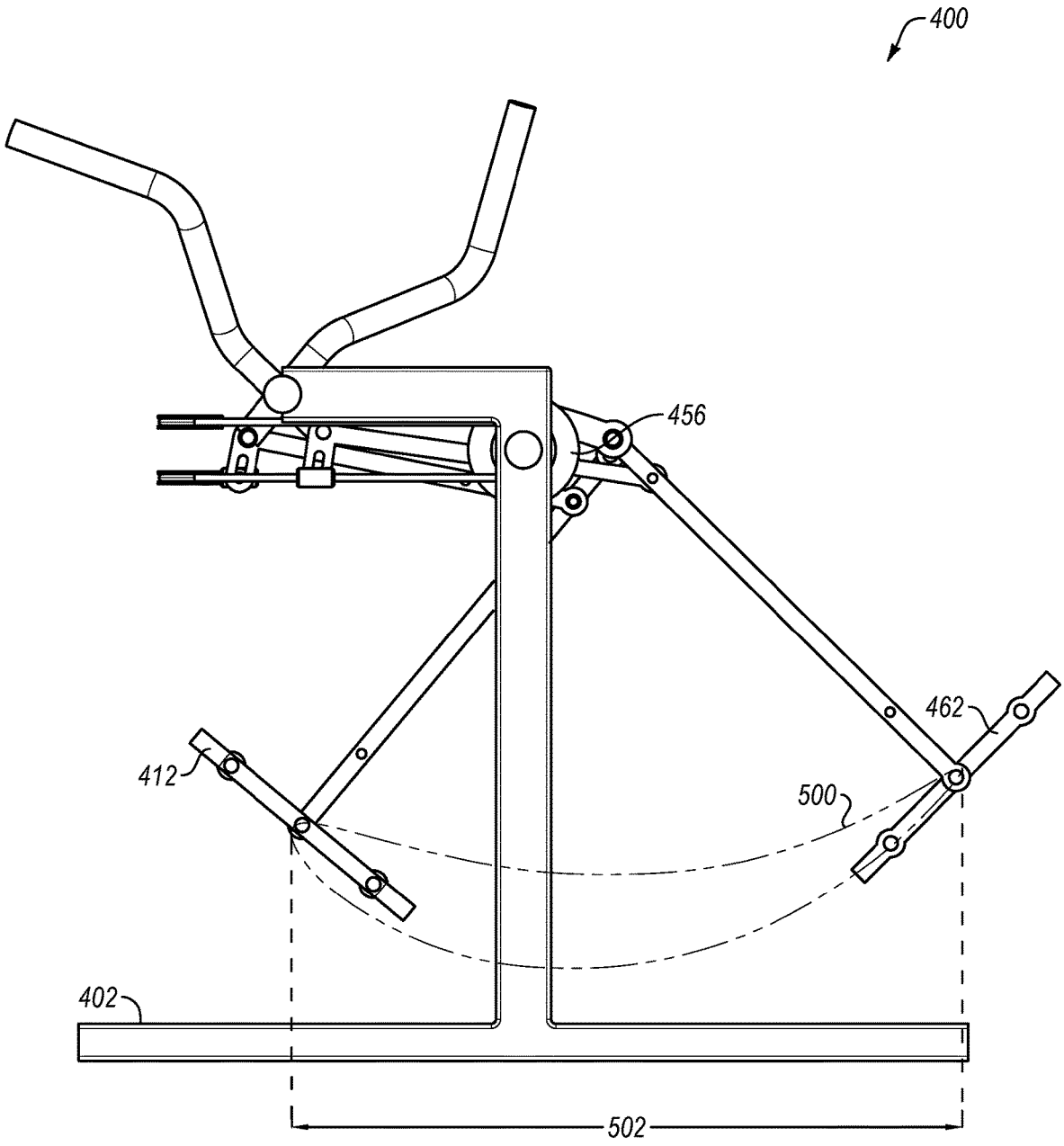
Figure 5E:
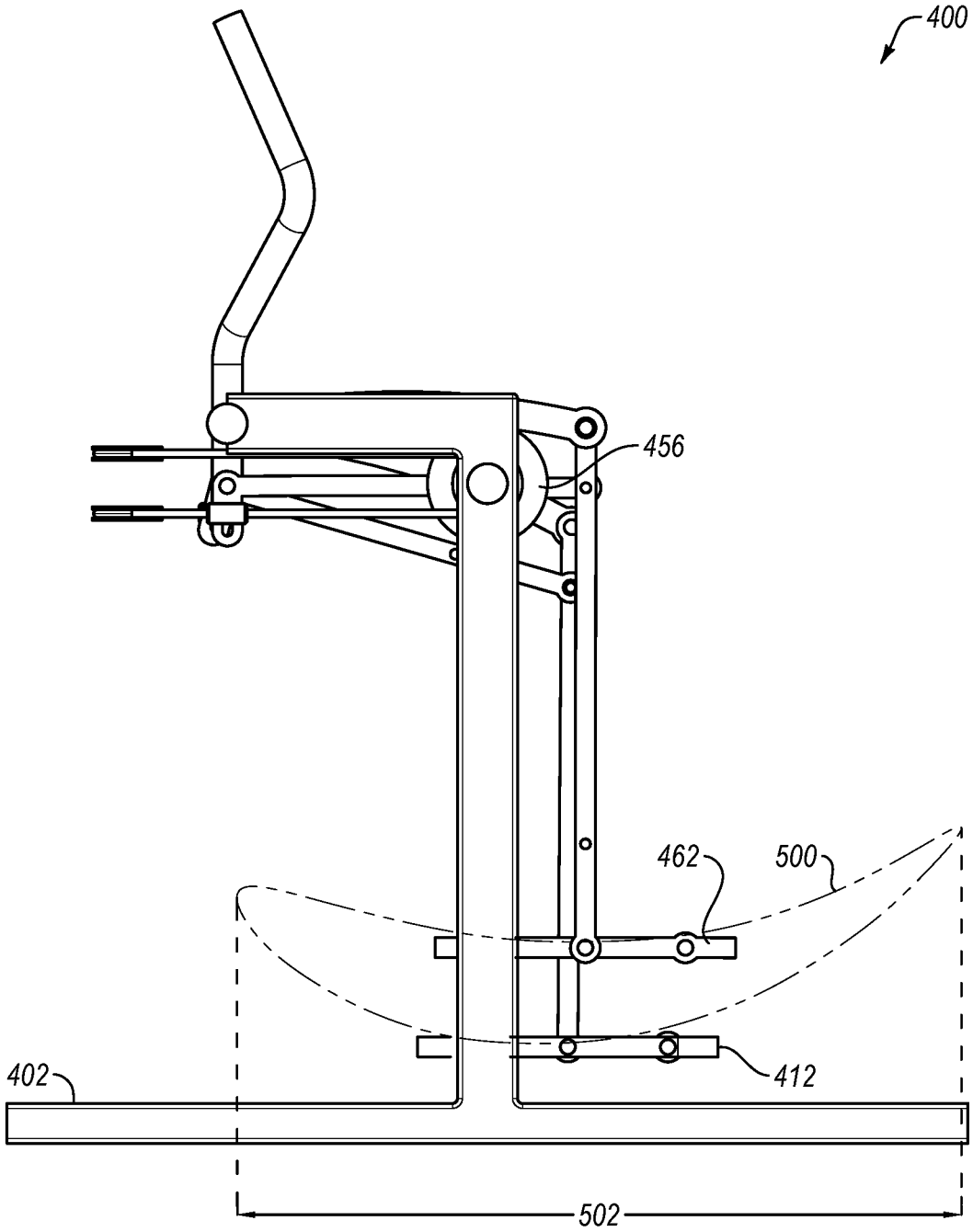

The right pedal leg 410 of the machine 400 may be supported by the right crank arm 408 via a coupling to a right roller arm 444, with the right roller arm 444 configured to roll atop a right roller 446 that is coupled to the right crank arm 408. Similarly, the left pedal leg 460 of the machine 400 may be supported by the left crank arm 458 via a coupling to a left roller arm 494, with the left roller arm 494 configured to roll atop a left roller 496 that is coupled to the left crank arm 458. By supporting the pedal legs on the rollers of the crank arms using the roller arms, differently shaped elliptical paths may be achieved (e.g., compare the shape of the elliptical path 300 of FIGS. 3A-3E to the shape of the elliptical path 500 of FIGS. 5A-5E).

FIGS. 5A-5E are left views of the third example elliptical exercise machine 400, illustrating an example elliptical path 500 of the third example elliptical exercise machine 400.

During operation of the machine 400, the right pedal 412 may be configured to swing forward and rearward along the elliptical path 500 by a user's right foot striding forward and rearward with a length 502 of each swing determined by a length of the stride of the user's right foot. The right pedal 412 may be configured to raise upward and lower downward along the elliptical path 500 as the right crank arm 408 (see e.g., FIG. 4F) moves upward and downward during rotation of the right crank 406 (see e.g., FIG. 4F). Similarly, the left pedal 462 may be configured to swing forward and rearward along the elliptical path 500 by a user's left foot striding forward and rearward with a length 502 of each swing determined by a length of the stride of the user's left foot. The left pedal 462 may be configured to raise upward and lower downward along the elliptical path 500 as the left crank arm 458 (see e.g., FIG. 4F) moves upward and downward during rotation of the left crank 456.

The machine 400 may therefore allow for the elliptical path 500 to have a dynamically variable stride length 502 which allows the user to stride with a stride length that is comfortable to the user. Also, machine 400 may have a shorter front-to-back footprint than conventional elliptical exercise machines. This relatively shorter front-to-back footprint may result in at least a portion of the right pedal 412 being configured to swing rearward further than a rearmost portion of the base 402 (see, e.g., FIG. 5B) and at least a portion of the left pedal 462 being configured to swing rearward further than a rearmost portion of the base 402 (see, e.g., FIG. 5D).

Figure 6A:
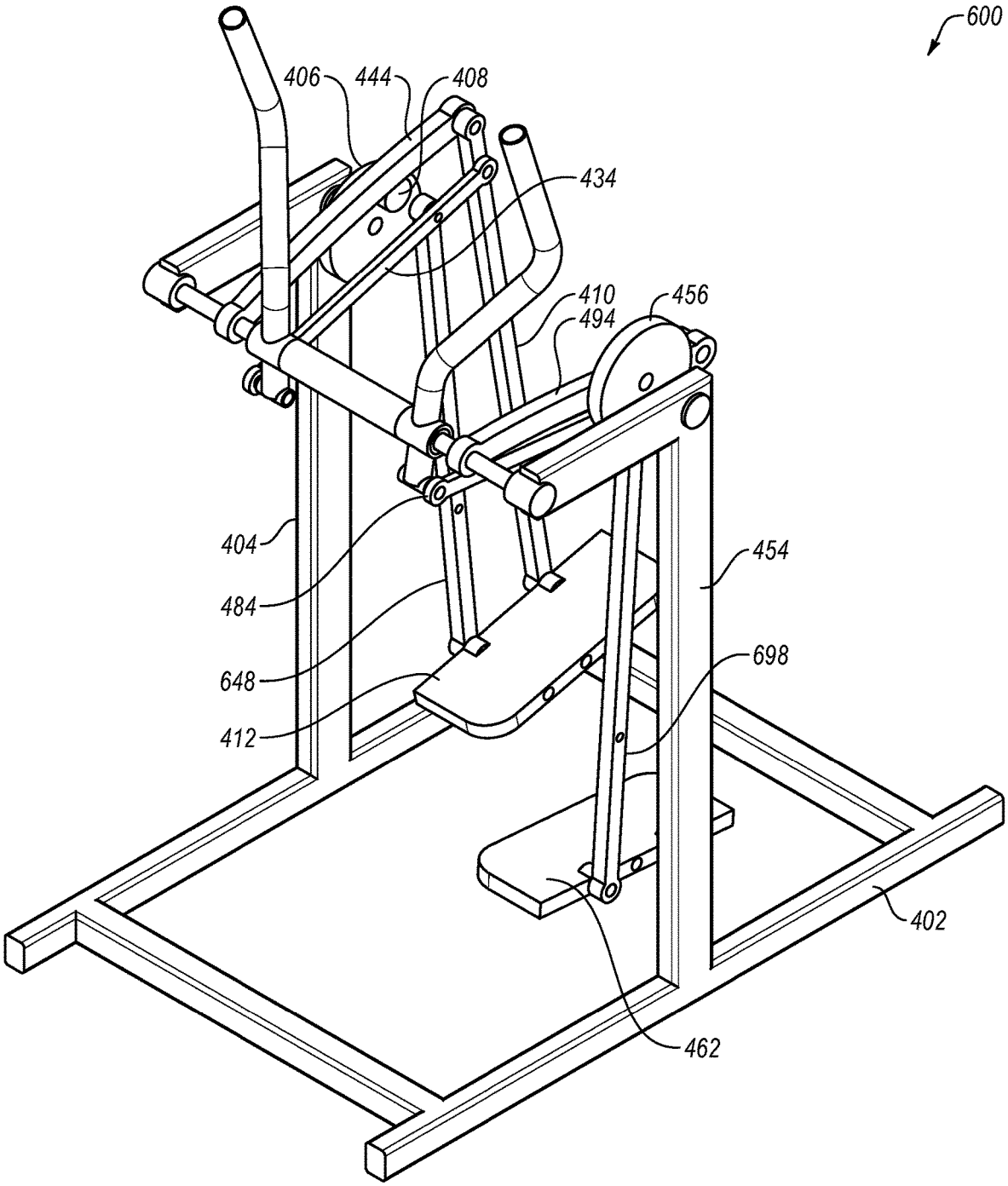
FIGS. 6A-6G are front-left, rear, right, front, left, top, and bottom perspective views, respectively, of a fourth example elliptical exercise machine.
Figure 6B:
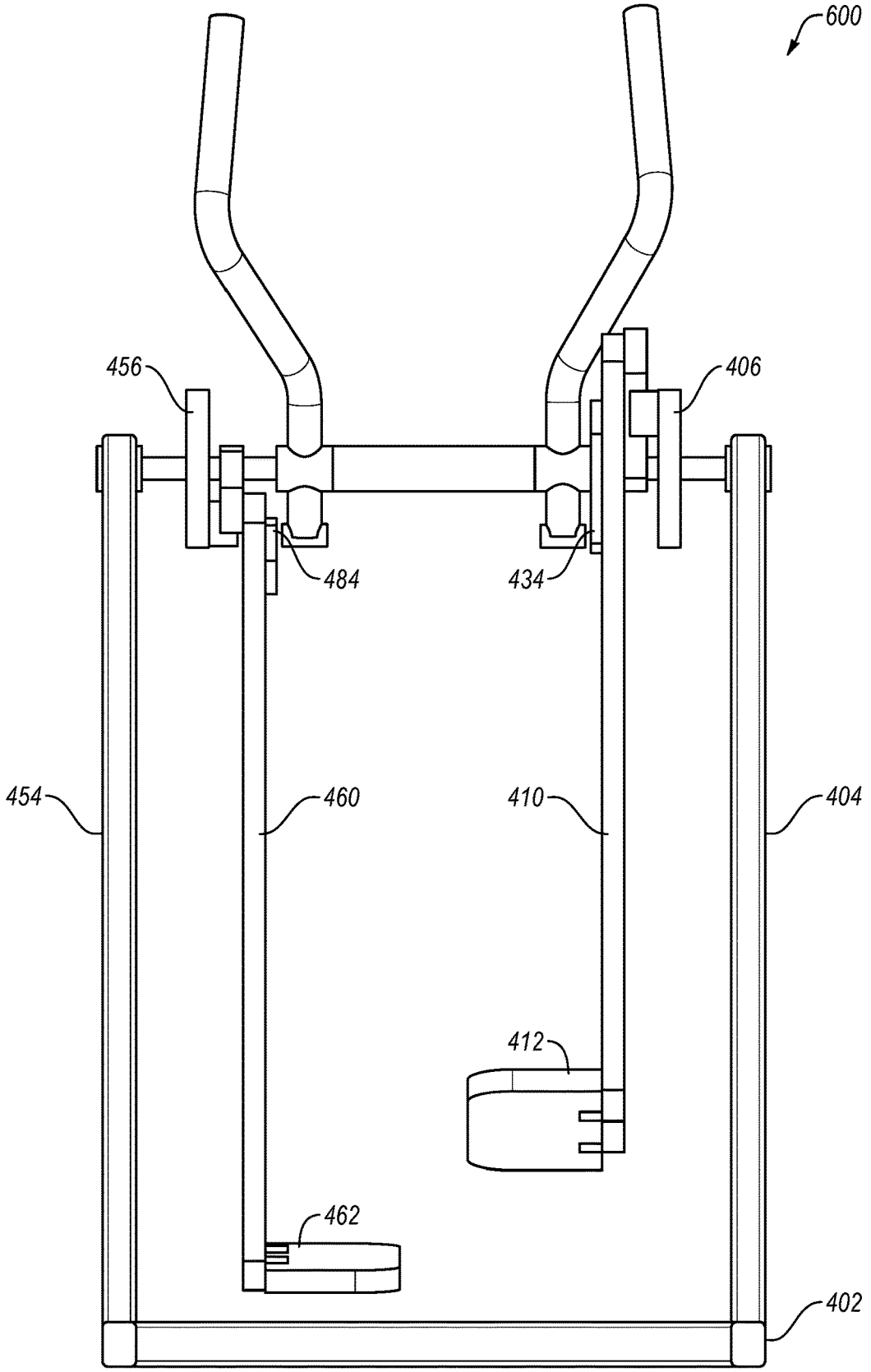
Figure 6C:
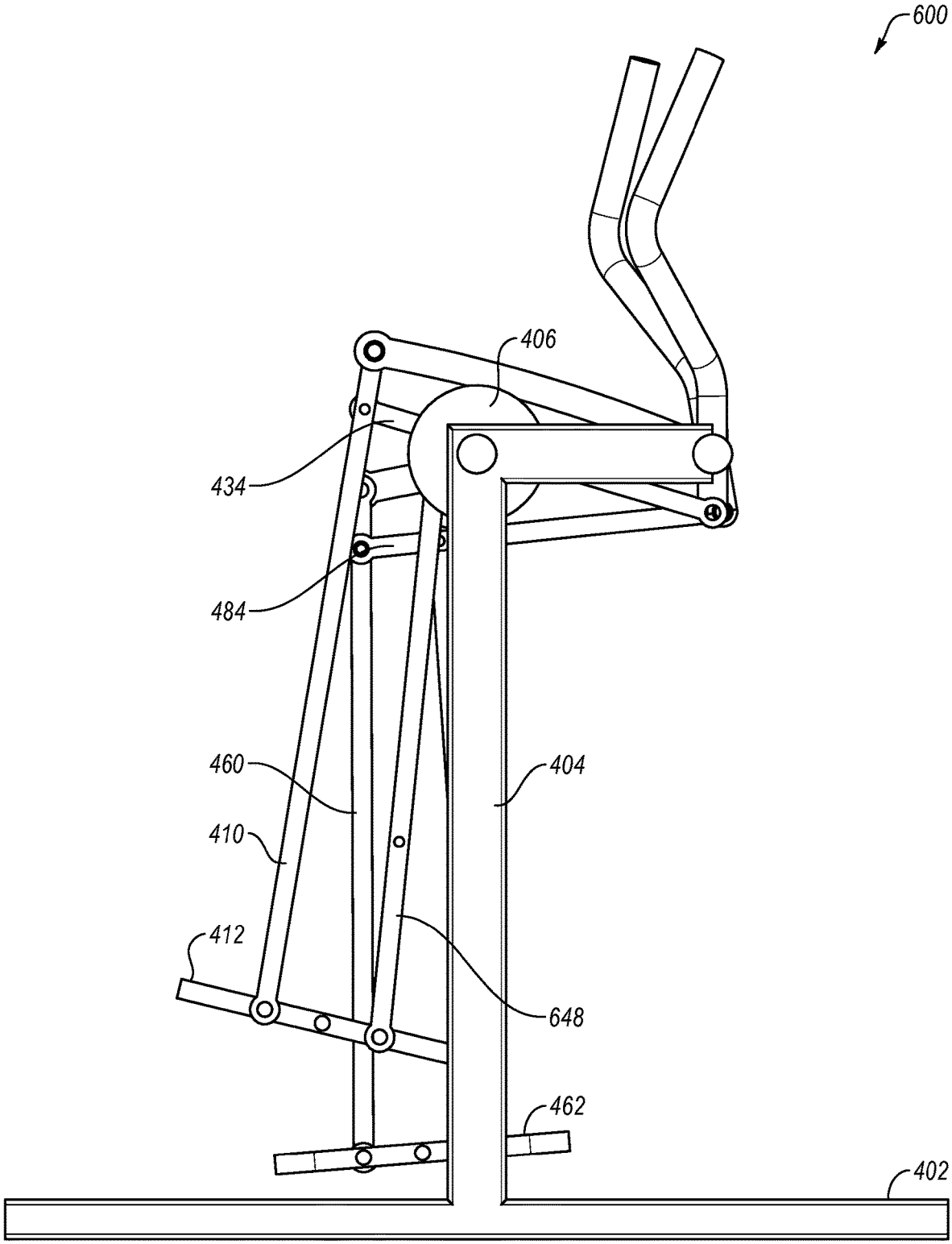
Figure 6D:
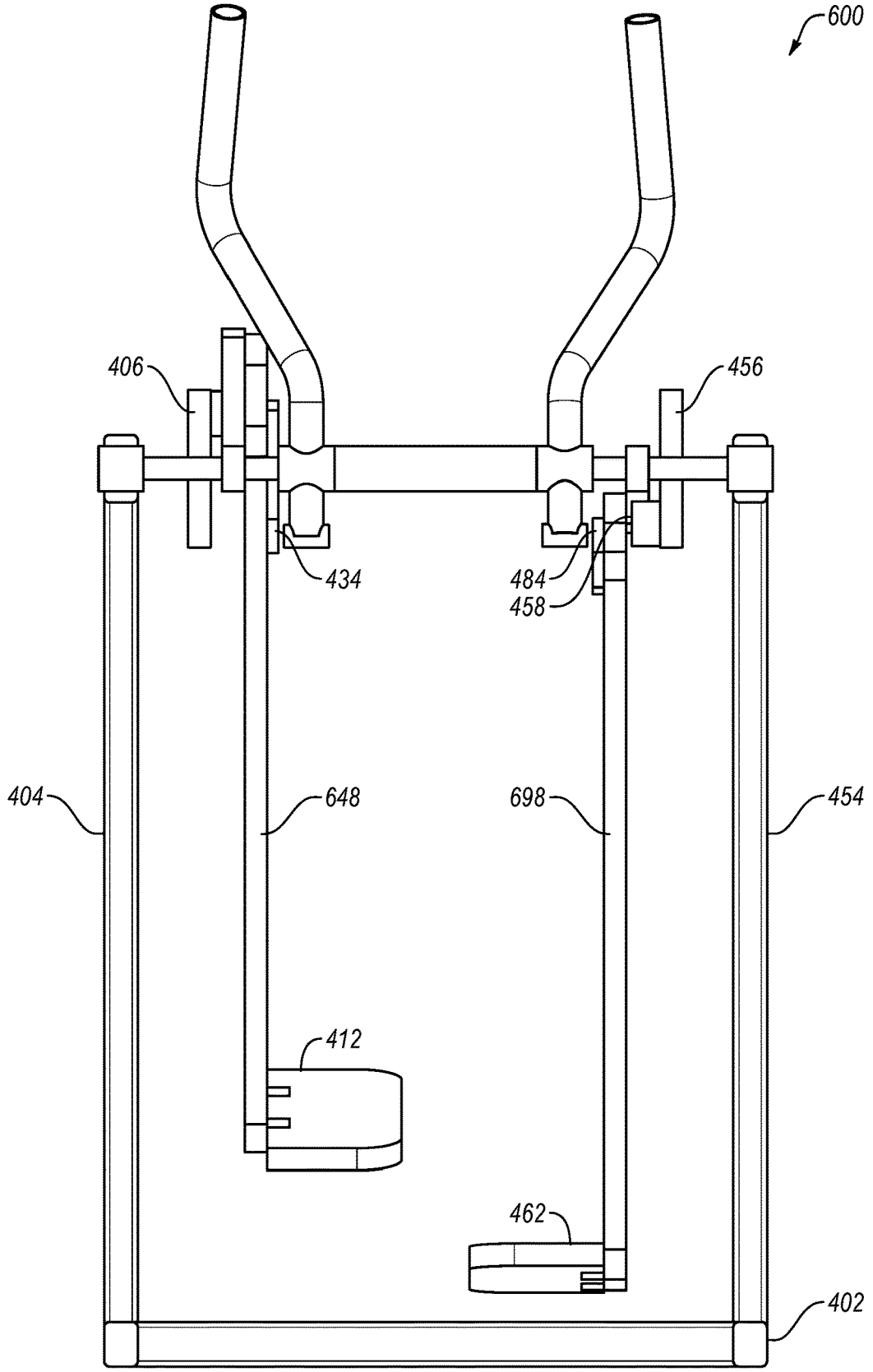
Figure 6E:
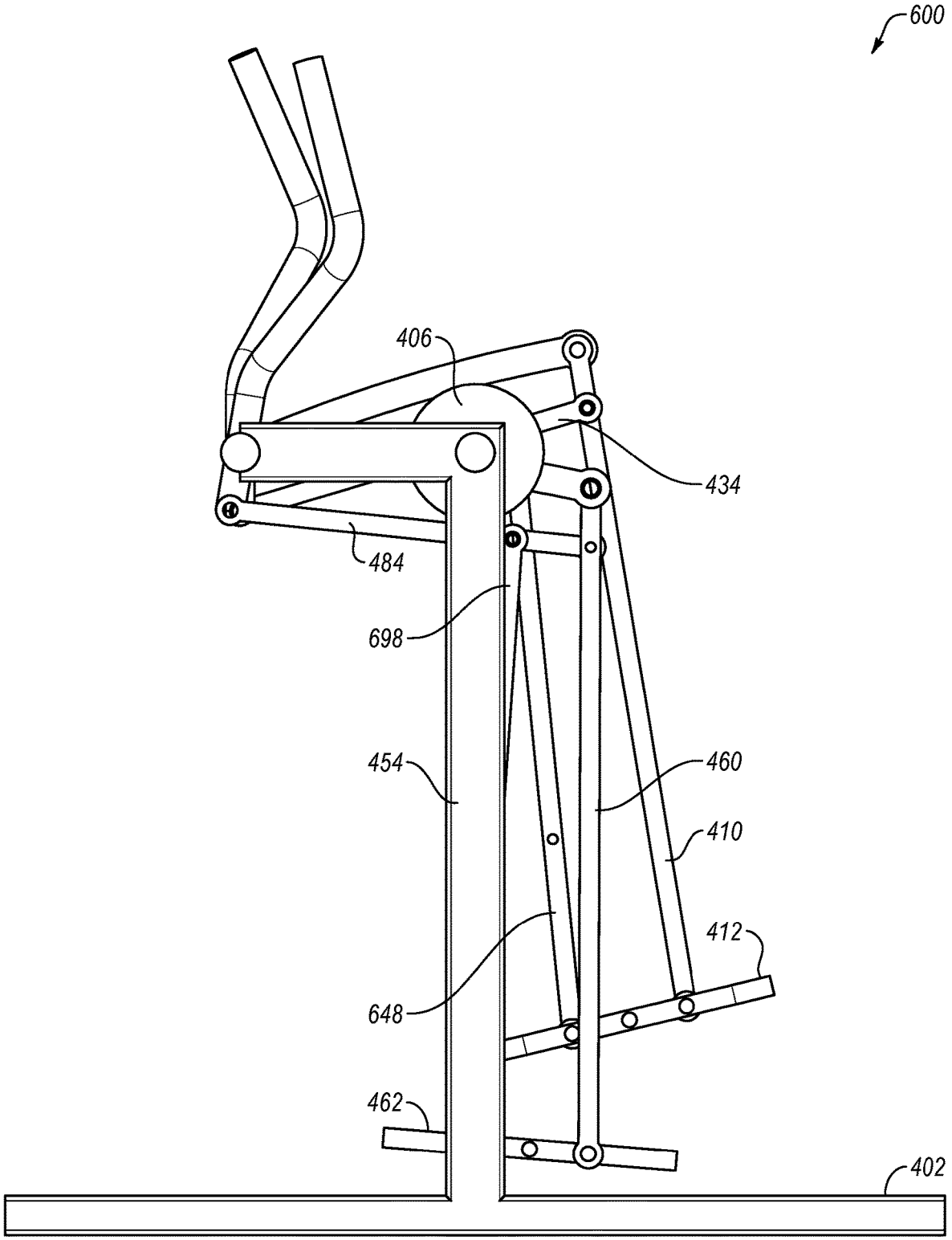
Figure 6F:
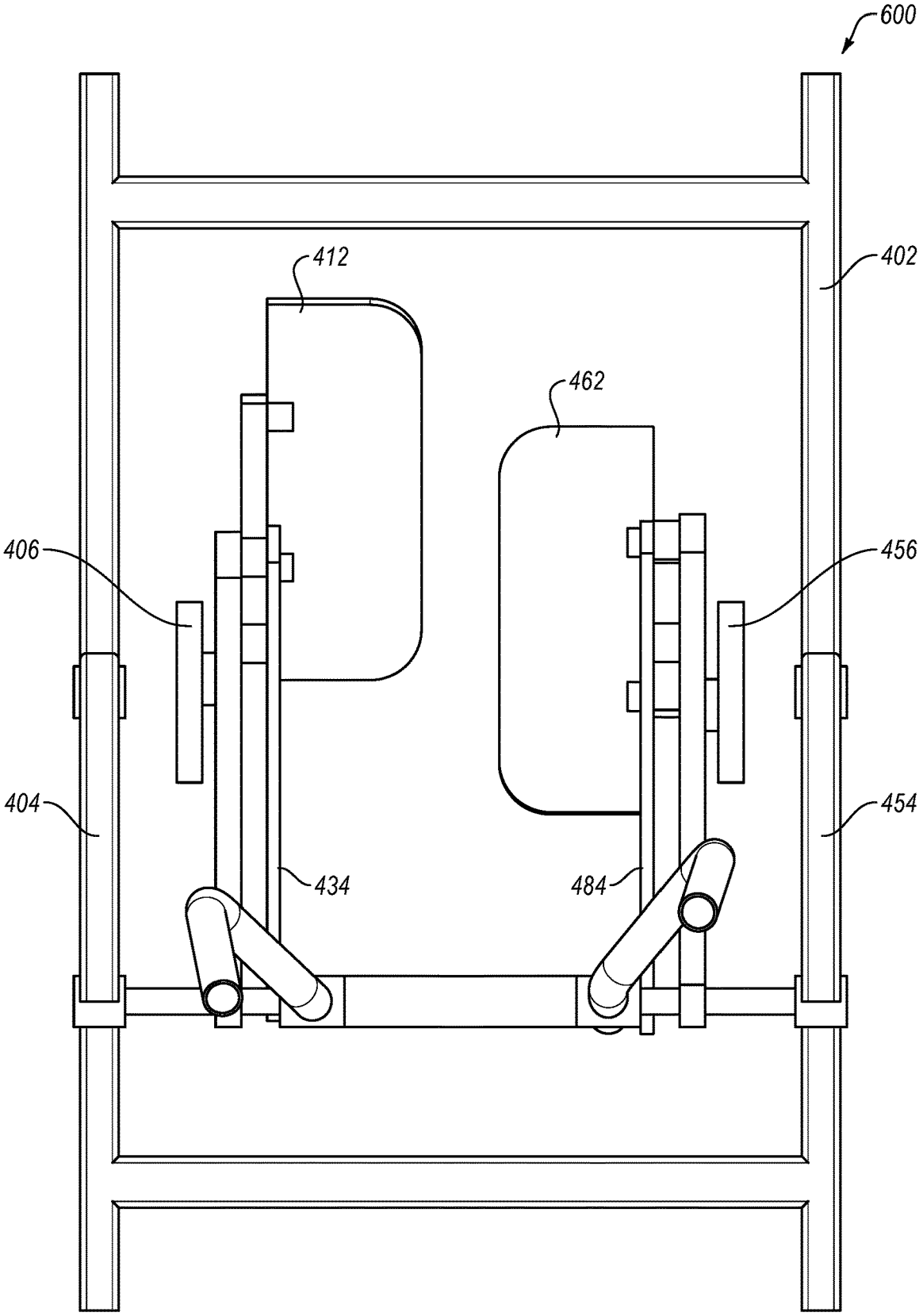
Figure 6G:
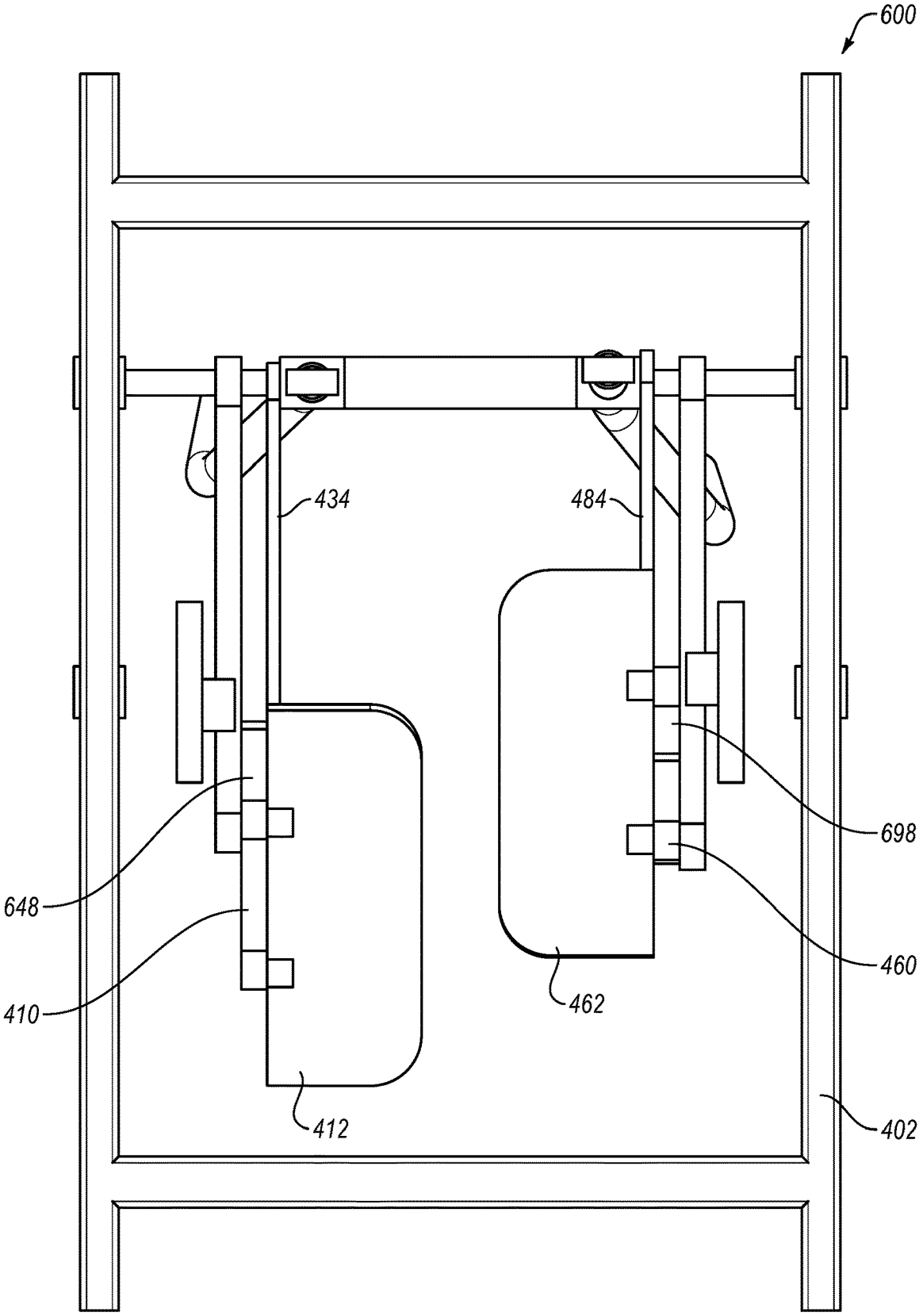

FIGS. 6A-6G are front-left, rear, right, front, left, top, and bottom perspective views, respectively, of a fourth example elliptical exercise machine 600. The machine 600 is similar to the machine 400, and therefore the discussion of the machine 600 will be limited to aspects of the machine 600 that differ from the machine 400.

The machine 600 supports the right crank 406 higher on right upright stanchion 404, and supports the left crank 456 higher on left upright stanchion 454, than the machine 400. Also, the machine 600 eliminates the timing cable 136, the right crank pulley 126, the upper and lower right timing pulleys 138 and 140, the left crank pulley 176, and the upper and lower left timing pulleys 188 and 190.

Figure 7A:
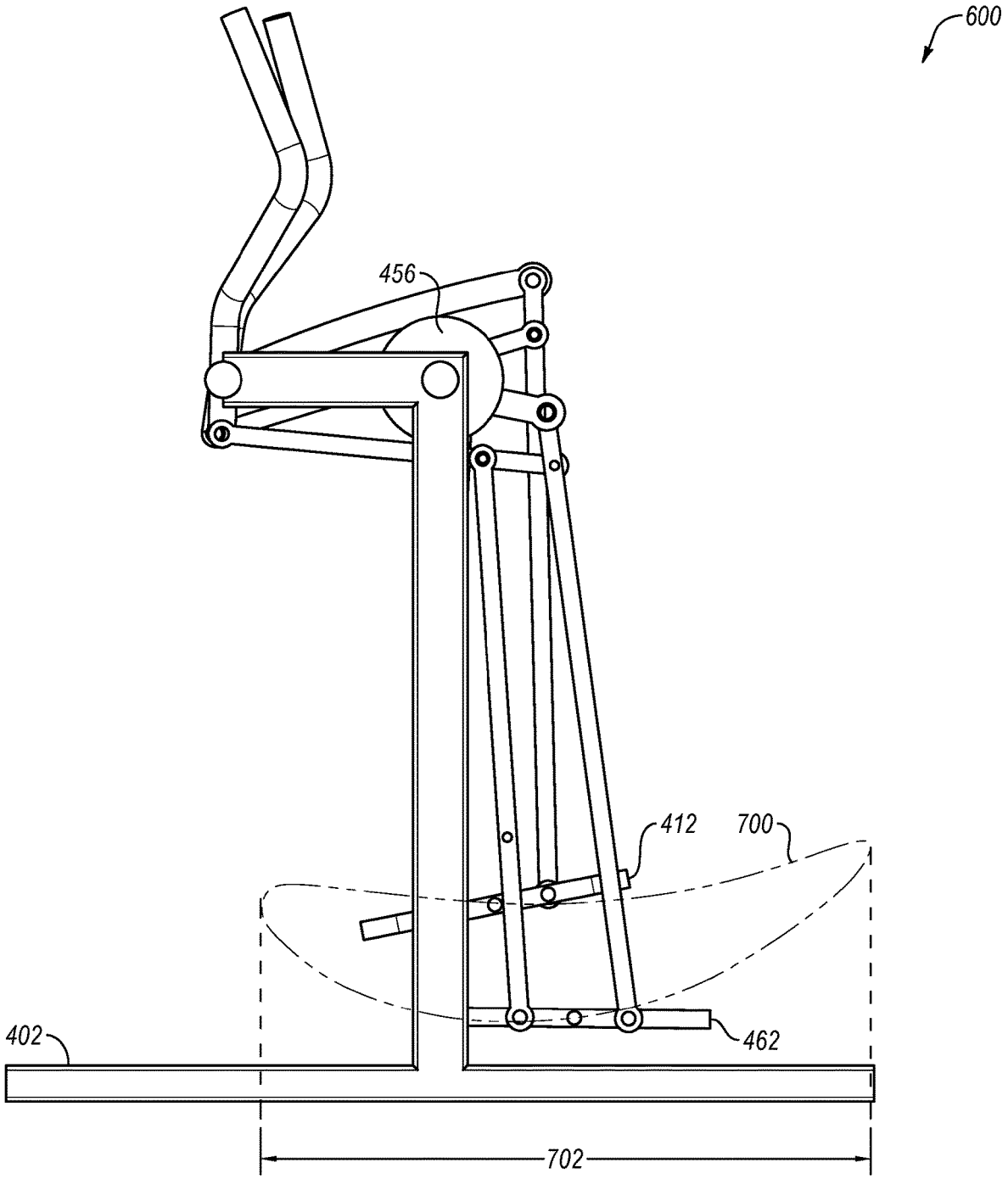
FIGS. 7A-7E are left views of the fourth example elliptical exercise machine, illustrating an example elliptical path of the fourth example elliptical exercise machine.
Figure 7B:
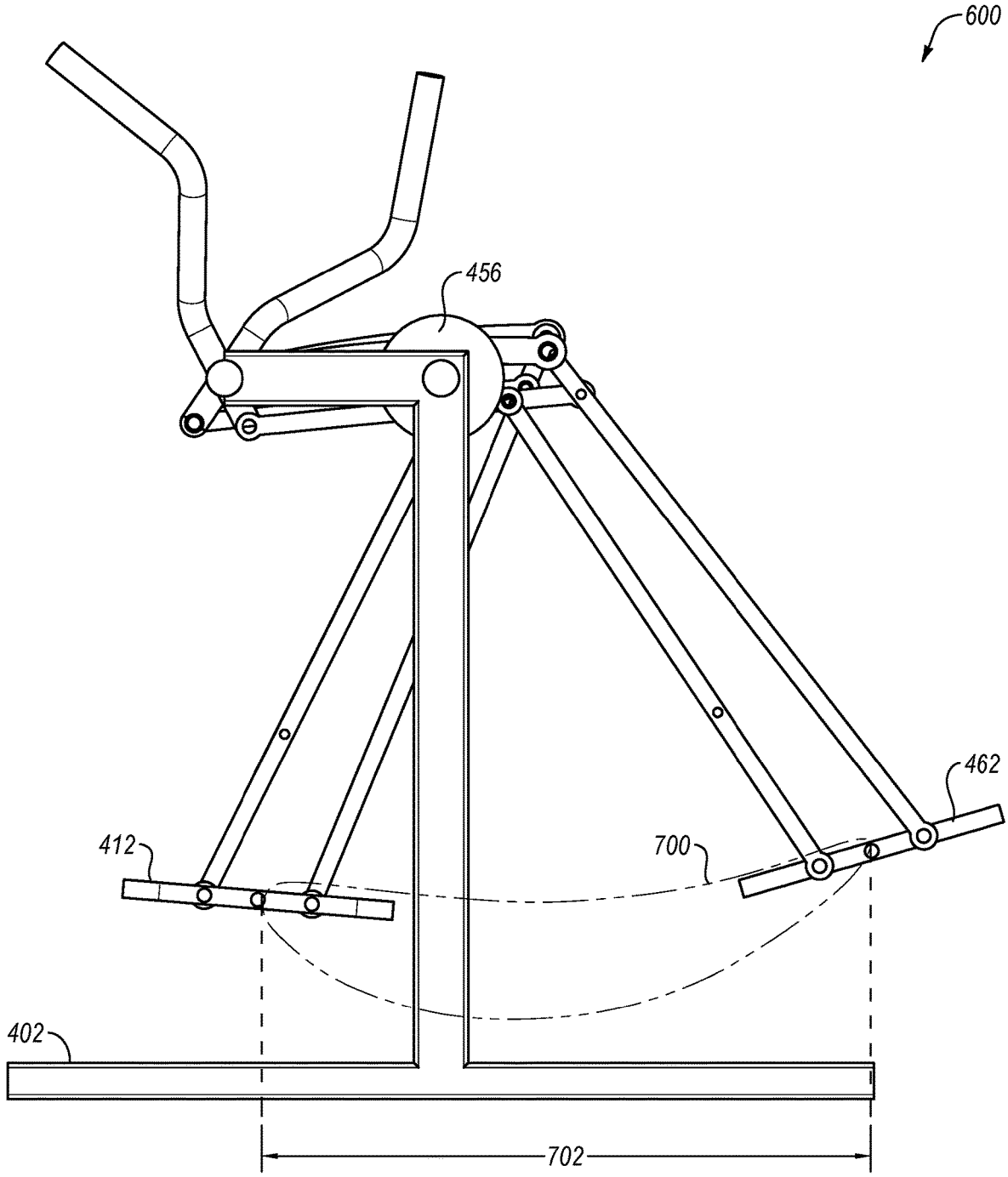
Figure 7C:
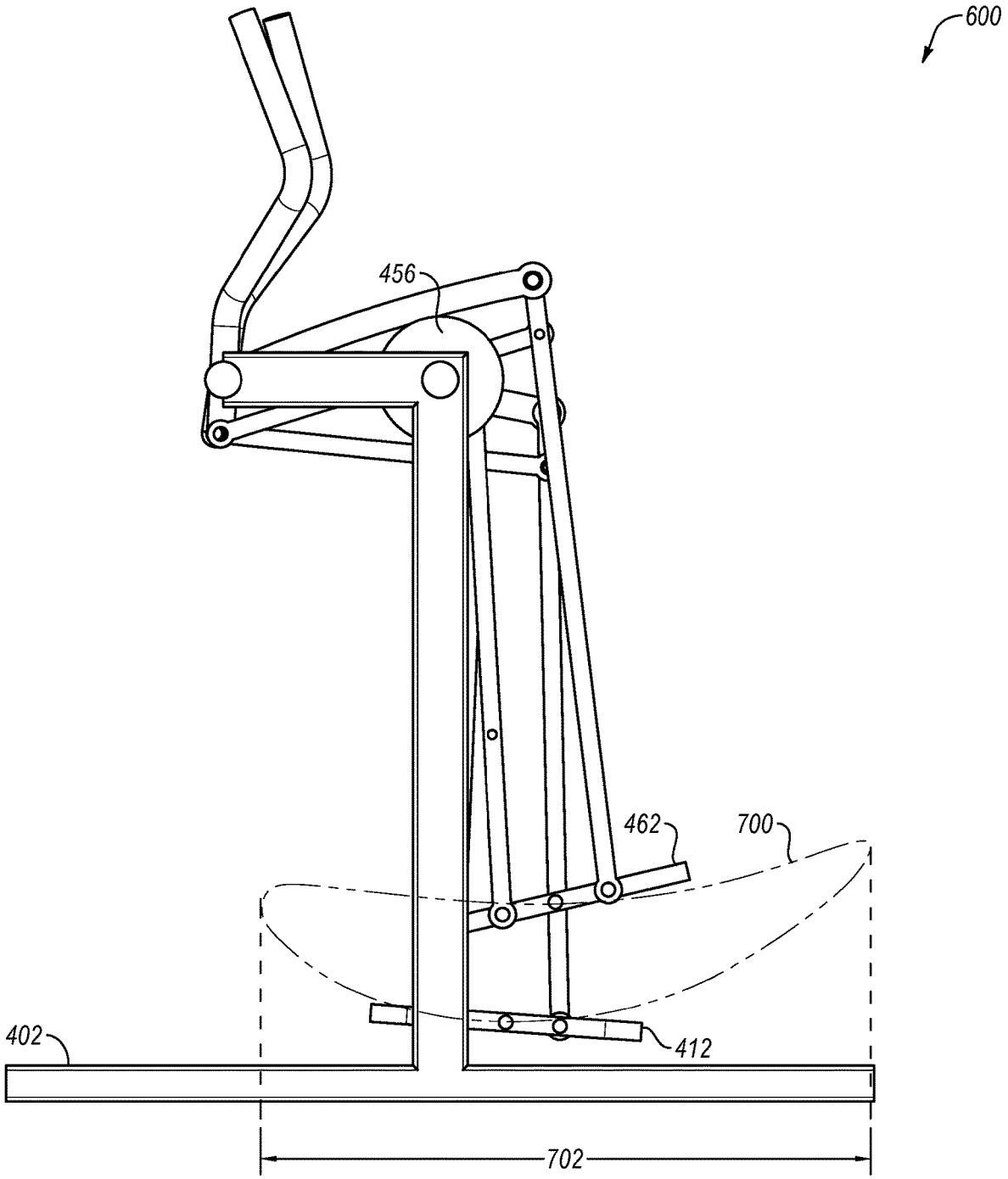
Figure 7D:
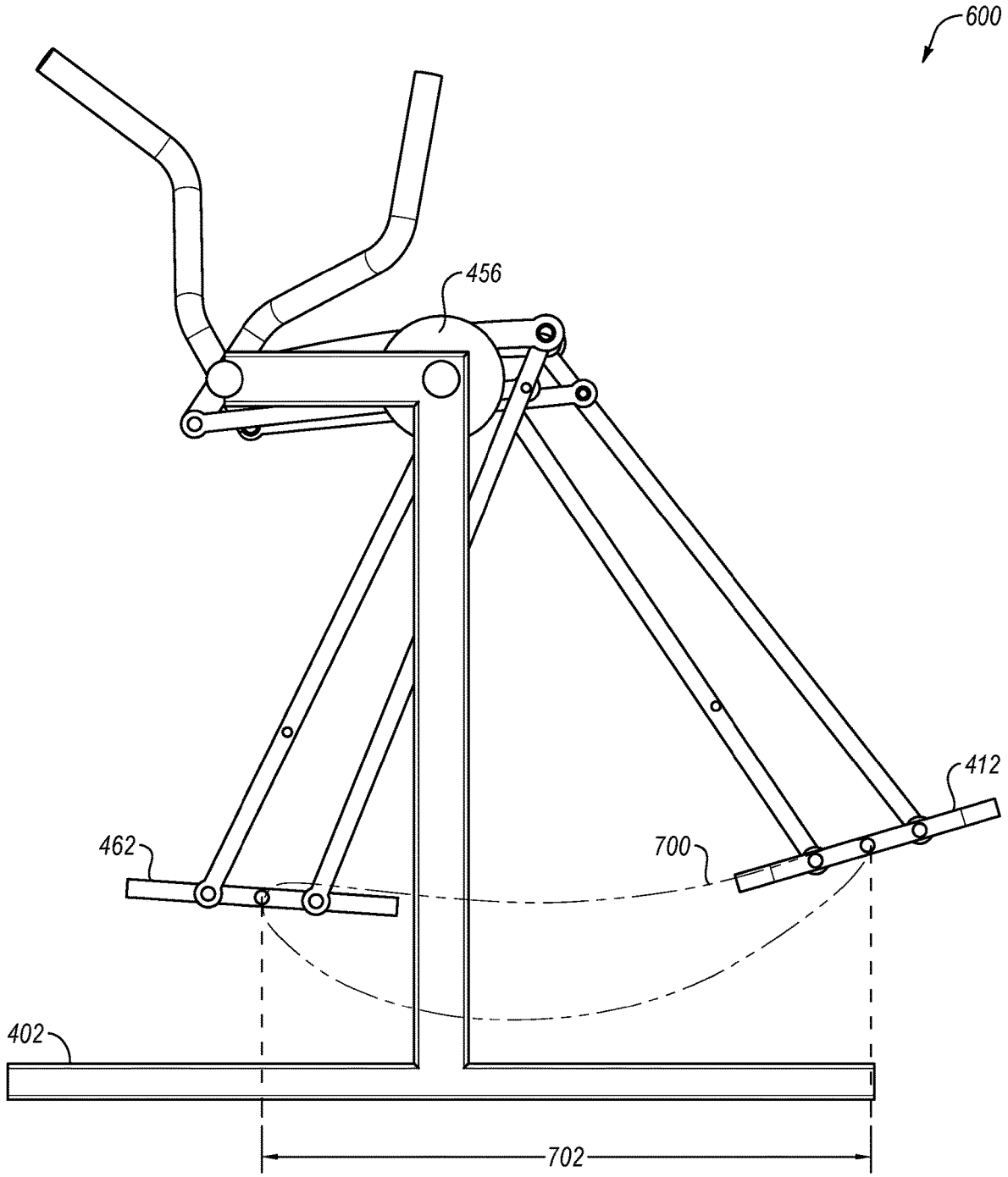
Figure 7E:
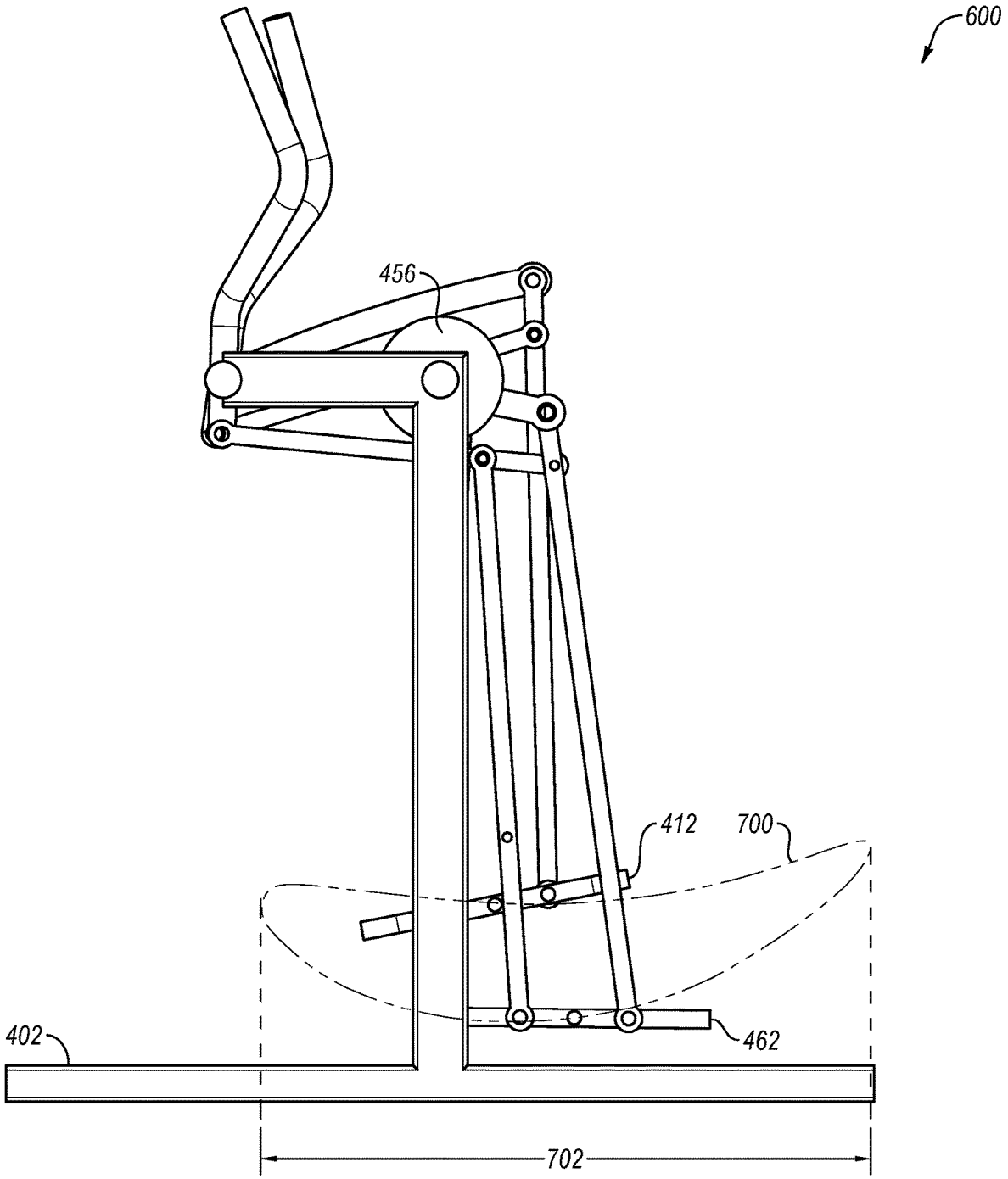

In addition, the machine 600 may include a second right pedal leg 648 supported by the right swing arm 434 and hanging downward from the right swing arm 434, with the second right pedal leg 648 further supporting the right pedal 412. Similarly, the machine 600 may include a second left pedal leg 698 supported by the left swing arm 484 and hanging downward from the left swing arm 484, with the second left pedal leg 698 further supporting the left pedal 462. By adding a second pedal leg supporting each pedal, differently shaped elliptical paths may be achieved (e.g., compare the shape of the elliptical path 500 of FIGS. 5A-5E to the shape of the elliptical path 700 of FIGS. 7A-7E).

FIGS. 7A-7E are left views of the fourth example elliptical exercise machine 600, illustrating an example elliptical path 700 of the fourth example elliptical exercise machine 600

During operation of the machine 600, the right pedal 412 may be configured to swing forward and rearward along the elliptical path 700 by a user's right foot striding forward and rearward with a length 702 of each swing determined by a length of the stride of the user's right foot. The right pedal 412 may be configured to raise upward and lower downward along the elliptical path 700 as the right crank arm 408 (see e.g., FIG. 6A) moves upward and downward during rotation of the right crank 406 (see e.g., FIG. 6A) Similarly, the left pedal 462 may be configured to swing forward and rearward along the elliptical path 700 by a user's left foot striding forward and rearward with a length 702 of each swing determined by a length of the stride of the user's left foot. The left pedal 462 may be configured to raise upward and lower downward along the elliptical path 700 as the left crank arm 458 (see e.g., FIG. 6D) moves upward and downward during rotation of the left crank 456.

The machine 600 may therefore allow for the elliptical path 700 to have a dynamically variable stride length 702 which allows the user to stride with a stride length that is comfortable to the user. Also, machine 600 may have a shorter front-to-back footprint than conventional elliptical exercise machines. This relatively shorter front-to-back footprint may result in at least a portion of the right pedal 412 being configured to swing rearward further than a rearmost portion of the base 402 (see, e.g., FIG. 7D) and at least a portion of the left pedal 462 being configured to swing rearward further than a rearmost portion of the base 402 (see, e.g., FIG. 7B).

Figure 8A:
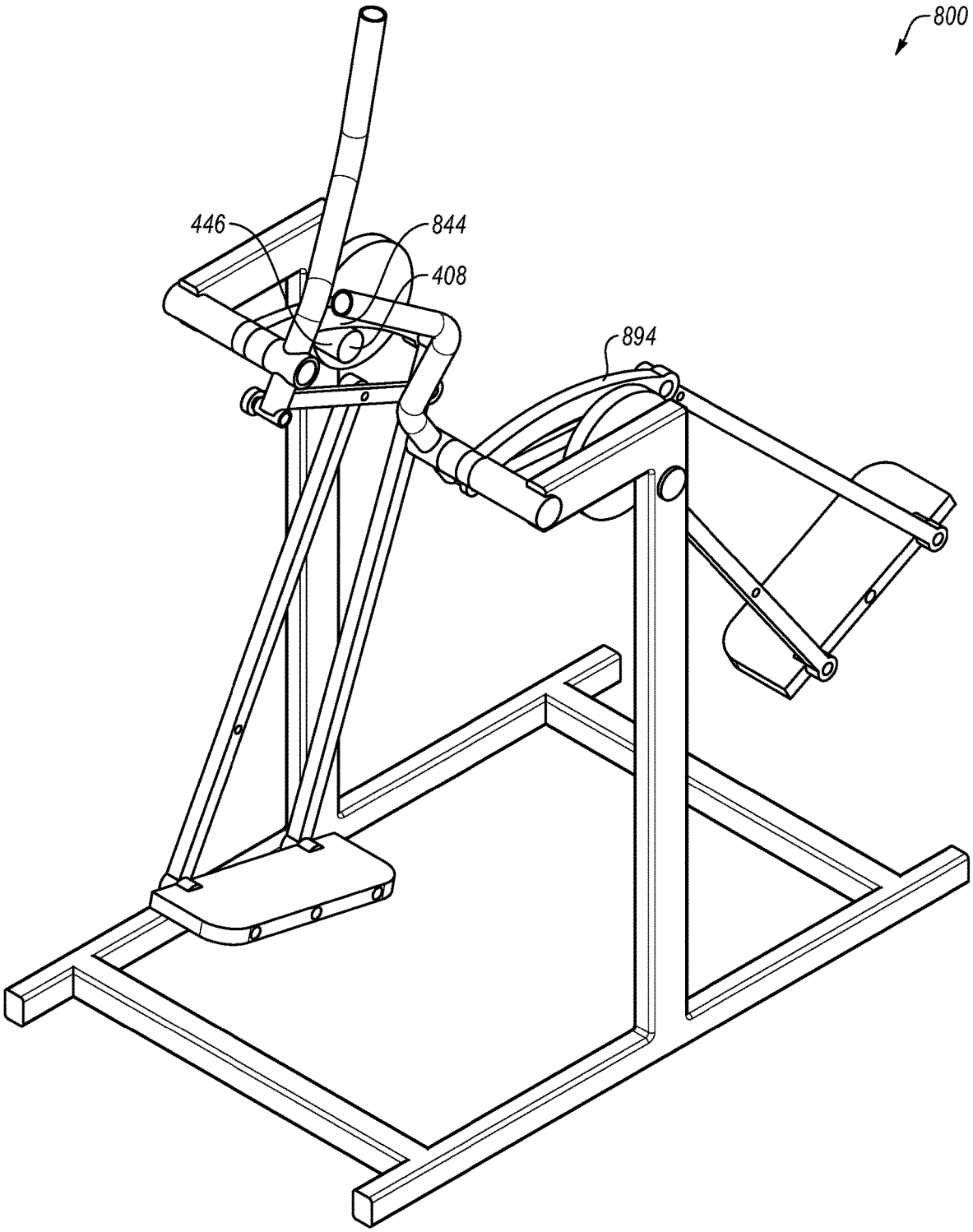
FIGS. 8A-8G are front-left, rear, right, front, left, top, and bottom perspective views, respectively, of a fifth example elliptical exercise machine.
Figure 8B:
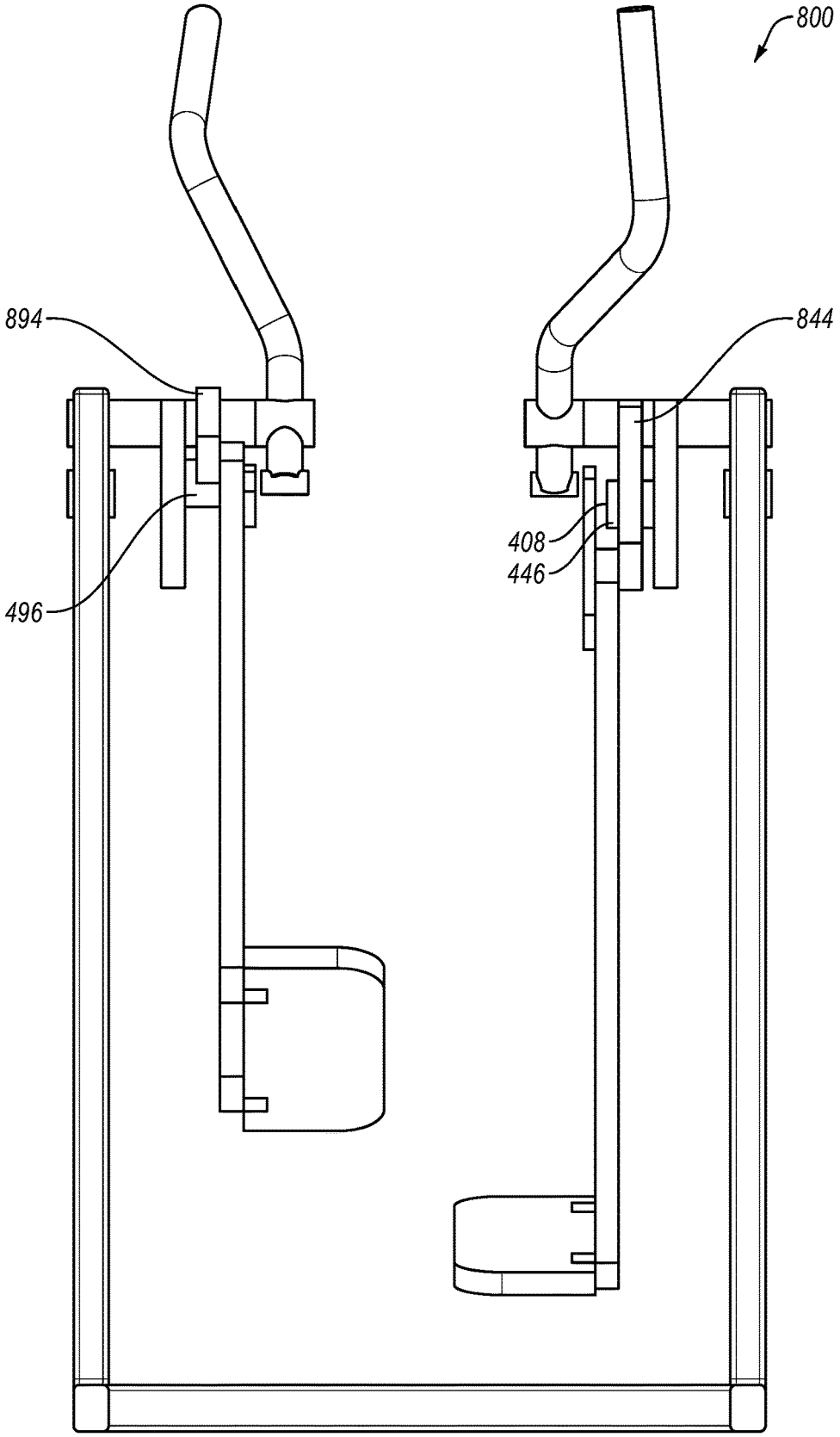
Figure 8C:
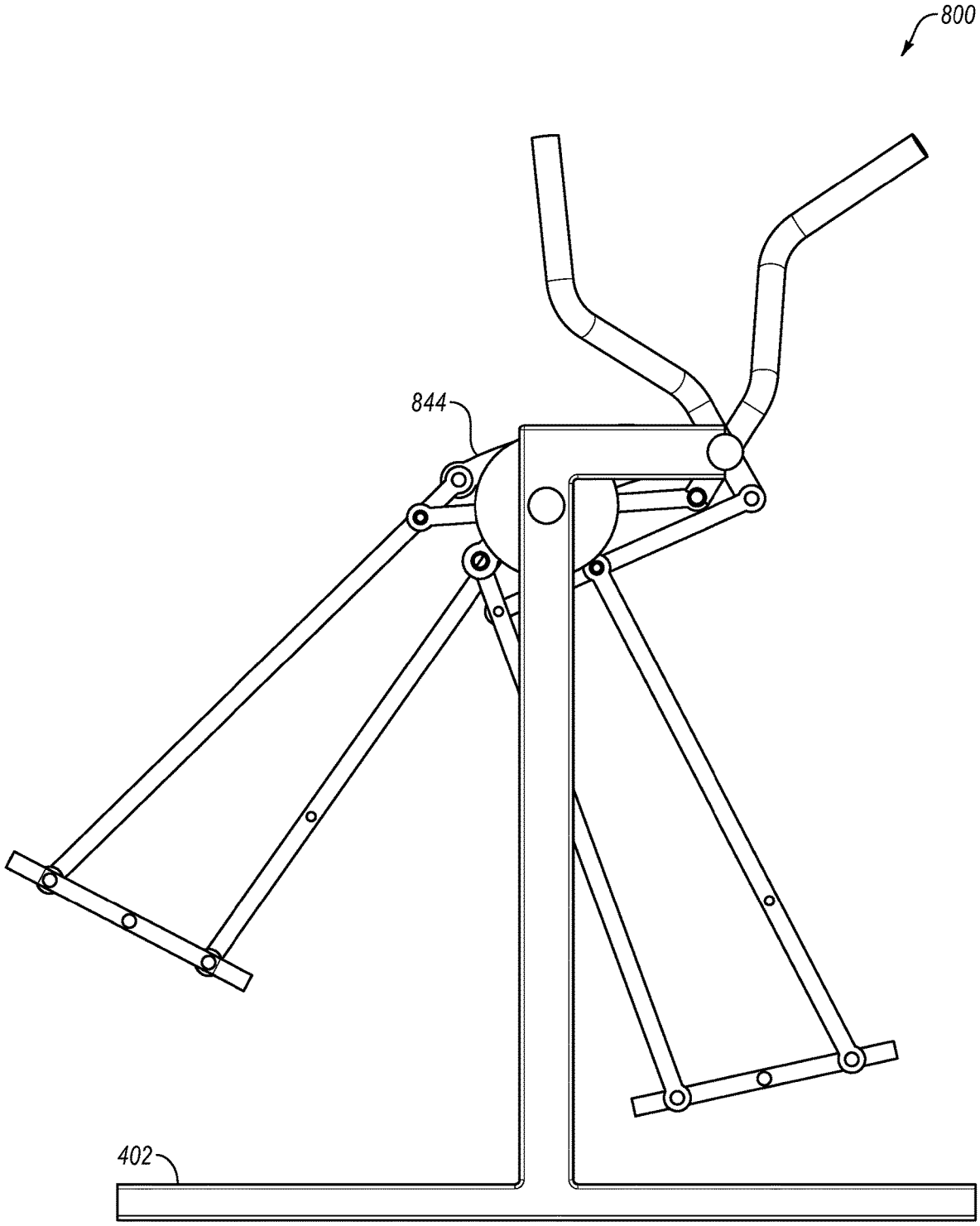
Figure 8D:
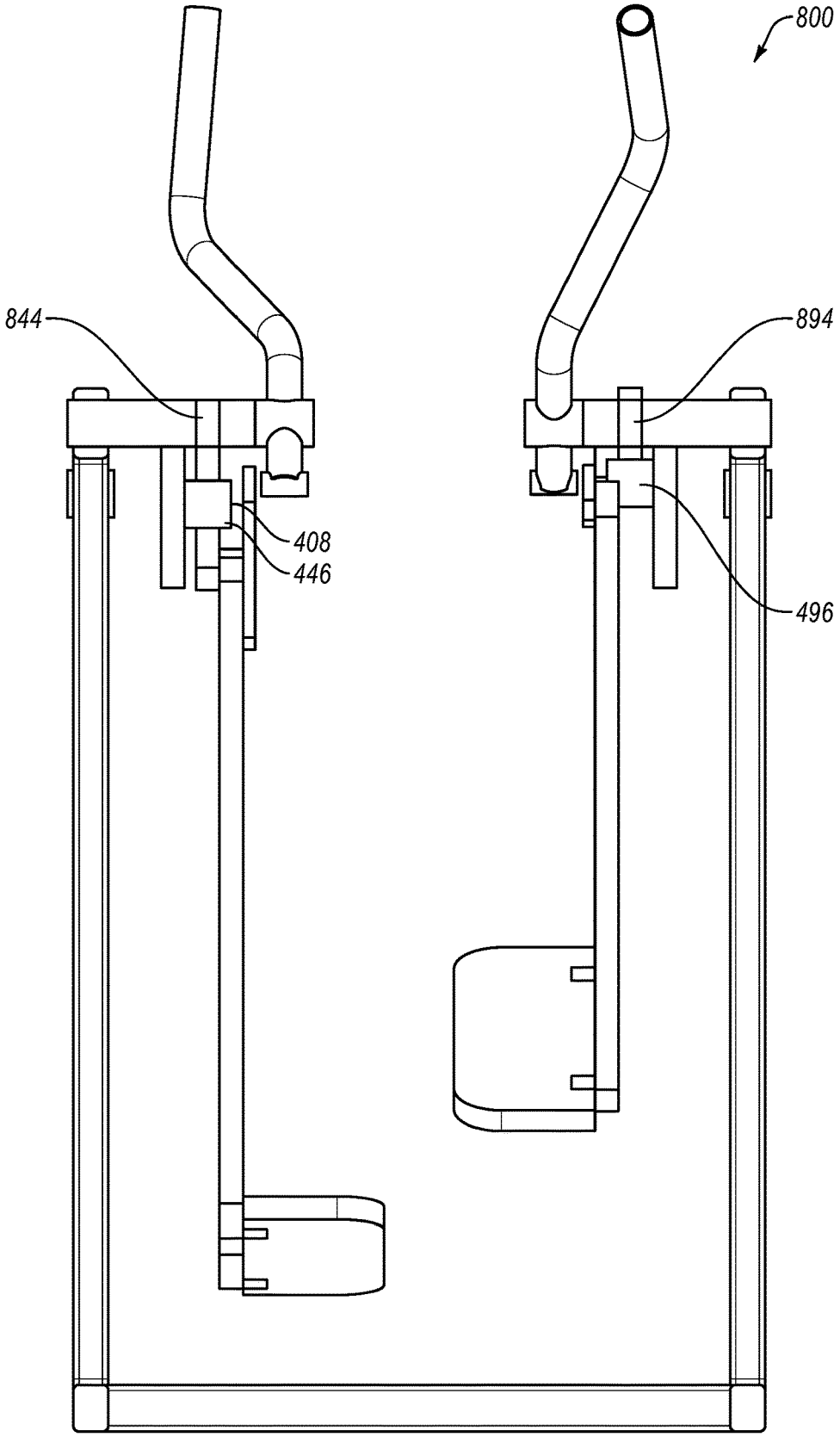
Figure 8E:
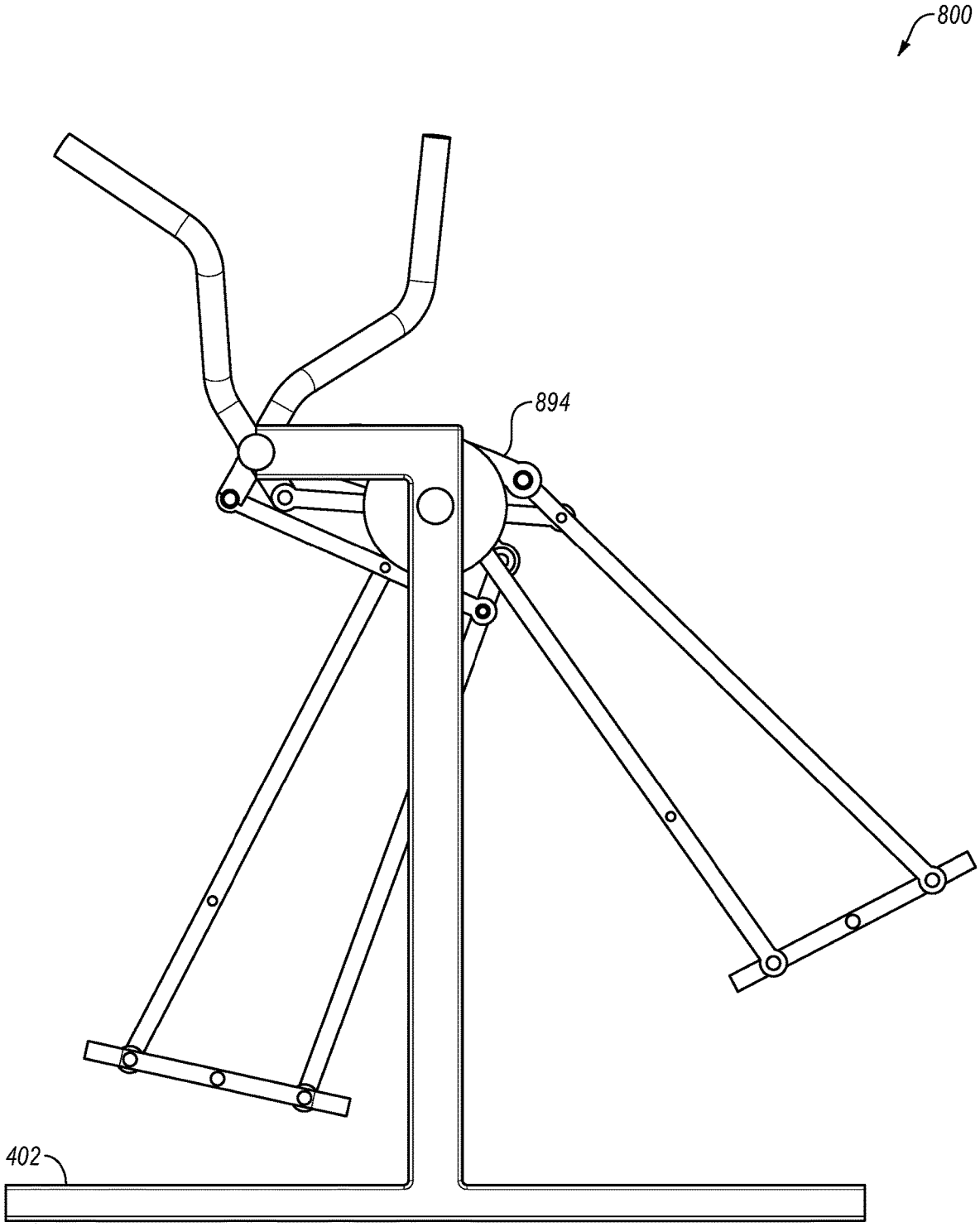
Figure 8F:
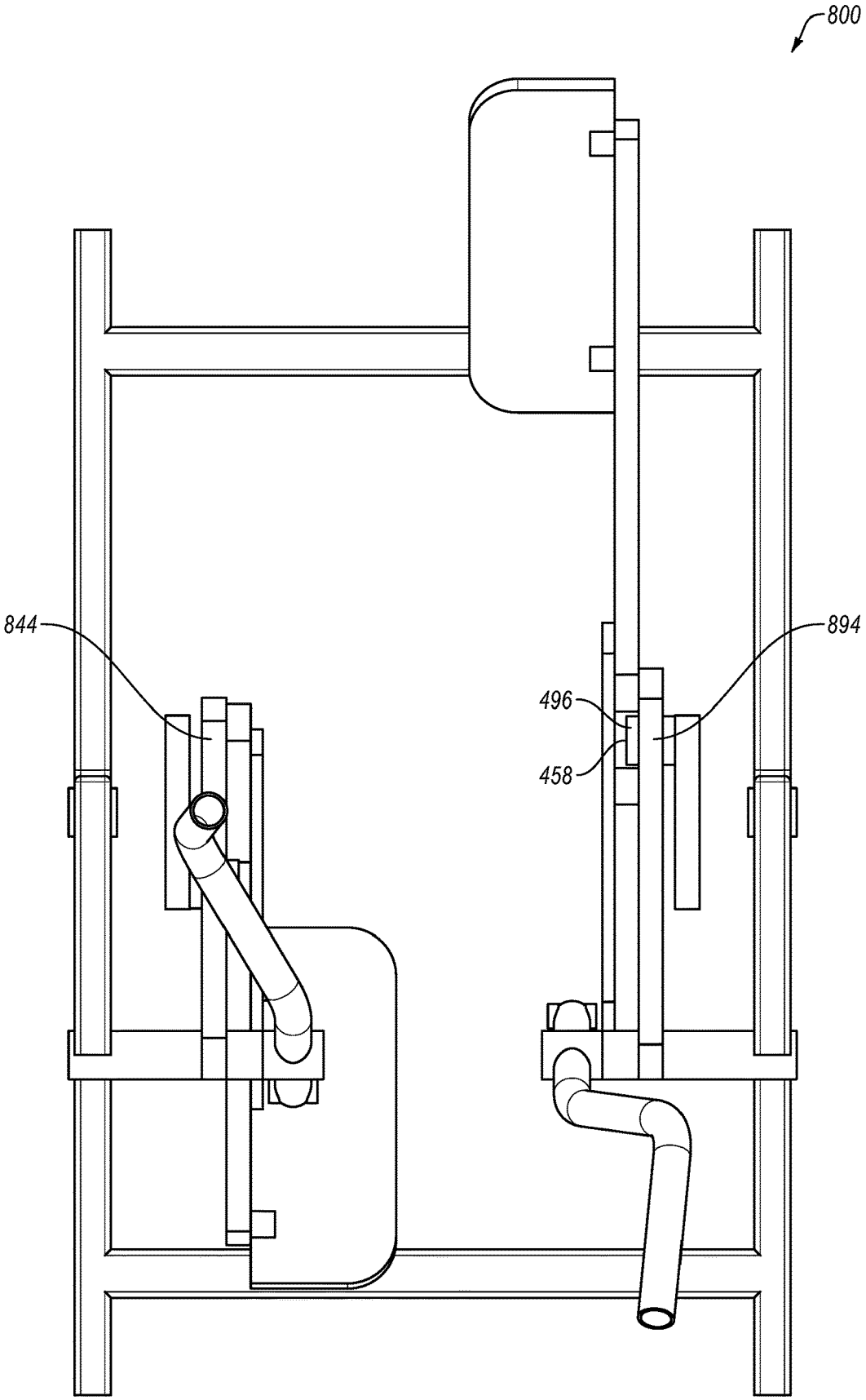
Figure 8G:
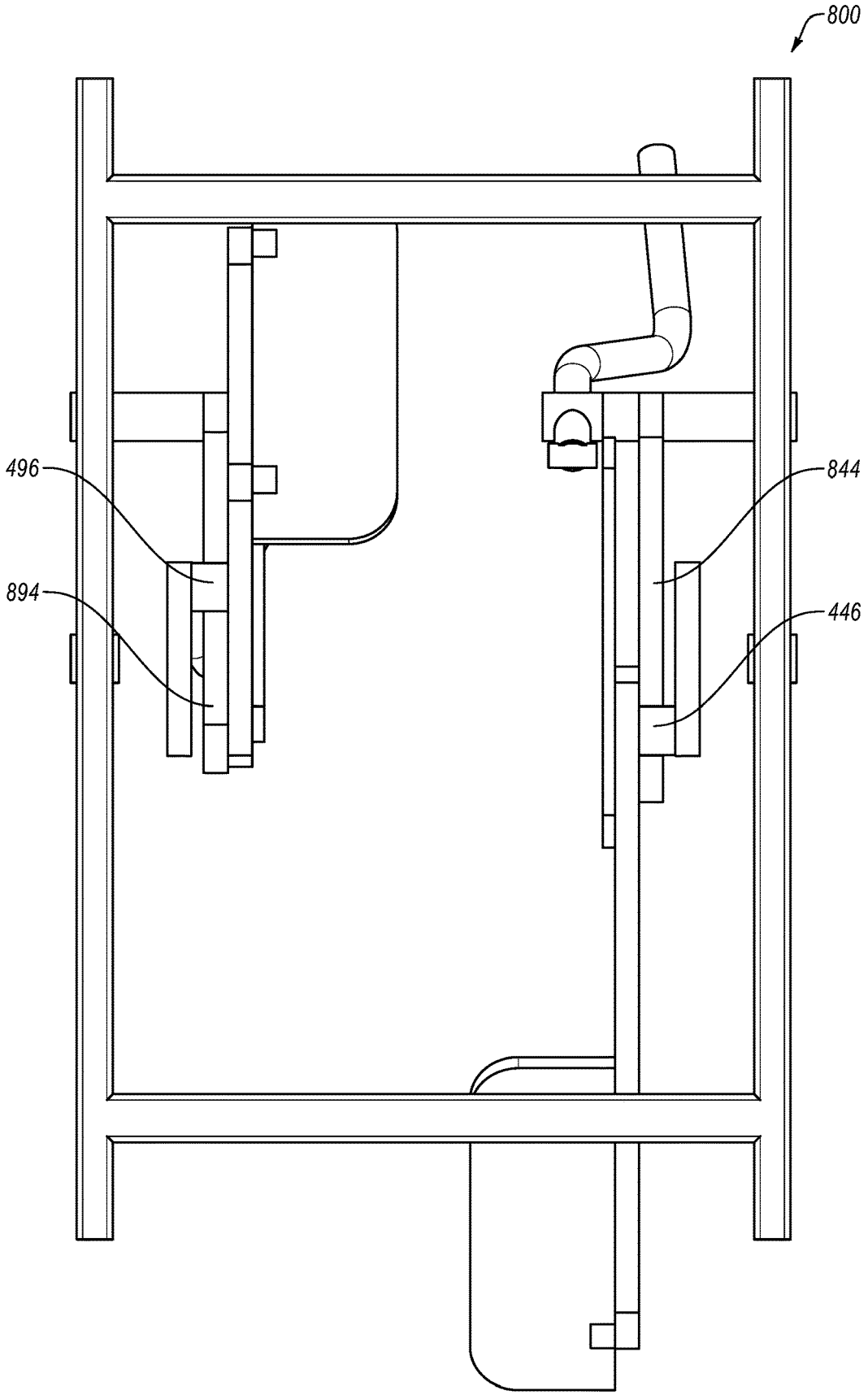

FIGS. 8A-8G are front-left, rear, right, front, left, top, and bottom perspective views, respectively, of a fifth example elliptical exercise machine 800. The machine 800 is similar to the machine 600, and therefore the discussion of the machine 800 will be limited to aspects of the machine 800 that differ from the machine 600.

Figure 9A:
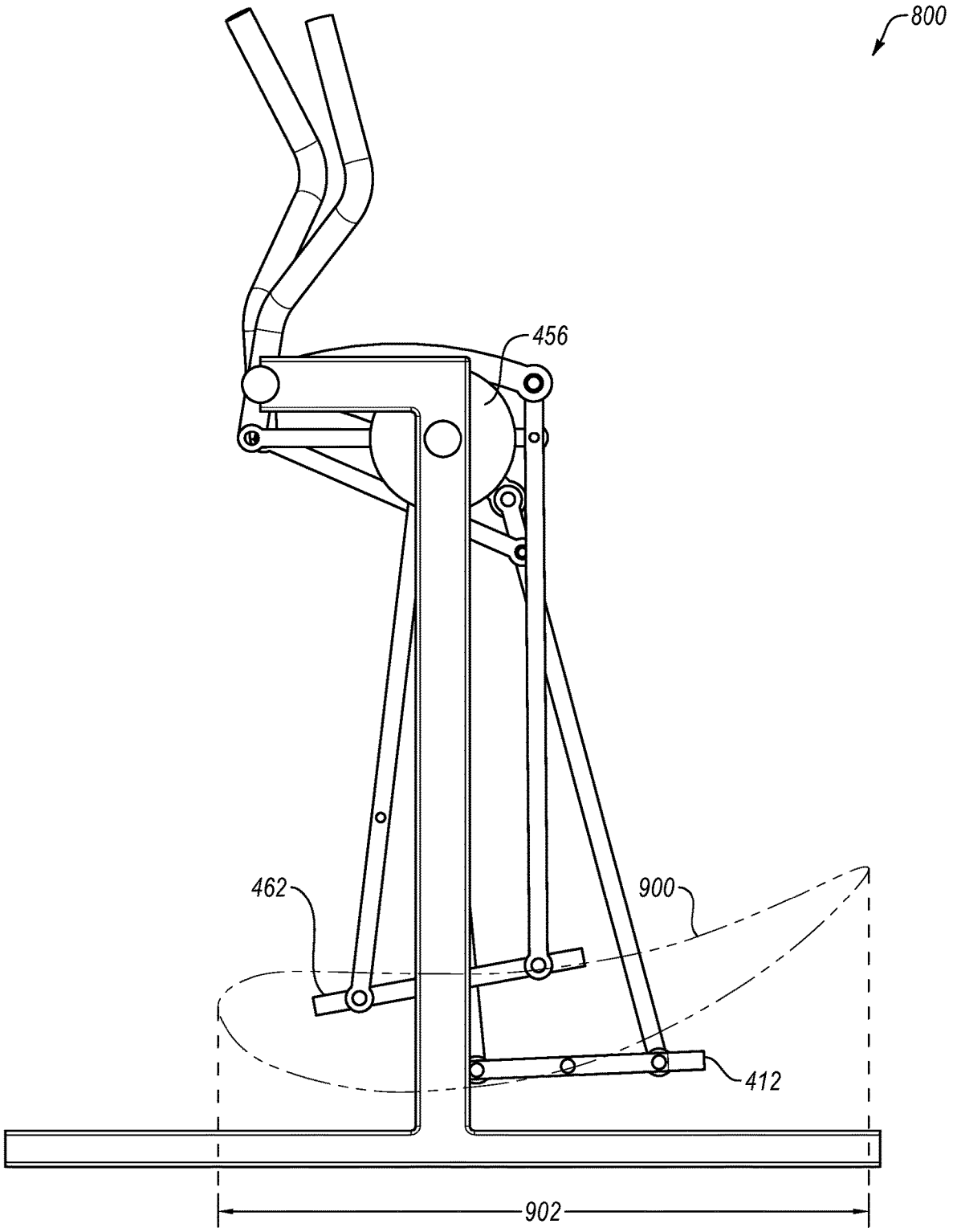
FIGS. 9A-9E are left views of the fifth example elliptical exercise machine, illustrating an example elliptical path of the fifth example elliptical exercise machine.
Figure 9B:
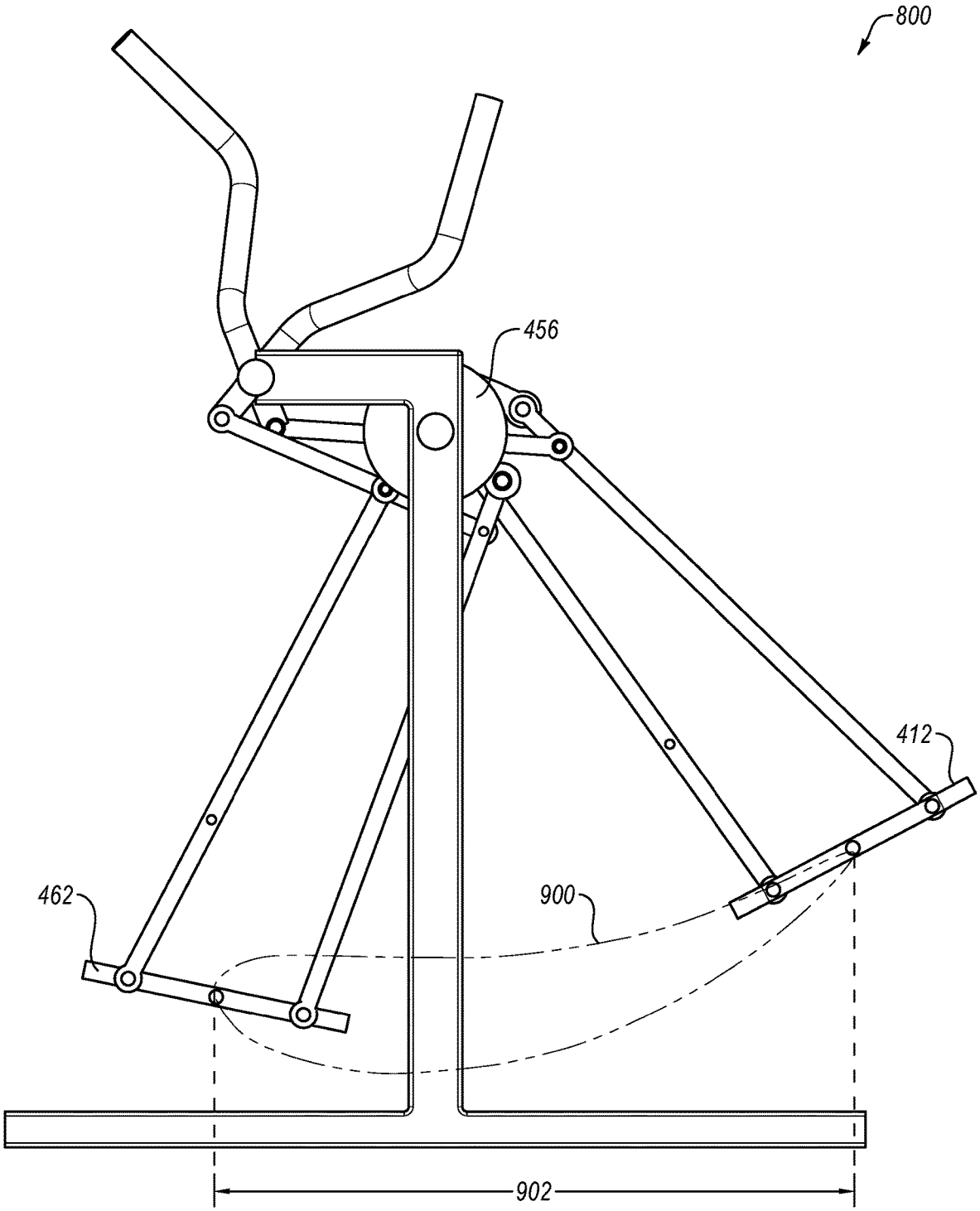
Figure 9C:
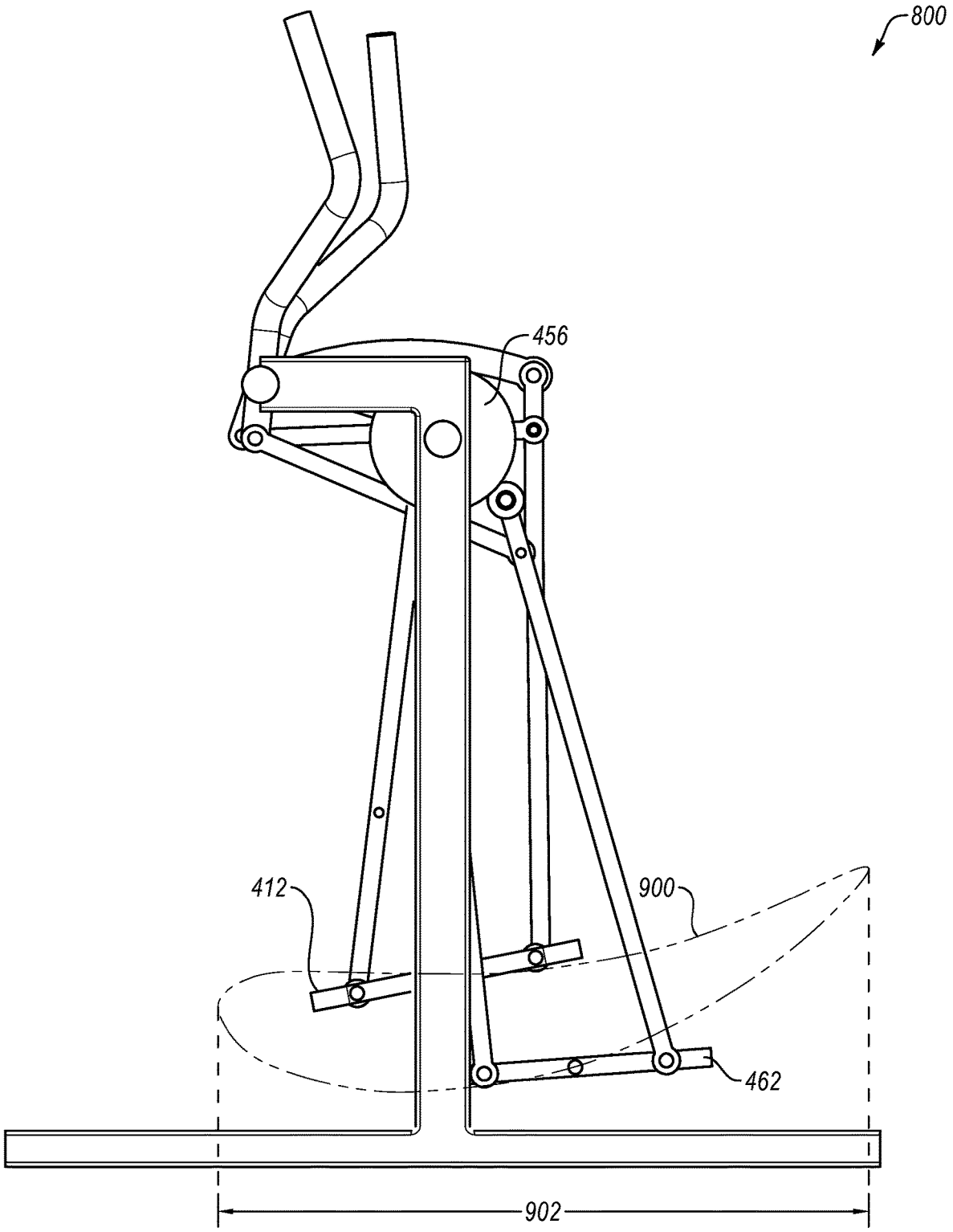
Figure 9D:
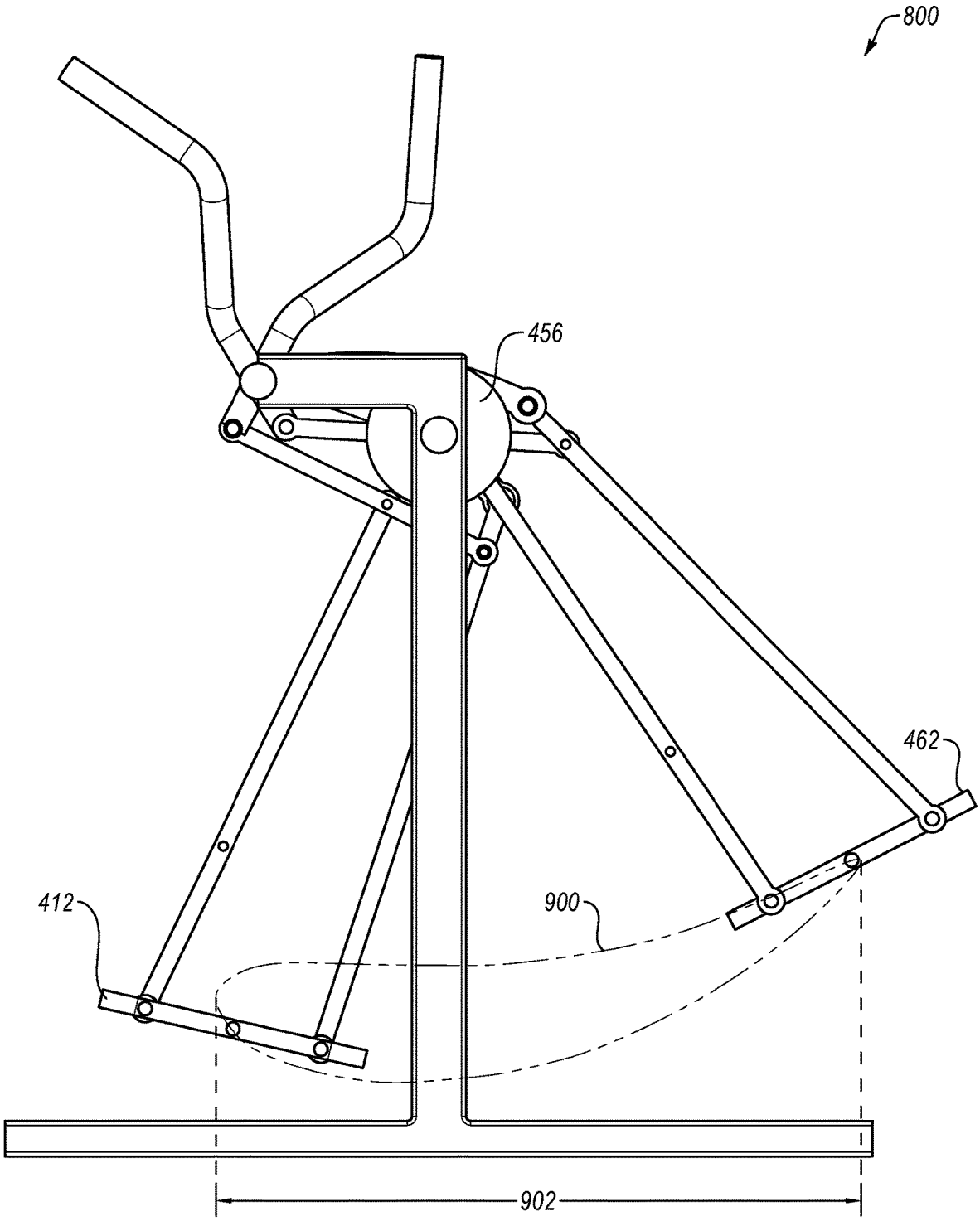
Figure 9E:
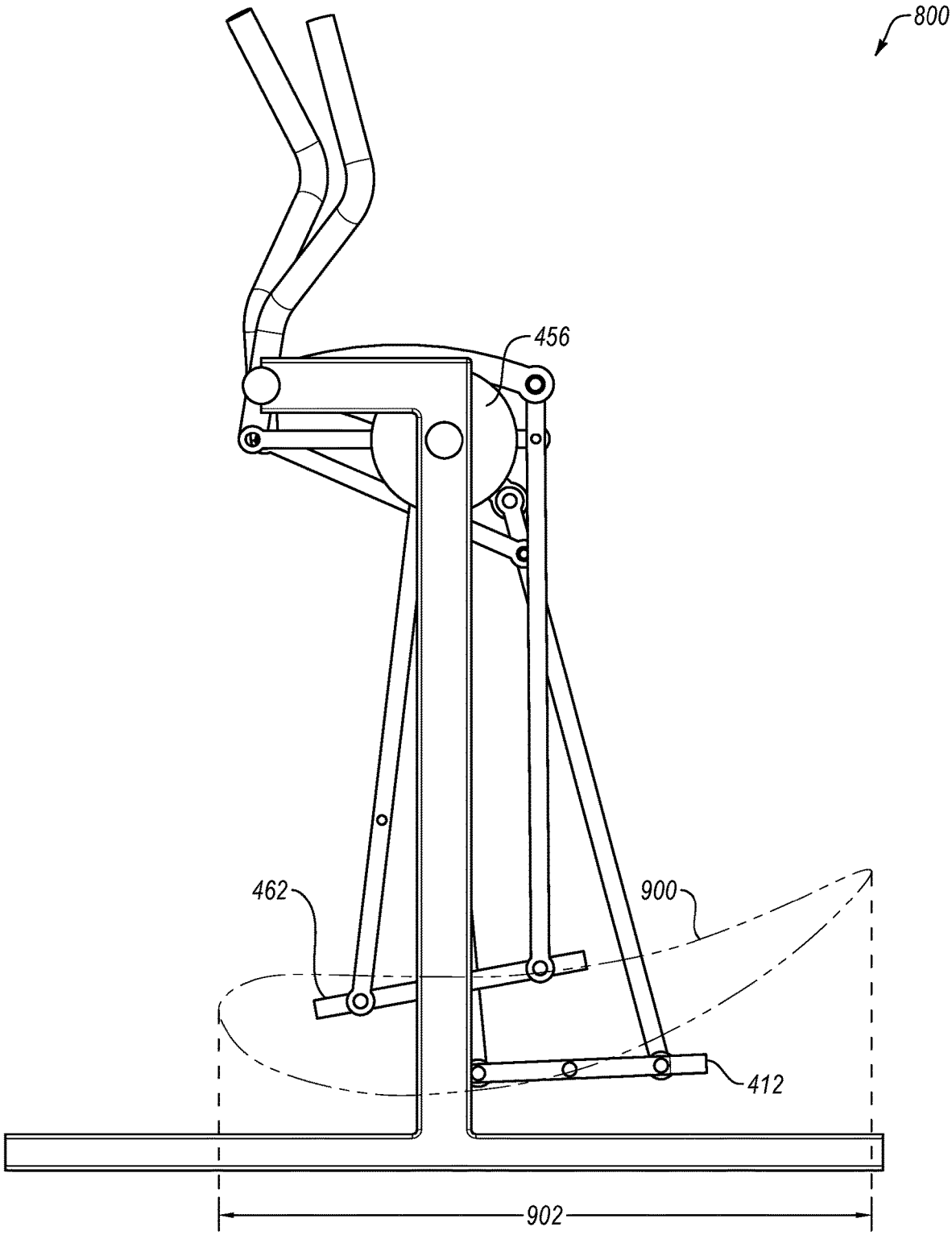

In place of the right roller arm 444 and the left roller arm 494 of the machine 600 (see FIG. 6A), the machine 800 may include a right roller arm 844 and a left roller arm 894. A surface of the right roller arm 844 that is configured to roll atop the right roller 446 may be curved and a surface of the left roller arm 894 that is configured to roll atop the left roller 496 may be curved. In the machine 800, each of these curved surfaces is a concave curved surface that is curved toward the corresponding roller. By curving the surface of each roller arm that rolls atop each roller, differently shaped elliptical paths may be achieved (e.g., compare the shape of the elliptical path 700 of FIGS. 7A-7E to the shape of the elliptical path 900 of FIGS. 9A-9E).

FIGS. 9A-9E are left views of the fifth example elliptical exercise machine 800, illustrating an example elliptical path 900 of the fifth example elliptical exercise machine 800.

During operation of the machine 800, the right pedal 412 may be configured to swing forward and rearward along the elliptical path 900 by a user's right foot striding forward and rearward with a length 902 of each swing determined by a length of the stride of the user's right foot. The right pedal 412 may be configured to raise upward and lower downward along the elliptical path 900 as the right crank arm 408 (see e.g., FIG. 8A) moves upward and downward during rotation of the right crank 406 (see e.g., FIG. 8A) Similarly, the left pedal 462 may be configured to swing forward and rearward along the elliptical path 900 by a user's left foot striding forward and rearward with a length 902 of each swing determined by a length of the stride of the user's left foot. The left pedal 462 may be configured to raise upward and lower downward along the elliptical path 900 as the left crank arm 458 (see e.g., FIG. 8F) moves upward and downward during rotation of the left crank 456.

The machine 800 may therefore allow for the elliptical path 900 to have a dynamically variable stride length 902 which allows the user to stride with a stride length that is comfortable to the user. Also, machine 800 may have a shorter front-to-back footprint than conventional elliptical exercise machines. This relatively shorter front-to-back footprint may result in at least a portion of the right pedal 412 being configured to swing rearward further than a rearmost portion of the base 402 (see, e.g., FIG. 9B) and at least a portion of the left pedal 462 being configured to swing rearward further than a rearmost portion of the base 402 (see, e.g., FIG. 9D).

INDUSTRIAL APPLICABILITY

In general, the example elliptical exercise machines disclosed herein may enable a dynamically variable stride length which allows the user to stride with a stride length that is comfortable to the user. Any variation in this dynamically variable stride length may be accomplished by a user simply taking a longer or shorter stride at any point during an exercise session. Further, the example elliptical exercise machines disclosed herein may take up relatively small amounts of floor space, which can make them easier to fit onto the floor space of an exercise area in a gym or a room in a home. This relatively small amount of floor space may be achieved by a relatively shorter front-to-back footprint that is accomplished, at least in part, by positioning the right and left cranks near the height of the user's hips, instead of positioning the right and left cranks down low near the user's feet as is done in most conventional elliptical exercise machines. Thus, the example elliptical exercise machines disclosed herein may overcome the shortcomings of conventional elliptical exercise machines, thereby enabling a more comfortable elliptical exercise for users while taking up less floor space in a gym or in a home.

Various modifications to the methods disclosed above will now be disclosed.

In the machine 800, the curved surfaces of the right roller arm 844 and the left roller arm 894 may be convex curved surfaces that are curved away from the corresponding rollers. By modifying the shape of these curved surfaces, differently shaped elliptical paths may be achieved.

Any of the example elliptical exercise machines disclosed herein may include a timing mechanism configured to cause the right crank arm to rotate about 180 degrees out of phase from the left crank arm. One example timing mechanism is the timing shaft 174 and associated belts and pulleys of the machine 100. Another example timing mechanism is the timing cable 136 and associated pulleys of the machines 200 and 400. It is understood that other example timing mechanisms that accomplish a similar result may be employed.

Additionally or alternatively, any of the example elliptical exercise machines disclosed herein may include a resistance mechanism configured to provide resistance to rotation of the right crank and/or the left crank. Where the right crank and the left crank are coupled together with a timing mechanism, providing resistance to either crank will effectively also provide resistance to the other crank via the timing mechanism. One example resistance mechanism is the flywheel 164 and associated belts and pulleys of the machine 100. It is understood that other example resistance mechanisms that accomplish a similar result may be employed. For example, the double-reduction pulley 168 may be eliminated from the resistance mechanism of the machine 100. Also, a magnetic brake may be employed on the machine 100 in connection with the flywheel 164 of the machine 100. The magnetic brake may be configured to provide variable resistance to the rotation of the flywheel 164. The magnetic brake may be any type of magnetic brake including an Eddy brake, a caliper brake with magnets on either side of the flywheel, a drum brake with magnets around the circumference of the flywheel, or a brake that only has magnets on one side of the flywheel. The magnets in the magnetic brake may be permanent magnets, or may be electro-magnets that require a power source in order to function. Further, instead of a magnetic brake, any other type of brake may be employed to provide variable resistance to the rotation of the flywheel 164, such as a friction brake (e.g., a strap or drum brake around the flywheel 164 or a caliper brake on the sides of the flywheel 164 that provide variable resistance to the rotation of the flywheel 164), an air brake (e.g., fan blades on the flywheel 164 that cause the air surrounding the flywheel 164 to resist the rotation of the flywheel 164), or a fluid brake (e.g., fan blades on the flywheel 164 that cause a fluid, such as water, contained in a container that surrounds the flywheel 164 to resist the rotation of the flywheel 164).

Additionally or alternatively, any of the example elliptical exercise machines disclosed herein may include an anti-skate mechanism configured to reduce or eliminate "skate" in the elliptical exercise machine. The term "skate" as used herein refers to the sensation where a pedal inadvertently extends farther forward or farther backward than is comfortable for the user, similar to the sensation one feels when a stride is uncomfortably and inadvertently lengthened for a user while wearing ice skates or roller skates. In some embodiments, an anti-skate mechanism may be implemented as part of a resistance mechanism, due to resistance on the right crank and/or the left crank tending to eliminate skate in the right and left pedals. Also, in some embodiments, an anti-skate mechanism may be implemented as part of a timing mechanism, due to coordination of the phases of the right crank and the left crank tending to eliminate skate in the right and left pedals. It is understood that other example anti-skate mechanisms that accomplish a similar result may be employed.

Additionally or alternatively, any of the example elliptical exercise machines disclosed herein may include a computer console configured to receive input from the user and provide output to the user, and/or configured to control the elliptical exercise machine. For example, the computer console may be employed in connection with the magnetic brake discussed above in order to allow the user to manually or programmatically alter the amount of resistance that the magnetic brake applies during the course of an exercise session on the elliptical exercise machine. The computer console may be configured to communicate over a network with other similar exercise machines, with servers, with computing devices of personal trainers, with sensors such as heart rate and respiration sensors, etc. Further, the computer console may be capable of downloading and uploading data in order to, for example, download and upload exercise sessions, data gathered at the elliptical exercise machine, data gathered at other exercise machines, etc. The computer console may enable a user of the elliptical exercise machine to compete with a user of another similar or dissimilar exercise machine, that is local to or remote from the user, with the competing users competing in real-time or at different times. Further, the computer console may be configured to track the amount of resistance provided by the magnetic brake to the flywheel, and the number or rotations of the flywheel, during an exercise session in order to compute the number of calories burned, the amount of energy expended, or any other metric desired by the user. Further, the computer console may be configured to track the number of strides taken by the user, as well as the length of each stride, in order to track the distance traveled by a user on the elliptical exercise machine during an exercise session. Further, all data tracked or downloaded by the computer console may be presented to the user on a display of the computer console.

Additionally or alternatively, any of the example elliptical exercise machines disclosed herein may include components moved from generally mirrored left-and-right positions to other positions, such as non-mirrored positions or center positions. For example, instead of left and right upright stanchions, any of the example elliptical exercise machines disclosed herein may instead include a single upright stanchion (perhaps positioned near the center of the base) that functions similarly to the left and right stanchions disclosed in the drawings. In another example, more than two upright stanchions may functions similarly to the left and right stanchions disclosed in the drawings. Therefore, the terms "left" and "right" as disclosed herein are for convenience only and are not intended to dictate generally mirrored left-and-right positions of components.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

The invention claimed is:

1. An elliptical exercise machine comprising:

a base;

one or more upright stanchions coupled to the base and extending upward from the base;

a first crank supported by the one or more upright stanchions, the first crank supporting a first crank arm that is offset from the center of the first crank, the first crank arm defining a first axis and supporting a first pedal leg hanging downward from the first crank arm to allow the first pedal leg to pivot about the first axis, the first pedal leg supporting a right pedal, the right pedal and the first pedal leg configured to simultaneously swing forward and rearward by a user's right foot striding forward and rearward with a length of each swing determined by a length of a stride of the user's right foot, the right pedal configured to raise upward and lower downward as the first crank arm moves upward and downward during rotation of the first crank; and a second crank supported by the one or more upright stanchions, the second crank supporting a second crank arm that is offset from the center of the second crank, the second crank arm defining a second axis and supporting a second pedal leg hanging downward from the second crank arm to allow the second pedal leg to pivot about the second axis, the second pedal leg supporting a left pedal, the left pedal and the second pedal leg configured to simultaneously swing forward and rearward by a user's left foot striding forward and rearward with a length of each swing determined by a length of a stride of the user's left foot, the left pedal configured to raise upward and lower downward as the second crank arm moves upward and downward during rotation of the second crank.

2. The elliptical exercise machine of claim 1, further comprising:

a flywheel coupled to the first crank and/or the second crank, the flywheel configured to provide resistance to rotation of the first crank and/or the second crank.

3. The elliptical exercise machine of claim 2, further comprising:

a magnetic brake configured to provide variable resistance to the rotation of the flywheel.

4. The elliptical exercise machine of claim 2, further comprising:

a crank pulley configured to rotate in phase with the first crank or with the second crank;

a double-reduction pulley;

a flywheel belt coupling the flywheel to the double-reduction pulley; and an intermediate belt coupling the double-reduction pulley to the crank pulley.

5. The elliptical exercise machine of claim 1, further comprising:

a timing shaft and belts and pulleys coupling the first crank to the second crank to cause the first crank arm to rotate about 180 degrees out of phase from the second crank arm.

6. The elliptical exercise machine of claim 5, wherein:

the timing shaft is coupled to the one or more upright stanchions.

7. The elliptical exercise machine of claim 5, wherein belts and pulleys include:

a first crank pulley configured to rotate in phase with the first crank;

a first timing shaft pulley configured to rotate in phase with the timing shaft;

a first belt coupling the first crank pulley to the first timing shaft pulley;

a second crank pulley configured to rotate in phase with the second crank;

a second timing shaft pulley configured to rotate in phase with the timing shaft; and a second belt coupling the second crank pulley to the second timing shaft pulley.

8. The elliptical exercise machine of claim 1, further comprising:

a timing cable and pulleys coupling the first crank to the second crank to cause the first crank arm to rotate about 180 degrees out of phase from the second crank arm.

9. The elliptical exercise machine of claim 8, wherein the pulleys include:

a first crank pulley configured to rotate in phase with the first crank;

upper and lower first timing pulleys;

a second crank pulley configured to rotate in phase with the second crank; and upper and lower second timing pulleys.

10. The elliptical exercise machine of claim 9, wherein the timing cable is configured in a loop and is configured to couple the first crank pulley to the upper and lower first timing pulleys, and to couple the upper and lower first timing pulleys to the upper and lower second timing pulleys, and to couple the upper and lower second timing pulleys to the second crank pulley.

11. The elliptical exercise machine of claim 1, further comprising:

a first swing handle, the first swing handle coupled to a first swing arm, the first swing arm coupled to the first pedal leg; and a second swing handle, the second swing handle coupled to a second swing arm, the second swing arm coupled to the second pedal leg.

12. The elliptical exercise machine of claim 11, wherein:

the first pedal leg is supported by the first crank arm via a coupling to a first roller arm, the first roller arm configured to roll atop a first roller that is coupled to the first crank arm; and the second pedal leg is supported by the second crank arm via a coupling to a second roller arm, the second roller arm configured to roll atop a second roller that is coupled to the second crank arm.

13. The elliptical exercise machine of claim 12, further comprising:

a third pedal supported by the first swing arm and hanging downward from the first swing arm, the third pedal leg further supporting the right pedal; and a fourth pedal leg supported by the second swing arm and hanging downward from the second swing arm, the fourth pedal leg further supporting the left pedal.

14. The elliptical exercise machine of claim 13, wherein:

a surface of the first roller arm that is configured to roll atop the first roller is a curved surface; and a surface of the second roller arm that is configured to roll atop the second roller is a curved surface.

15. The elliptical exercise machine of claim 14, wherein:

the curved surface of the first roller arm is a concave surface; and the curved surface of the second roller arm is a concave surface.

16. The elliptical exercise machine of claim 14, wherein:

the curved surface of the first roller arm is a convex surface; and the curved surface of the second roller arm is a convex surface.

17. The elliptical exercise machine of claim 1, wherein:

at least a portion of the right pedal is configured to swing rearward further than a rearmost portion of the base; and at least a portion of the left pedal is configured to swing rearward further than the rearmost portion of the base.

* * * * *